United States Patent [19]

Ohki et al.

[11] Patent Number: 5,064,751

[45] Date of Patent: Nov. 12, 1991

[54] METHOD OF PROCESSING A SILVER HALIDE COLOR PHOTOGRAPHIC MATERIAL AND A COLOR DEVELOPER WHERE THE DEVELOPER CONTAINS A HYDRAZINE COMPOUND

[75] Inventors: Nobutaka Ohki; Kazuto Andoh; Hideaki Naruse; Hiroshi Fujimoto; Jiro Tsukahara; Morio Yagihara; Takatoshi Ishikawa, all of Kanagawa, Japan

[73] Assignee: Fuji Photo Film Co., Ltd., Kanagawa, Japan

[21] Appl. No.: 644,863

[22] Filed: Jan. 23, 1991

Related U.S. Application Data

[63] Continuation of Ser. No. 346,357, Apr. 28, 1989, abandoned, which is a continuation of Ser. No. 77,136, Jul. 23, 1987, abandoned.

[30] Foreign Application Priority Data

Jul. 23, 1986 [JP] Japan ..... 61-173468
Jul. 23, 1986 [JP] Japan ..... 61-1711682

[51] Int. Cl.[5] ..... G03C 7/30

[52] U.S. Cl. ..... 430/464; 430/264; 430/434; 430/467; 430/468; 430/486; 430/490; 430/598

[58] Field of Search ..... 430/264, 372, 377, 380, 430/464, 467, 468, 486, 490, 598, 434

[56] References Cited

U.S. PATENT DOCUMENTS

| | | | |
|---|---|---|---|
| 2,772,973 | 12/1956 | Britain | 430/470 |
| 3,141,771 | 7/1964 | Bard et al. | 430/214 |
| 3,227,552 | 1/1966 | Whitmore | 430/217 |
| 3,996,054 | 12/1976 | Santemma et al. | 430/377 |
| 4,481,268 | 11/1984 | Bailey et al. | 430/484 |
| 4,650,746 | 3/1987 | Simson et al. | 430/490 |
| 4,684,604 | 8/1987 | Harder | 430/598 |
| 4,801,521 | 1/1989 | Ohki et al. | 430/467 |
| 4,839,268 | 6/1989 | Bando | 430/379 |

FOREIGN PATENT DOCUMENTS 158446 9/1985 Japan .

*Primary Examiner*—Charles L. Bowers, Jr.
*Assistant Examiner*—Patrick A. Doody
*Attorney, Agent, or Firm*—Sughrue, Mion, Zinn, Macpeak & Seas

[57] ABSTRACT

A method for processing a silver halide color photographic material including the step of developing the silver halide color photographic material with a color developing solution containing at least one aromatic primary amine developing agent and at least one hydrazide represented by the following formula (I) or (II)

$$R^1—X^1—NHNH—R^2 \quad (I)$$

in which $X^1$ represents —CO—, —$SO_2$— or $$—\overset{\overset{NH}{\|}}{C}—;$$

$R^1$ represents a hydroxyl group, a hydroxyamino group, carbamoyl group, a hydrazinocarbonyl group, an amino group, or a hydrazino group; and $R^2$ represents a hydrogen atom, an alkyl group, or an aryl group; provided that the $R^1$ or $R^2$ groups of at least two of the hydrazide groups may be linked to form a dimer or higher polymer of the hydrazide.

$$R^3—X^2—NHNH—R^4 \quad (II)$$

in which $X^2$ represents —CO— or —$SO_2$—; $R^3$ represents a hydrogen atom, an alkyl group, an aryl group, a heterocyclic group, an alkoxy group, or an aryloxy group; and $R^4$ represents a hydrogen atom, an alkyl group or an aryl group; provided that the $R^3$ or $R^4$ groups of at least two of the hydrazide groups may be linked to form a dimer or higher polymer of the hydrazide. The method provides increased developer stability and reduced fog formation, particularly in continuous processing.

10 Claims, No Drawings

METHOD OF PROCESSING A SILVER HALIDE COLOR PHOTOGRAPHIC MATERIAL AND A COLOR DEVELOPER WHERE THE DEVELOPER CONTAINS A HYDRAZINE COMPOUND

This is a continuation of application Ser. No. 07/346,357 filed Apr. 28, 1989, which is a continuation of application Ser. No. 07/077,136 filed July, 23, 1987 now abandoned.

FIELD OF THE INVENTION

This invention relates to a method of processing silver halide color photographic materials, and more particularly to photographic processing using a color developer (i.e., color developing composition) having improved stability and color forming ability, and providing greatly reduced fog formation especially in continuous processing.

BACKGROUND OF THE INVENTION

A color developer using an aromatic primary amine color developing agent is conventionally used in color image-forming processes and at present is generally used in the image forming process for color developer. However, as is well known, this color developer is easily oxidized by air or metals, and when color images are formed using such an oxidized color developer, fog formation is increased and sensitivity and gradation are changed, undesirably affecting photographic properties.

Accordingly, various methods for improving the preservability of color developer have been investigated and in particular, a hydroxylamine and a sulfite ion have often been used in a color developer. However, hydroxylamine generates ammonia if it is decomposed, which causes the formation of fog, and sulfite ion disadvantageously acts as a competing compound for a color developing agent, to inhibit the coloring property, etc. Thus, neither component is a preferred preservative.

Furthermore, for improving the stability of color developers, various preservatives and chelating agents have been investigated. For example, proposed preservatives include aromatic polyhydroxy compounds described in Japanese Patent Application (OPI) Nos. 49828/77, 160142/84, and 47038/81 corresponding to U.S. Pat. No. 4,264,716 (the term "OPI" as used herein indicates an "unexamined published Japanese patent application"), and U.S. Pat. No. 3,746,544; hydroxycarbonyl compounds described in U.S. Pat. No. 3,615,503 and British Patent No. 1,306,176; α-aminocarbonyl compounds described in Japanese Patent Application (OPI) Nos. 143020/77 corresponding to U.S. Pat. Nos. 4,155,764 and 89425/78 corresponding to U.S. Pat. No. 4,142,895; alkanolamines described in Japanese Patent Application (OPI) No. 3532/79 corresponding to U.S. Pat. No. 4,170,478; and metal salts described in Japanese Patent Application (OPI) Nos. 44148/82 corresponding to U.S. Pat. Nos. 4,330,616 and 53749/82.

Also, proposed chelating agents include aminopolycarboxylic acids described in Japanese Patent Publication Nos. 30496/73 and 30232/69 corresponding to U.S. Pat. No. 3,462,269 organic phosphonic acids described in Japanese Patent Application (OPI) No. 97347/81, Japanese Patent Publication No. 39359/81 corresponding to U.S. Pat. No. 3,794,591 and West German Patent No. 2,227,739; phosphonocarboxylic acids described in Japanese Patent Application (OPI) Nos. 102726/77 corresponding to U.S. Pat. No. 4,083,723 42730/78 corresponding to U.S. Re Nos. 30064, 121127/79, 126241/80, and 65956/80; and the compounds described in Japanese Patent Application (OPI) Nos. 19584/83 corresponding to U.S. Pat. Nos. 4,482,626 and 203440/83, and Japanese Patent Publication No. 40900/78.

However, since these techniques provide insufficient preservability or adversely affect photographic characteristics, satisfactory results are not obtained by using these techniques.

In particular, when benzyl alcohol, which is a harmful pollutant, is omitted from a color developer inevitably a deterioration of its colorforming ability occurs. In such a system, preservatives which act as competing compounds for color developing agents greatly reduce the coloring properties. Therefore, many of these conventional techniques are unsatisfactory in such a system.

A color developer containing hydrazides as disclosed in U.S. Pat. Nos. 3,141,771 and 2,772,973 does not provide satisfactory preservability.

Furthermore, a color photographic light-sensitive material having silver chlorobromide emulsions containing a large amount of silver chloride is susceptible to fogging upon color development, as disclosed in Japanese Patent Application (OPI) Nos. 95345/83 and 232342/84. When processing such a silver halide emulsion, a preservative which dissolves less emulsion and has better preservability is greatly desired, but satisfactory preservatives with these characteristics have not yet been found.

Japanese Patent Application No. 169789/86 correlated to the present application relates to a color developer using different preservatives from that of the present invention.

SUMMARY OF THE INVENTION

An object of this invention is, therefore, to provide a photographic processing method using a color developer having excellent stability and coloring properties, and providing greatly reduced fog formation especially, in continuous processing.

It has now been discovered that this and other objects of the present invention can be attained by a method for processing a silver halide color photographic material, including developing the material with a color developer containing an aromatic primary amine color developing agent and at least one hydrazide represented by the following formula (I) or (II)

$$R^1—X^1—NHNH—R^2 \quad (I)$$

in which $X^1$ represents —CO—, —SO— or $$—\overset{\overset{\displaystyle NH}{\|}}{C}—;$$

$R^1$ represents a hydroxyl group, a hydroxyamino group, a carbamoyl group, a hydrazinocarbonyl group, an amino group, or a hydrazino group; and $R^2$ represents a hydrogen atom, an alkyl group, or an aryl group; provided that the $R^1$ or $R^2$ groups of at least two of the hydrazide groups may be linked to form a dimer or higher polymer of the hydrazide.

$$R^3—X^2—NHNH—R^4 \quad (II)$$

in which $X^2$ represents —CO— or —$SO_2$—; $R^3$ represents a hydrogen atom, an alkyl group, an aryl group, a heterocyclic group, an alkoxy group, or an aryloxy group; and $R^4$ represents a hydrogen atom, an alkyl group or an aryl group; provided that the $R^3$ or $R^4$ groups of at least two of the hydrazide groups may be linked to form a dimer or higher polymer of the hydrazide.

In another preferred embodiment of the process of this invention, the color developer contains substantially no benzyl alcohol.

DETAILED DESCRIPTION OF THE INVENTION

The hydrazides represented by formula (I) or (II) described above for use in this invention are now explained in greater detail.

In formula (I), $X^1$ represents a divalent group selected from —CO—, —SO— and $$-\overset{\overset{\displaystyle NH}{\|}}{C}-$$

as described above, and $R^1$ represents a hydroxyl group, a substituted or unsubstituted carbamoyl group, a substituted or unsubstituted hydrazinocarbonyl group, a substituted or unsubstituted amino group (having, preferably, 0 to 10 carbon atoms, such as an amino group, a diethylamino group, a dipropylamino group, a hexylamino group, an anilino group, a naphthylamino group etc.), or a substituted or unsubstituted hydrazino group (having, preferably, 0 to 10 carbon atom, such as an N',N'-dimethylhydrazino group, an N'-phenylhydrazino group, etc.).

$R^2$ in formula (I) is a hydrogen atom, a substituted or unsubstituted alkyl group (having, preferably 1 to 15, more preferably 1 to 10, and most preferably 1 to 7 carbon atoms, such as a methyl group, an ethyl group, a cyclohexyl group, a methoxyethyl group, etc.), or a substituted or unsubstituted aryl group (having, preferably, 6 to 10 carbon atoms, such as a phenyl group, a 3-hydroxyphenyl group, etc.).

The substituent which substitutes on the group $R^1$ preferably includes a halogen atom (e.g., a chlorine atom, a bromine atom, etc.), a hydroxyl group, a carboxyl group, a sulfo group, an amino group, an alkoxy group, an amido group, a sulfonamido group, a carbamoyl group, a sulfamoyl group, an alkyl group, an aryl group, an aryloxy group, an alkoxylthio group, an arylthio group, an acyl group, a nitro group, a cyano group, an ureido group, a sulfonyl group, a sulfinyl group, a hydrazinocarbonylaminc, group, a hydrazinocarbonyloxy group, etc. When the group $R^1$ has two or more substituents, the substituents are the same or different, and the substituents may be further substituted.

The substituent which substitutes for the group $R^2$ preferably includes a halogen atom (e.g., a chlorine atom, a bromine atom, etc.), a hydroxyl group, a carboxyl group, a sulfo group, an amino group, an alkoxy group, an amido group, a sulfonamido group, a carbamoyl group a sulfamoyl group, an alkyl group, an aryl group, etc., and the substituent may be further substituted.

X in formula (I) is most preferably group of —CO—.

$R^1$ in formula (I) is preferably an arylamino group, a hydroxyl group, a hydroxyamino group, a carbamoyl group, a hydrazinocarbonyl group and a substituted or unsubstituted alkylamino group having in total 2 or more carbon atoms and an arylamino group and an alkylamino group having in total 2 or more carbon atoms, preferably 3 to 8 carbon atoms an alkenylamino group are more preferable. Of them, arylamino and alkylamino groups preferably have not more than 10 carbon atoms, e.g., a phenyl amino group, a naphthylarylamino and alkylamino groups, etc. is most preferable. The arylamino group may be substituted. The substitutuent for the arylamino and alkylamino groups includes the same as disclosed in the substituent for the group $R^1$. When the arylamino and alkylamino groups have two or more substituents, the substituents are the same or different, the substituent may be further substituted, The preferable substituent for the arylamino and alkylamino groups includes a carboxy group, sulfo group, a hydroxy group, an alkoxy group, a sulfonamido group, a sulfamoyl group, an amino group (e.g., substituted or unsubstituted amino group), a hydrazinocarbonylamino group, etc. Of them a carboxyl group, a sulfo group, a hydrazinocarbonyl group are preferable.

$R^2$ in formula (I) is preferably a hydrogen atom or an alkyl group, and more preferably a hydrogen atom.

Specific examples of the compound shown by formula (I) are shown below but the invention is not to be construed as being limited thereto.

$$NH_2NHCONH_2 \quad (I\text{-}1)$$

$$NH_2N\overset{\overset{\displaystyle NH}{\|}}{C}NH_2 \quad (I\text{-}2)$$

$$NH_2NHCONHNH_2 \quad (I\text{-}3)$$

$$NH_2NHSO_3H \quad (I\text{-}4)$$

$$NH_2NHSO_2NHNH_2 \quad (I\text{-}5)$$

$$NH_2NHCONHOH \quad (I\text{-}6)$$

(I-7)

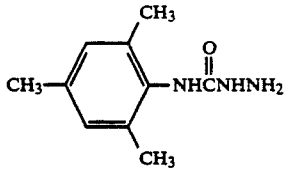

$$CH_3NH\overset{\overset{\displaystyle NH}{\|}}{C}NH_2 \quad (I\text{-}8)$$

$$CH_3NHNHSO_2NHNHCH_3 \quad (I\text{-}9)$$

$$NH_2NHCONH—(CH_2)_3—NHCONHNH_2 \quad (I\text{-}10)$$

(I-11)

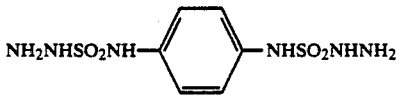

$$NH_2NHCONHCH_3 \quad (I\text{-}12)$$

(I-13)

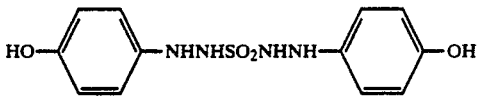

-continued
$NH_2NHSO_2NHOH$ (I-14)
(I-15)
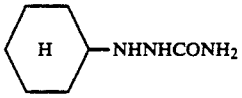
$NH_2NHCONHCONHNH_2$ (I-16)
(I-17)
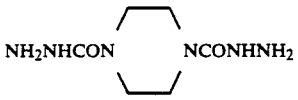
(I-18)
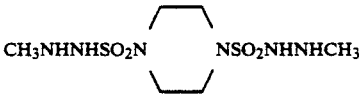
(I-19)
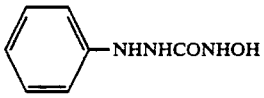
(I-20)
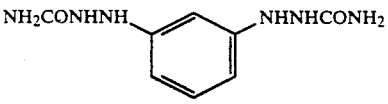
$NH_2COCONHNH_2$ (I-21)
$NH_2NHCOCONHNH_2$ (I-22)
(I-23)
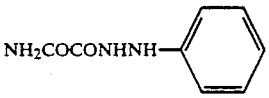
(I-24)
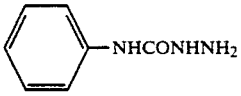
(I-25)
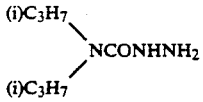
(I-26)
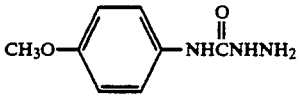
(I-27)
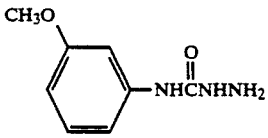
(I-28)
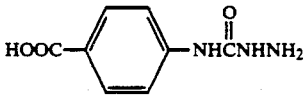
(I-29)
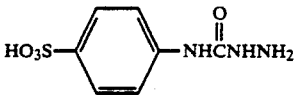
-continued
(I-30)
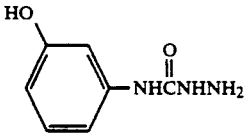
(I-31)
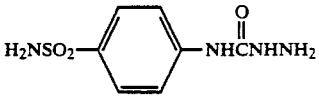
(I-32)
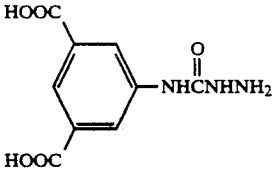
(I-33)
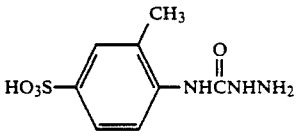
(I-34)
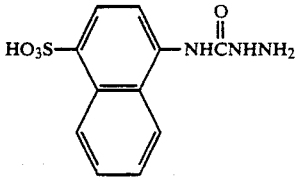
(I-35)
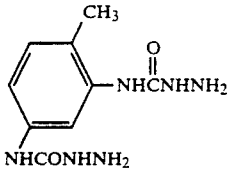
(I-36)
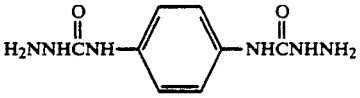
(I-37)
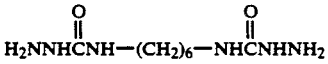
(I-38)
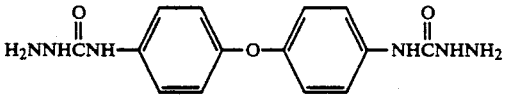
(I-39)
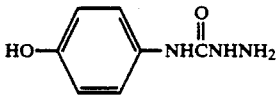
(I-40)
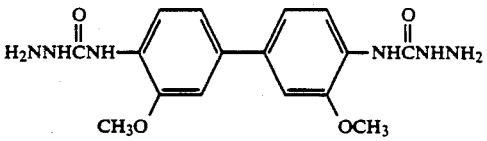

-continued (I-41)

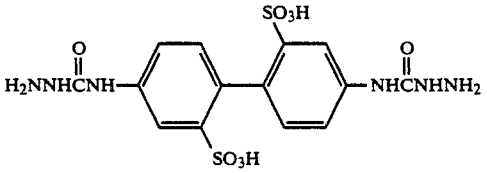

(I-42)

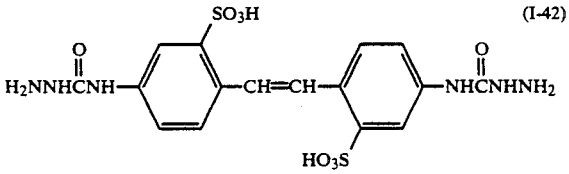

(I-43)

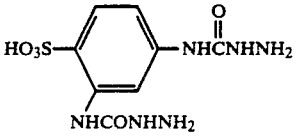

(I-44)

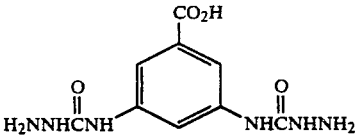

(I-45)

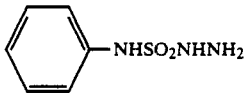

(I-46)

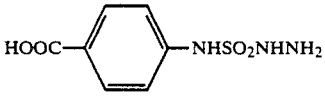

(I-47)

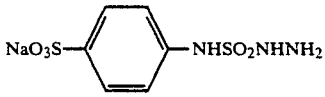

(I-48)

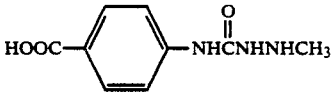

(I-49)

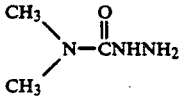

(I-50)

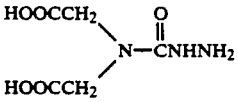

(I-51)

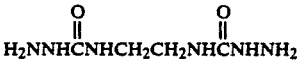

(I-52)

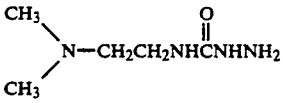

(I-53)

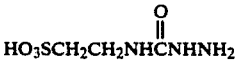

-continued (I-54)

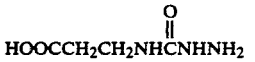

(I-55)

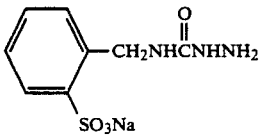

(I-56)

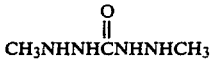

(I-57)

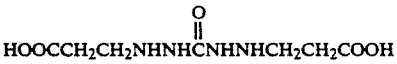

(I-58)

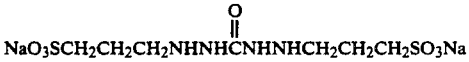

(I-59)

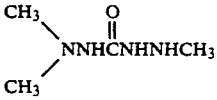

(I-60)

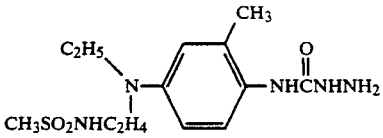

(I-61)

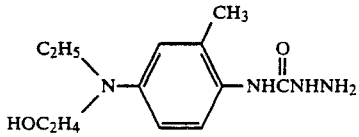

(I-62)

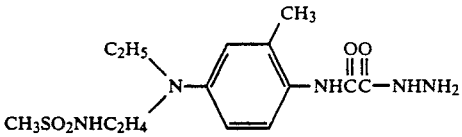

(I-63)

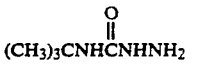

In formula (II), $X^2$ represents a divalent group selected from —CO—, and —$SO_2$—, and $R^3$ represents a hydrogen atom, a substituted or unsubstituted alkyl group (having, preferably, 1 to 15 more preferably 1 to 10, and most preferably 1 to 7 carbon atoms, such as a methyl group, an ethyl group, t-butyl group a cyclohexyl group, a methoxyethyl group, a benzyl group, etc.), a substituted or unsubstituted aryl group (having, preferably, 6 to 10 carbon atoms, such as a phenyl group, a p-tolyl group, a 2-hydroxyphenyl group, a 2-aminophenyl group, etc.), a substituted or unsubstituted heterocyclic group (having, preferably, 1 to 10 carbon atoms, and more preferably being a 5- or 6-membered ring containing at least one hetero atom selected from an oxygen atom, a nitrogen atom, and a sulfur atom, such as a 4-pyridyl group, an N-acetylpiperidin-4-yl group, etc.), a substituted or unsubstituted alkoxy group (having, preferably, 1 to 10 carbon atoms, such as a methoxy group, an ethoxy group, a butoxy group, a methoxyethoxy group, a benzyloxy group, etc.), a substituted or unsubstituted aryloxy group (having, preferably, 6 to 10 carbon atoms, such as a phenoxy group, a p-methoxyphenoxy group, etc.).

$R^4$ in formula (I) is a hydrogen atom, a substituted or unsubstituted alkyl group (having, preferably 1 to 15, more preferably 1 to 10, and most preferably 1 to 7 carbon atoms, such as a methyl group, an ethyl group, a cyclohexyl group, a methoxyethyl group, etc.), or a substituted or unsubstituted aryl group (having, preferably, 6 to 10 carbon atoms, such as a phenyl group, a 3-hydroxyphenyl group, etc.).

When $R^3$ represents a substituted alkyl, aryl, heterocyclic, alkoxy, or aryloxy group and also when $R^4$ represents a substituted a substituted alkyl group or aryl group, the substituent preferably includes a halogen atom (e.g., a chlorine atom, a bromine atom, etc.), a hydroxyl group, a carboxyl group, a sulfo group, an amino group, an alkoxy group, an amido group, a sulfonamido group, a carbamoyl group, a sulfamoyl group, an alkyl group, an aryl group. The substituent may be further substituted.

$R^3$ in formula (II) is preferably a hydrogen atom, an alkyl group, an aryl group or an alkoxyl group, more preferably an aryl group or an alkoxy group.

$R^4$ in formula (II) is preferably a hydrogen atom or an alkyl group, and more preferably a hydrogen atom.

$X^2$ in formula (II) is most preferably —CO—. Specific examples of the compound shown by formula (II) are shown below but the invention is not to be construed as being limited thereto.

$NH_2NHCOOC_2H_5$ (II-1)

$NH_2NHCOCH_3$ (II-2)

(II-3)

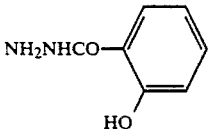

(II-4)

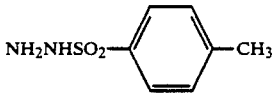

$NH_2NHSO_2CH_3$ (II-5)

(II-6)

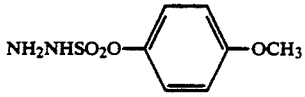

$CH_3NHNHCOOC_2H_4OCH_3$ (II-7)

(II-8)

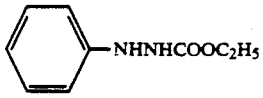

(II-9)

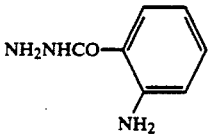

(II-10)

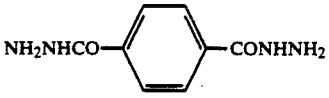

-continued $NH_2NHCO(CH_2)_4CONHNH_2$ (II-11)

(II-12)

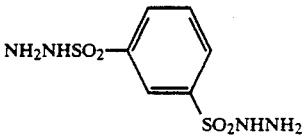

(II-13)

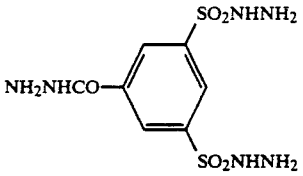

(II-14)

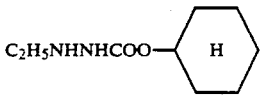

$NH_2NHCHO$ (II-15)

(II-16)

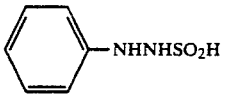

(II-17)

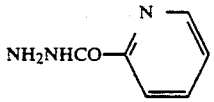

$NH_2NHCOOC_2H_4OCONHNH_2$ (II-18)

$NH_2NHSO_2OC_3H_7(1)$ (II-19)

(II-20)

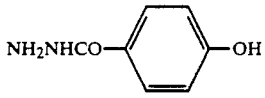

(II-21)

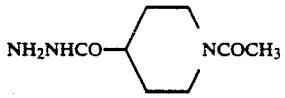

(II-22)

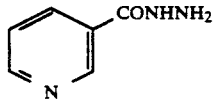

(II-23)

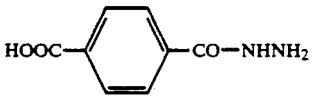

(II-24)

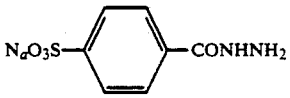

$(CH_3)_3CCONHNH_2$ (II-25)

(II-26)

$(CH_3)_3CC(=O)NHNH_2$

-continued
(II-27)
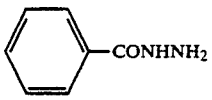
(II-28)
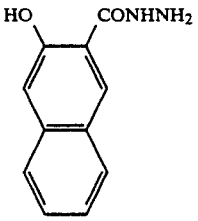
(II-29)
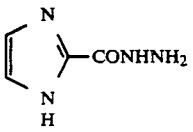
(II-30)
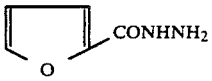
(II-31)
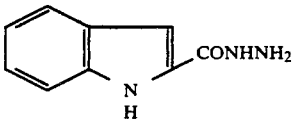
(II-32)
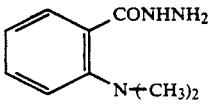
(II-33)
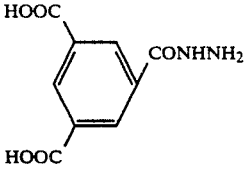
(II-34)
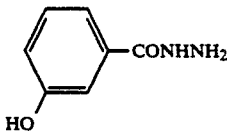
(II-35)
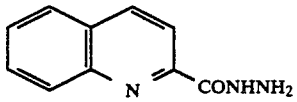
(II-36)
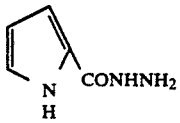
(II-37)
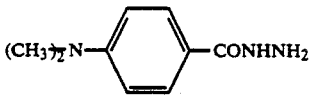
-continued
(II-38)
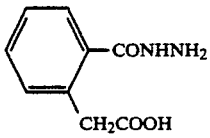
(II-39)
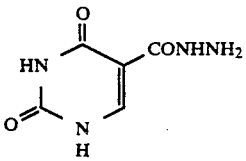
(II-40)
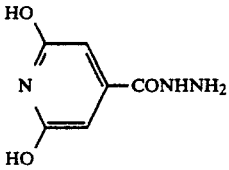
(II-41)
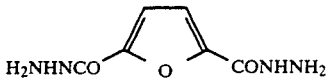
(II-42)
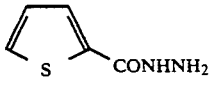
(II-43)
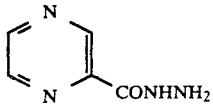
$HOCH_2CH_2SO_2NHNH_2$ (II-44)
$NaO_3SCH_2CH_2CONHNH_2$ (II-45)
$H_2NCONHCH_2CH_2SO_2NHNH_2$ (II-46)
(II-47)
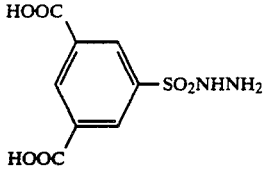
(II-48)
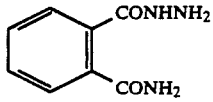
$CH_3CONHNH(CH_2)_3SO_3Na$ (II-49)
(II-50)
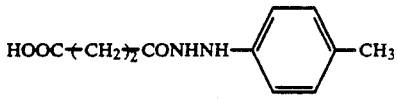
(II-51)
$NaO_3SCH_2CH_2O\overset{O}{\overset{\|}{C}}NHNH_2$
(II-52)
$(CH_3)_3C\overset{O}{\overset{\|}{C}}NHNHCH_2CH_2OH$
Many of the compounds shown in formula (I) and (II) described above are commercially available, and all of these compounds can be synthesized according to the general synthesis methods described in Organic Syntheses, Coll. Vol.2, page 450, published by John Wiley and Sono. Many of the compounds of formula (I) are also synthesized according to the methods as is described in *Shin Jikken Kagaku Koza* (*New Experimental Chemistry Lectures*), Vol 14, III, pages 1621–1628, published by Maruzen Company, Beil., 2, 559 and Beil., 3, 117. Many of the compounds of formula (II) are also synthesized according to the methods as is described in P.A.S. Smith, *Derivatives of Hydrazine and other Hydronitrogens having n-n-Bands*, pages 120–124, pages 130–131, published by The Benjamine/Cummings Publishing Company (1983).

The compounds shown by formula (I) or (II) may form salts with various acids such as hydrochloric acid, sulfuric acid, nitric acid, phosphoric acid, oxalic acid, acetic acid. etc.

The amount of the compound represented by formula (I) or (II) present in a color developer is from about $1.5\times10^{-3}$ to $3.0\times10^{-1}$ mol, preferably from about $5.0\times10^{-3}$ mol to $1.0\times10^{-1}$ mol per liter of color developer.

When the compound shown by formula (I) or (II) described above is a monomer, the sum of the carbon atoms thereof is preferably not more than 15, more preferably not more than 10, and most preferably not more than 7.

The compounds of formula (I) may be linked with each other at $R^1$ or $R^2$ to form a dimer (biscompound), a trimer (tris-compound) or a polymer. When the compound of formula (I) forms, a polymer, the polymer may be a homopolymer or a copolymer. Comonomer composing the copolymer together with the compound of formula (I) or (II) includes an acrylic acid, a methacrylic acid, amide derivatives of them and p-styrenesulphonic acid, wherein the comonomer is preferably selected to make the copolymer watersoluble. A repeating unit of the compound of formula (I) is preferably included by at least 30 mol%, more preferably at least 50 mol% and most preferably at least 70 mol%.

The color developer for use in this invention is now explained in greater detail.

The color developer for use in this invention contains an aromatic primary amine color developing agent such as, preferably, p-phenylenediamine derivatives. pedific examples of suitable color developer are illustrated below but the invention is not to be construed as being limited to these compounds.

D - 1 N,N-Diethyl-p-phenylenediamine
D - 2 2-Amino-5-diethylaminotoluene
D - 3 2-Amino-5-(N-ethyl-N-laurylamino)toluene
D - 4 4-[N-Ethyl-N-(β-hydroxyethyl)amino]aniline
D - 5 2-Methyl-4-[N-ethyl-N-(β-hydroxyethyl)amino]-aniline
D - 6 N-Ethyl-N-(β-methanesulfonamidoethyl)-3-methyl-4-aminoaniline
D - 7 N-(2-Amino-5-diethylaminophenylethyl)methanesulfonamide
D - 8 N,N-Dimethyl-p-phenylenediamine
D - 9 4-Amino-3-methyl-N-ethyl-N-methoxyethylaniline
D - 10 4-Amino-3-methyl-N-ethyl-N-β-ethoxyethylaniline
D - 11 4-Amino-3-methyl-N-ethyl-N-β-butoxyethylaniline The most preferably developers for use in the present invention include 2-methyl-4-[N-ethyl-N-(β-hydroxyethyl)amino]aniline or N-ethyl-N-(β-methanesulfonamidoethyl)-3-methyl-4-aminoamiline.

Also, these aromatic primary amine color developing agents may be in the form of salts such as sulfates, hydrochlorides, sulfites, p-toluenesulfonates, etc.

The amount of the aromatic primary amine color developing agent is from about 0.1 g to about 20 g, preferably from about 0.5 g to about 10 g and most preferably from about 1 g to about 8 g per liter of color developer.

The use of ordinary hydrazides in color developers is described in U.S. Pat. Nos. 3,141,771 and 2,772,973, but sufficient preservability is not obtained with the compounds disclosed. On the other hand, the preservability of a color developer is greatly improved and the formation of fog is restrained by using the hydrazide represented by formula (I) or (II) described above.

In this invention, it is preferred that the color developer does not contain hydroxylamine. If the color developer contains hydroxylamine, the content thereof is as small as possible. Preferably the color developer contains not more than 1 g and more preferably not more than 0.5 g per liter of the color developer.

It is also preferred that the color developer contains substantially no benzyl alcohol in order to prevent the formation of fog. In this invention, the term "containing substantially no benzyl alcohol" means that the content of benzyl alcohol in a color developer is less than about 2 ml per liter of the color developer. It is preferred that the color developer contains not more than 1 ml, more preferred the color developer contains no benzyl alcohol Furthermore, it is also preferred that the developer contains substantially no p-aminophenol type developing agent in view of a stability of the developer. In more detail, the developer preferably contains 1 g or less, more preferably 0.1 g or less, of p-aminophenol type developing agent per liter of the developer.

The developer preferably contains no coupler such as a color coupler. The color developer for use in this invention may further contain, if desired, sulfites such as sodium sulfite, potassium sulfite, metasulfite, potassium metasulfite, etc., or carbonylsulfurous acid addition products as additional preservatives. The amount of such an additional preservative in the color developer solution is less than about 3.0 g/liter, and preferably less than about 0.5 g/liter. When the preservative in this invention represented by formula (I) is used in a color developer containing substantially no benzyl alcohol, it is preferred for preservability and/or the photographic properties obtained that the amount of the sulfite ion added be less than about 20 g/liter, more preferably 5 g/liter.

Examples of other preservatives which can be also used in the color developer for use in this invention include hydroxyacetones described in U.S. Pat. No. 3,615,503 and British Patent No. 1,306,176, α-aminocarbonyl compounds described in Japanese Patent Application (OPI) Nos. 143020/77 and 89425/78, various metal salts described in Japanese Patent Application (OPI) Nos. 44148/82 and 53749/82, saccharides described in Japanese Patent Application (OPI) No. 102727/77, hydroxamic acids described in Japanese Patent Application (OPI) No. 27638/77, α, α'-dicarbonyl compounds described in Japanese Patent Application (OPI) No. 160141/84, salicylic acids described in Japanese Patent Application (OPI) No. 180588/84, alkanolamines described in Japanese Patent Application (OPI) No. 3532/79, poly(alkyleneimine) described in Japanese Patent Application (OPI) No. 94349/81, gluconic acid derivatives described in Japanese Patent Application (OPI) No. 75647/81, tertiary cyclic amines described in Japanese Patent Application No. 265149/76 etc. These preservatives may, if desired, be used in a combination of two or more thereof.

Of these compounds, the use of alkanolamines (triethanolamine, diethanolamine, triethylenediamine (1,4-diazabicyclo[2,2,2]octane) etc.) and/or aromatic polyhydroxy compounds is preferred.

The pH of the color developer for use in this invention is preferably from about 9 to about 12, and is more preferably from about 9 to about 11.0.

The color developer may, further contain any of various conventional additives which are ordinary employed for color developers, without particular limitation.

For maintaining the pH of the color developer, it is preferred to use any of various buffers, including, e.g., carbonates, phosphates, borates, tetraborates, hydroxybenzoates, glycine salts, N,N-dimethylglycine salts, leucine salts, norleucine salts, guanine salts, 3,4-dihydroxyphenylaniline salt, alanine salts, aminobutyrate, 2-amino-2-methyl-1,3-propanediol salts, valine salts, proline salts, trishydroxyaminomethane salts, lysine salts, etc. In particular, carbonates, phosphates, tetraborates, and hydroxybenzoates are preferred since they are excellent in solubility, and in buffering a solution at a high pH range greater than about 9.0, they do not adversely influence photographic performance (e.g., fog formation, etc.) when they are added to the color developer. They are also available at low cost.

Specific examples of these buffers include sodium carbonate, potassium carbonate, potassium hydrogencarbonate, sodium hydrogencarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the present invention is not to be construed as being limited to these compounds.

The amount of the buffer added to a color developer is preferably at least about 0.1 mol, and more preferably from about 0.1 mol to 0.4 mol per liter of the color developer.

Furthermore, the color developer for use in this invention can contain various chelating agents to prevent precipitation of calcium and magnesium, and for improving the stability of the color developer.

As chelating agents, organic acid compounds are preferred, and examples of such chelating agents include aminopolycarboxylic acids described in Japanese Patent Publication Nos. 30496/73 and 30232/79, organic phosphonic acids described in Japanese Patent Application (OPI) No. 97347/81, Japanese Patent Publication No. 39359/81, and West German Patent No. 2,227,639, phosphonocarboxylic acids described in Japanese Patent Application (OPI) Nos. 102726/77, 42730/78, 121127/79, 126241/80, and 65956/80, and the compounds described in Japanese Patent Application (OPI) Nos. 195845/83, 203440/83, and Japanese Patent Publication No. 40900/78.

Specific examples of the chelating agent are illustrated below but the invention is not to be construed as being limited to these compounds.

Nitrilotriacetic acid
Diethylenetriaminepentaacetic acid
Ethylenediaminetetraacetic acid
Triethylenetetraminehexaacetic acid
Triethylenetetraminehexaacetic acid
N,N,N-trimethylenephosphonic acid
Ethylenediamine-N,N,N',N'-tetramethylenephosphonic acid
1,3-diamino-2-propanoltetraacetic acid
Transcyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetriacetic acid
Ethylenediamineorthohydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid These chelating agents may be used, if desired, as a mixture thereof.

The amount of the chelating agent(s) used is one sufficient for keeping metal ion(s) in a color developer, and is generally from about 0.1 g to about 10 g per liter of the color developer.

The color developer for use in this invention can contain, if desired, an optional development accelerator. Examples of such a development accelerator include thioether compounds described in Japanese Patent Publication Nos. 16088/62, 5987/62, 7826/63, 12380/69, 9019/70 and U.S. Pat. No. 3,813,247; p-phenylenediamine series compounds described in Japanese Patent Application (OPI) Nos. 49829/77, and 15554/75; quaternary ammonium salts described in Japanese Patent Application (OPI) Nos. 137726/75, 156826/81, 43429/77, and Japanese Patent Publication No 30074/69; p-aminophenols described in U.S. Pat. Nos. 2,610,122 and 4,119,462; amine series compounds described in U.S. Pat. Nos. 2,494,903, 3,128,182, 4,230,796, 3,253,919, 2,482,546, 2,596,926, 3,582,346 and Japanese Patent Publication No. 11431/66; polyalkylene oxides described in Japanese Patent Publication Nos. 16088/62, 25201/67, 11431/66, 23883/67, U.S. Pat. Nos. 3,128,183 and 3,532,501; as well as conventional 1-phenyl-3-pyrazolidones, hydrazines, mesoionic compounds, ionic compounds and imidazoles, etc. The amount of the development acclesator is preferably from 0.01 g to 100 g, more preferably from 0.05 g to 50 g and most preferably from 0.1 g to 10 g per liter of the color developer.

The color developer for use in this invention may contain, if desired, an optional antifoggant including, e.g., a metal halide such as potassium bromide, sodium chloride or potassium iodide and an organic anti foggant. The preferred amount of the antifoggant is from 0.001 g to 10 g, more preferably from 0.005 g to 5 g and most preferably from 0.01 g to 2 g based on per liter of the color developer. Examples of organic antifoggants include nitrogencontaining heterocyclic compounds such as benzotriazole, 6-nitrobenzimidazole, 5-nitroisoindazole, 5-methylbenzotriazole, 5-nitrobenzotriazole, 5-chlorotenzotriazole, 2-thiazolylbenzimidazole, 2-thiazolylmethylbenzimidazole, hydroxyazaindolizine, 5-nitrcindazole, and mercaptotriazoles, etc.

It is preferred that the color developer for use in this invention contain an optical whitening agent. Preferred examples of the optical whitening agent are 4,4'-diamino-2,2'-disulfostilbene series compounds. The amount of the optical whitening agent present is less than about 5 g, and preferably from about 0.1 g to 2 g per liter of the color developer.

Also, the color developer may, if desired, contain various surface active agents such as alkylsulfonic acids, arylsulfonic acids, aliphatic carboxylic acids and aromatic carboxylic acids, etc.

The processing temperature for color development in this invention is preferably from about 20° C. to 70° C., and more preferably from about 20° C. to 50° C., and most preferably from about 30° C. to 40° C. The processing time is preferably from about 20 seconds to 5 minutes, and more preferably from about 30 seconds to 2 minutes.

The amount of replenisher added to a partially exhausted color developer is preferably as small as possible, and is usually from about 20 ml to 600 ml, preferably from about 50 ml to 300 ml, and more preferably from about 100 ml to 200 ml per square meter of color photographic material processed.

Next, the bleach solution and fix solution or bleach-fix (blix) solution used in the process of this invention is explained in greater detail.

As the bleaching agent which is used for the bleach solution or blix solution in this invention, any conventional bleaching agents may be used, but in particular, organic complex salts of iron (III) (e.g., complex salts of aminopolycarboxylic acids such as ethylenediaminetetraacetic acid, diethylenetriaminepentaacetic acid, etc., and organic phosphonic acids such as aminopolyphosphonic acid, phosphonocarboxylic acid, etc.,); organic acids such as citric acid, tartaric acid, and malic acid; persulfates and hydrogen peroxide, are preferred.

Of these compounds, organic complex salts of iron(III) are particularly preferred from the viewpoints of rapid processing and the prevention of environmental pollution.

Examples of aminopolycarboxylic acids, aminopolyphosphonic acids, organic phosphonic acids and the salts thereof useful for forming the organic complex salts of iron(III) are illustrated below, although the present invention is not limited to these specific examples.

Ethylenediaminetetraacetic acid,
Diethylenetriaminepentaacetic acid,
Ethylenediamine-N-(β-oxyethyl)-N,N',N'-triacetic acid,
1,3-Diaminopropane tetraacetic acid,
Triethylenetetraminehexaacetic acid,
Propylenediaminetetraacetic acid,
Nitrilotriacetic acid,
Nitrilotripropionic acid,
Cyclohexanediaminetetraacetic acid,
1,3-Diamino-2-propanoltetraacetic acid,
Methyliminodiacetic acid,
Iminodiacetic acid,
Hydroxyliminodiacetic acid,
Dihydroxyethylglycine ethyl ether diaminetetraacetic acid,
Glycol ether diaminetetraacetic acid,
Ethylenediaminetetrapropionic acid,
Ethylenediaminedipropionic acid,
Phenylenediaminetetraacetic acid,
2-Phosphonobutane-1,2,4-triacetic acid,
1,3-Diaminopropanol-N,N,N',N'-tetramethylenephosphonic acid,
Ethylenediamine-N,N,N',N',tetramethylenephosphonic acid,
1,3-Propylenediamine-N,N,N',N'-tetramethylenephosphonic acid, and
1-Hydroxyethylidene-1,1-diphosphonic acid.

These compounds may be in the form of sodium salts, potassium salts, lithium salts or ammonium salts. Of these compounds, the iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferred due to their high bleaching power.

These ferric ion complex salts may be used in the form of the complex salt itself or the ferric ion complex salt may be formed in solution by using a ferric salt such as ferric sulfate, ferric chloride, ferric nitrate, ferric ammonium sulfate, ferric phosphate, etc., and a chelating agent such as aminopolycarboxylic acid, aminopolyphosphonic acid phosphonocarboxylic acid, etc. When using the complex salt itself, one kind of complex salt may be used or two or more kinds of complex salts may be used in combination. When forming a complex salt in solution using a ferric salt and a chelating agent, one kind of ferric salt or two or more kinds of ferric salts may be used. Also, in either case a chelating agent may be used in an amount in excess of that required for forming the ferric ion complex salt(s).

Of these ferric complex salts, aminopolycarboxylic acid ferric complex salts are preferred. The amount of the complex salt present is from about 0.01 mol. to 1.0 mol, and preferably from about 0.05 mol to 0.50 mol per liter of the bleach or blix solution.

The bleach or blix solution may further contain, if desired, a bleach accelerator in a preferable amount of from 0.001 to 10 g based on per liter of bleach or blix solution. Specific examples of useful bleach accelerators include the compounds having a mercapto group or a disulfide group described in U.S. Pat. No. 3,893,853, West German Patent Nos. 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78, 28426/78, and *Research Disclosure*, No. 17129 (July, 1978); thiazolidine derivatives described in Japanese Patent Application (OPI), 140129/75; thiourea derivatives described in Japanese Patent Publication No. 8506/70, Japanese Patent Application (OPI) Nos. 20832/77 and 32735/78, and U.S. Pat. No. 3,706,561; iodides described in Japanese Patent Application No. 16235/83; polyethylene oxides described in West German Patent Nos. 966,410 and 2,748,430; polyamine compounds described in Japanese Patent Publication No. 8836/70; the compounds described in Japanese Patent Application (OPI) Nos. 42434/74, 59644/74, 94927/78, 35727/79, 26506/80, and 163940/83; and iodide ions and bromide ions. Of them, compounds having a mercapto group or a disulfide group are preferably because those have a large bleach accelerating effect, especially, compounds described in U.S. Pat. No. 3,893,858, West German Patent No. 1,290,812 and Japanese Patent Application (OPI) No. 95630/78 are more preferable Furthermore, the bleach or blix solution for use in this invention may contain a rehalogenating agent such as a bromide (e.g., potassium bromide, sodium bromide, ammonium bromide, etc ), a chloride (e.g., potassium chloride, sodium chloride, ammonium chloride, etc ), and an iodide (such as ammonium iodide, etc.) in a preferable amount of from 0.1 g to 50 g per liter of the bleach or blix solution. Moreover, if desired, the bleach or blix solution may contain a corrosion inhibitor such as an inorganic or organic acid having a pH buffering action, or the alkali metal salts and ammonium salts thereof (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.), ammonium nitrate or guanidine, in a preferred amount of from 0.1 g to 50 g per liter of bleach or blix solution.

Fixing agents which are used for the fixing bath or blix bath in this invention include thiosulfates such as sodium thiosulfate, ammonium thiosulfate, etc.; thiocyanates such as sodium thiocyanate, ammonium thiocyanate, etc.; thioether compounds such as ethylenebisthioglycolic acid, 3,6-dithia-1,8-octanediol, etc.; and water-soluble silver halide dissolving agents such as thioureas, etc. They can be used singly or as a mixture thereof Also, a specific blix solution composed of a combination of the fixing agent described in Japanese Patent Application (OPI) No. 155354/80 and a large amount of a halide such as potassium iodide can be used in this invention. The use of a thiosulfate, in particular, ammonium thiosulfate is preferred.

The amount of the fixing agent is preferably from about 0.3 mol to 2 mol, and more preferably from about 0.5 mol to 1.0 mol, per liter of processing solution.

The pH range of the blix or the fix solution in this invention is preferably about 3 to 10, and more preferably from about 5 to 9. If the pH is lower than this range, the deterioration of the liquid and the conversion of cyan dyes into leuco compounds are accelerated, although the desilvering ability is improved. On the other hand, if the pH is higher than this range, the desilvering ability is reduced and staining is likely to occur.

For controlling the pH of the blix or fix solution, if necessary, hydrochloric acid, sulfuric acid, nitric acid, acetic acid, hydrogencarbonates, ammonia, potassium hydroxide, sodium hydroxide, sodium carbonate, potassium carbonate, etc., may be added to the liquid.

Also, the blix or fix solution for use in this invention may further contain various fluorescent brightening agents, dofoaming agents, surface active agents, or organic solvents (e.g., polyvinylpyrrolidone, methanol, etc.).

The blix or fix solution for use in this invention may further contain sulfite ion releasing compounds such as sulfites (e.g., sodium sulfite, potassium sulfite, ammonium sulfite, etc.) bisulfites (e.g., ammonium bisulfite, sodium bisulfite, potassium bisulfite, etc.), metabisulfites (e.g., potassium metabisulfite, sodium metabisulfite, ammonium metabisulfite, etc.), etc., as preservatives. The content of this compound is preferably from about 0.02 mol to 0.50 mol, and more preferably from about 0.04 mol to 0.40 mol, calculated as sulfite ion, per liter of the liquid.

As the preservative, a sulfite is generally used but ascorbic acid, a carbonyl bisulfite addition compound, or a carbonyl compound also may be used.

Furthermore, the blix or fix both in this invention may further contain, if necessary, a buffer, a fluorescent brightening agent, chelating agent or an antifungal agent etc.

At least one wash step is typically used in the process according to the invention. In this invention, in place of an ordinary water wash step, a simplified processing method can be employed in which only a "stabilization step" is performed, without separate water wash step. The term "wash step" as used herein broadly refers to an ordinary water wash step, a stabilization step, or rinse step, which is used in place of a conventional wash step.

The amount of wash water required differs according to the number of tanks or baths used for a multistage countercurrent wash step, and the amount of the components from earlier baths carried over by light-sensitive materials, and hence it is difficult to define the amount thereof with precision. However, in this invention, the blix or fix components contained in the final wash bath should be less than about $1\times10^{-4}$ V/V. For example, in the case of a 3-tank countercurrent wash step, the amount of wash water used is preferably more than about 1,000. ml, and more preferably more than about 5,000 ml per square meter of color photographic material. Also, when using a water-saving processing step, the amount of wash water may be in the range of from about 100 ml to 1,000 ml per square meter of color photographic material.

The washing temperature is typically from about 15° C. to 45° C., and preferably from about 20° C. to 35° C.

In the wash processing step, various compounds may be used for preventing precipitation and stabilizing the wash water, including, for example, chelating agents such as inorganic phosphoric acids, aminopolycarboxylic acids, organic phosphonic acids, etc.; antibacterial agents and antifungal agents for preventing the generation of bacteria, algae, and molds (e.g., the compounds described in *Journal of Antibacterial and Antifungal Agents*, Vol. 11, No. 5, pp. 207–223 (1983), Hiroshi Horiguchi, *Bokin Bobai no Kagaku (Antibacterial and Antifungal Chemistry*, metal salts such as magnesium salts and aluminum salts, alkali metal salts or ammonium salts, and surface active agents for reducing drying load and preventing the occurrence of drying marks or deposits. Furthermore, the compounds described in West, *Photographic Science and Engineering, Vol.* 6, pp. 344–359 (1965) may be added to the wash water.

In the present invention it is particularly effective for greatly reducing the amount of wash water to add any of a chelating agent and an antibacterial agent, and an antifungal agent to the wash water and to employ a multistage countercurrent wash step using two or more tanks. Also, the invention is particularly effective in the case of performing a multistage countercurrent stabilization step (i.e., a "stabilization process") as described in Japanese Patent Application (OPI) No. 8543/82 in place of an ordinary wash step. Using these methods, the content of the blix or fix components in the final bath may be reduced to less than about $5\times10^{-2}$ $\bar{v}/\bar{v}$ and preferably less than about $1\times10^{-2}$ $\bar{v}/\bar{v}$.

The stabilization bath for use in this invention can contain any of various conventional compounds for stabilizing the color images formed, including, for example, various buffers (e.g., a combination of borates, metaborates, borax, phosphates, carbonates, potassium hydroxide, sodium hydroxide, aqueous ammonia, monocarboxylic acids, dicarboxylic acids, polycarboxylic acids, etc.); and aldehydes such as formaldehyde, etc., for controlling the pH of photographic layers (e.g., to a pH of about 3 to 8). Other compounds which may be added to the stabilization bath include chelating agents (e.g., inorganic acids, aminopolycarboxylic acids, organic phosphonic acids, aminopolyphosphonic acids, phosphonocarboxylic acids, etc.), antibacterial agents (e.g., thiazole series compounds, isothiazole series compounds, halogenated phenols, sulfanylamides, benzotriazoles, etc.), surface active agents, fluorescent brightening agents, hardening agents, etc. These may be used as a mixture of two or more compounds.

Also, it is preferred for improving the storage stability of color images formed to add any of various ammonium salts such as ammonium chloride, ammonium nitrate, ammonium sulfate, ammonium phosphate, ammonium sulfite, ammonium thiosulfate, etc., to the stabilization bath as a pH controlling agent after processing.

In order to save the greatest amount of wash water, it is preferred for reducing the amount of waste liquid to introduce a part or all of the overflow wash water into an earlier bath, such as the blix bath or fix bath.

For continuous processing according to the invention, consistent results are obtained by preventing the variation of the composition of each processing liquid by using a replenisher for each processing liquid. The amount of the replenisher can be reduced to a half or less than half of the standard replenisher amount to reduce costs.

In this invention, each processing bath or tank may, if desired., be equipped with any conventionally used apparatus, including, e.g., a heater, a temperature sensor, a liquid level sensor, a circulation pump, a filter, a floating lid, a squeegee, a nitrogen sirrer, an air stirrer, etc.

The process of this invention can be applied to black and white photographic material and any processing methods requiring a color developer. For example, the process can be used for processing black and white photographic materials in addition to processing color photographic materials, for example, color photographic papers, color reversal photographic papers, color positive photographic papers, color negative photographic films, color reversal photographic films, color direct positive-working photographic materials (e.g. papers), etc.

The silver halide emulsions of the color photographic light-sensitive materials which are processed according to the invention may have any halogen compositions, such as silver iodobromide, silver bromide, silver chlorobromide, silver chloride, etc., but for rapid processing and low-replenisher processing, a silver chlorobromide emulsion containing at least about 60 mol %silver chloride or a pure silver chloride emulsion is preferred, and such emulsions containing from about 80 mol %to 100 mol %of silver chloride are particularly preferred. When high sensitivity is required along with minimum fog formation during production, storage and/or processing of color photographic materials, a silver chlorobromide emulsion containing at least about 50 mol %silver bromide or a pure silver bromide emulsion is preferred; it is more preferred that the content of silver bromide be more than about 70 mol%. When the content of silver bromide is over about 90 mol%, rapid processing of the color photographic materials is difficult, although by accelerating development by means of a development accelerator such as a silver halide solvent, fogging agent or a developing agent, the development process can be shortened to some extent without being restricted by the content of silver bromide, and such a case is sometimes preferred. For color photographic papers, it is preferred that the silver halide emulsion contain a small amount of silver iodide, and the content of silver iodide is preferably less than about 3 mol%. For color photographic films (color photographic negative films, color photographic reversal films, etc.), silver iodobromide and silver chloroiodobromide emulsions are preferred and in this case, the content of silver iodide is preferably from about 3 mol %to 15 mol%.

The silver halide grains for use in materials processed by the invention may have different phases in the core and the surface layer thereof; may have a multiphase structure having a junction structure; or may be composed of a uniform phase throughout the whole grains. Also, the silver halide emulsion may be composed of a mixture of such grain types.

The mean grain size (defined as the diameter of the grains when the grain is spherical or nearly spherical, and by the mean value based on the projected area using, in the case of cubic grains, the long side length as the grain size, or by the mean value calculated as a sphere in the case of tabular grains) of the silver halide grains for use in this invention is preferably in the range of from about 0.1 μm to 2 μm, and more preferably from about 0.15 μm to 1 μm. The grain size distribution of the silver halide grains may be narrow or broad but the use of a monodisperse silver halide emulsion, is preferred in which the coefficient of variation obtained by dividing the standard deviation in the grain size distribution of the silver halide emulsion by the mean grain size of the silver halide grains in the emulsion is within about 20% (preferably within about 15%). Also, to provide the desired gradation for the color photographic materials, two or more kinds of monodisperse silver halide emulsions (preferably each having the above-described coefficient of variation, but a different grain size) can be used as a mixture thereof for one emulsion layer or as separate emulsion layers each having substantially same color sensitivity. Furthermore, two or more kinds of polydisperse silver halide emulsions or a combination of a monodisperse silver halide emulsion and a polydisperse silver halide emulsion can be used as a mixture thereof for one emulsion layer or as separate emulsion layers.

The silver halide grains used in materials processed by the present invention may have a regular crystal form, e.g., cubic, octahedral, dodecahedral or tetradecahedral; an irregular crystal form such as spherical; or a composite form of these crystal forms. Also, the silver halide grains may be tabular grains, for example, in a tabular silver halide emulsion containing tabular silver halide grains having an aspect ratio (diameter/thickness) of at least about 5, and preferably at least about 8, that account for at least about 50% of the total projected area of the silver halide grains. A mixture of these silver halide emulsions, each containing silver halide grains having different crystal forms, may be also used. The silver halide emulsion may be a surface latent image emulsion forming latent images mainly on the surface of the grains, or an internal latent image emulsion forming latent images mainly in the inside of the grains.

The above silver halide photographic emulsions can be prepared according to the methods described in P. Glafkides, *Chimie et Physique Photographique*, (Paul Montel, 1967); G. F. Duffin, *Photographic Emulsion Chemistry*, (Focal Press, 1966); and V. L. Zelikman et al., *Making and Coating Photographic Emulsions*, (Focal Press, 1964).

Such emulsions can be prepared by any of of an acid method, a neutralization method and an ammonia method, and a soluble silver salt and a soluble halide can be reacted by a single jet method, a double jet method, or a combination thereof. A reverse mixing method of forming silver halide grains in the presence of excess silver ions can also be used. As one double jet method, a controlled double jet method maintaining a constant pAg in the liquid phase while forming silver halide grains can also be used. According to this method, a silver halide emulsion containing silver halide grains having a regular crystal form and substantially uniform grain size can be obtained.

Furthermore, a silver halide emulsion prepared by a conversion method, including a step of converting a silver halide formed before finishing the formation of the silver halide grains into a silver halide having a small solubility product can be processed by the invention, as well as a silver halide emulsion to which silver halide conversion is applied after finishing the formation of the silver halide grains.

During the formation or physical ripening of the silver halide grains, a cadmium salt, a zinc salt, a lead salt, a thallium salt, an iridium salt or a complex salt thereof, a rhodium salt or a complex salt thereof, an iron salt or a complex salt thereof, etc., may be present in the system.

After the formation of silver halide grains silver halide emulsions, are usually physically ripened, desalted, and chemically ripened before coating.

A silver halide solvent (e.g., ammonia, potassium rhodanate, and thioethers and thione compounds described in U.S. Pat. No. 3,271,157, Japanese Patent Application (OPI) Nos. 12360/76, 82408/78, 144319/,78, 100717/79 and 155828/79) can be used for the precipitation, physical ripening, and chemical ripening of the silver halide emulsions for use in this invention.

For removing soluble salts from silver halide emulsions after physical ripening, a noodle washing method, a flocculation method, or an ultrafiltration method can be employed.

The silver halide emulsions for use in this invention can be chemically sensitized by a sulfur sensitization method using active gelatin or a sulfur-containing compound capable of reacting with silver (e.g., a thiosulfate, thiourea, mercapto compound, rhodanines, etc.); a reduction sensitization method using a reducing agent (e.g., stannous salts, amines, hydrazine derivatives, formamidinesulfinic acid, silane compounds, etc.); a noble metal sensitization method using a metal compound (e.g., gold complex salts and complex salts group VIII metals such as Pt, Ir, Pd, Rh, Fe, etc.), or a combination thereof.

The silver halide emulsions for use in color materials processed according to this invention are typically spectrally sensitized by methine dyes, specify, so that the emulsions have desired color sensitivities, e.g., blue sensitivity, green sensitivity, and red sensitivity. The dyes used include cyanine dyes, merocyanine dyes, complex cyanine dyes, complex merocyanine dyes, holopolar cyanine dyes, hemicyanine dyes, styryl dyes, and hemioxonol dyes. Particularly useful dyes include cyanine dyes, mreocyanine dyes, and complex merocyanine dyes.

These dyes can contain any nuclei ordinary used for cyanine dyes as basic heterocyclic nuclei, including pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; nuclei formed by fusing an aliphatic hydrocarbon ring to the aforesaid nuclei, and nuclei formed by fusing an aromatic hydrocarbon ring to the aforesaid nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be further substituted at the carbon atoms thereof.

Merocyanine dyes or complex merocyanine dyes may contain 5-membered or 6-membered heterocyclic nuclei such as pyrazolin-5-one nuclei, thiohydantoin-nuclei, 2-thiooxazolidine-2,4-dione nuclei, thiazolidine-2,4-dione nuclei, rhodanine nuclei, thiobarbituric acid nuclei, etc., nuclei having a ketomethylene structure.

These sensitizing dyes may be used alone or as a combination thereof. A combination of sensitizing dyes is frequently used for the purpose of super-color sensitization. Typical examples of such combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, Japanese Patent Publication Nos. 4963/68 and 12375/78, Japanese Patent Application (OPI) Nos. 110618/77 and 109925/77.

The silver halide emulsions in materials processed by the invention may contain a dye having no spectral sensitizing activity by itself, or a material which does not substantially absorb visible light, but that has super-color-sensitizing activity together with the sensitizing dye(s).

The sensitizing dye(s) may be added to a silver halide emulsion in any step during the formation of silver halide grains, before or after the chemical sensitization, during the chemical sensitization, or during coating. The addition of the sensitizing dye(s) during the formation of silver halide grains is effective not only to increase the adsorption thereof, but also to control the crystal form and structure of the grains. Also, the addition of the sensitizing dye(s) during chemical sensitization is effective not only to increase the adsorption thereof, but also to control the chemical sensitizing site and to prevent the deformation of crystals. Such an addition method is particularly effective when using silver halide emulsions having a high silver chloride content and also when using silver halide emulsions having a high silver bromide or silver iodide content at the surface of the silver halide grains.

Preferable color photographic materials which are processed by the process of this invention are ones containing color couplers in the silver halide emulsion layers (i.e., coupler-in emulsion type color photographic materials). It is preferred that the color couplers be rendered nondiffusible by a ballast group or by being polymerized. Furthermore, the use of 2-equivalent color couplers (the coupling position of which is substituted by a releasing group) is more effective for reducing the amount of silver than the use 4-equivalent color couplers having a hydrogen atom at the coupling active position thereof. Couplers providing colored dyes having a proper diffusibility, colorless couplers, DIR couplers releasing a development inhibitor by a coupling reaction or couplers releasing a development accelerator by a coupling reaction can be used in such color photographic materials.

Typical examples of yellow couplers used in color materials include oil-protect acylacetamide series yellow couplers. Specific examples of such couplers are described in U.S. Pat. Nos. 2,407,210, 2,875,057 and 3,265,506.

In this invention, 2-equivalent yellow couplers are preferably used, and typical examples thereof are oxygen atom-releasing yellow couplers described in U.S. Pat. Nos. 3,408,194, 3,447,928, 3,933,501 and 4,022,620, and nitrogen atom-releasing yellow couplers described in Japanese Patent Publication No. 10739/80, U.S. Pat. Nos. 4,401,752 and 4,326,024, *Research Disclosure*, No. 18053 (April, 1979), British Patent No. 1,425,020, West German Patent Application (OLS) Nos. 2,219,917, 2,261,361, 2,329,587 and 2,433,812. Of these couplers, α-pivaloylacetanilide series yellow couplers are excellent in fastness, and particularly light fastness of the colored dyes formed, while α-benzoylacetanilide series yellow couplers provide high color density.

Magenta couplers used in color photographic materials include oil-protect indazolone series or cyanoacetyl series magenta couplers, preferably 5-pyrazolone series couplers and pyrazoloazole series couplers such as pyrazolotriazole series couplers. 5-Pyrazolone series couplers having an arylamino group or an acylamino group at the 3-position are preferred because of the hue and color density of the colored dye formed. Typical examples of these couplers are described in U.S. Pat. Nos. 2,311,082, 2,343,703, 2,600,788, 2,908,573, 3,062,653, 3,152,896, and 3,936,015. Preferred releasing groups for the 2equivalent 5-pyrazolone series magenta couplers include nitrogen atom-releasing groups described in U.S. Pat. No. 4,310,619 and arylthio groups described in U.S. Pat. No. 4,351,897. Also, 5-pyrazolone series magenta couplers having a ballast group described in European Patent No. 73,636 give high coloring density.

Pyrazoloazole series magenta couplers include pyrazolobenzimidazoles described in U.S. Pat. No. 3,369,879, preferably pyrazolo[5,1-c][1,2,4]triazoles described in U.S. Pat. No. 3,725,067; pyrazolotetrazoles described in *Research Disclosure*, No. 24220 (June, 1984), and pyrazolopyrazoles described in ibid, No. 24230 (June, 1984). For reduced yellow side absorption of colored dyes and high light fastness of colored dyes, imidazo[1,2-b]-pyrazoles described in European Patent 119,741 are preferred and pyrazolo[1,5-b][1,2,4]triazoles described in European Patent No. 119,860 are particularly preferred.

Cyan couplers for use in this invention include oil-protect type naphtholic and phenolic couplers. The naphtholic cyan couplers include naphtholic couplers described in U.S. Pat. No. 2,474,293 and preferably, oxygen atom-releasing 2-equivalent naphtholic couplers described in U.S. Pat. Nos. 4,052,212, 4,146,396, 4,228,233, and 4,296,200. Also, specific examples of the phenolic cyan couplers are described in U.S. Pat. Nos. 2,369,929, 2,801,171, 2,772,162 and 2,895,826. Cyan couplers having high fastness to moisture and heat are preferably used in color materials processed by this invention and typical examples thereof include phenolic cyan couplers having an alkyl group or two or more carbon atoms at the meta-positions of the phenol nucleus described in U.S. Pat. No. 3,772,002; 2,5-diacylamino-substituted phenolic cyan couplers described in U.S. Pat. Nos. 2,772,162, 3,758,308, 4,126,396, 4,334,011, and 4,327,173, West German Patent Application (OLS) No. 3,329,729 and Japanese Patent Application (OPI) No. 166956/84, and phenolic cyan couplers having a phenylureido group at the 2-position and an acylamino group at the 5-position thereof described in U.S. Pat. Nos. 3,446,622, 4,333,999, 4,451,559 and 4,427,767.

In particular, in the process of this invention, good photographic properties with reduced fog formation can be obtained when the photographic materials contain at least one cyan coupler represented by the following formulae (C-I) and (C-II). The improvement obtained by using the process according to the invention is striking.

The cyan couplers represented by formulae (C-I) and (C-II) are now described in detail:

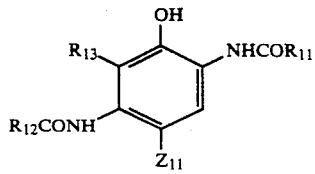

(C-I)

in which $R_{11}$ represents an alkyl group, a cycloalkyl group, an aryl group, an amino group, or a heterocyclic group; $R_{12}$ represents an alkyl group or an aryl group; $R_{13}$ represents a hydrogen atom, a halogen atom, an alkyl group, or an alkoxy group; $R_{12}$ and $R_{13}$ may combine with each other to form a ring; and $Z_{11}$ represents a hydrogen atom, a halogen atom, or a releasable group capable of being released by a coupling reaction with the oxidation product of an aromatic primary amine color developing agent.

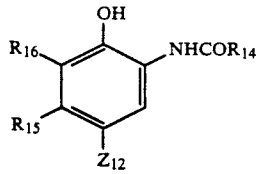

(C-II)

in which $R_{14}$ represents an alkyl group, a cycloalkyl group, an aryl group, or a heterocyclic group; $R_{15}$ represents an alkyl group having 2 or more carbon atoms; $R_{16}$ represents a hydrogen atom, a halogen atom, or an alkyl group; and $Z_{12}$ represents a hydrogen atom, a halogen atom, or a releasable group capable of being released by a coupling reaction with the oxidation product of an aromatic primary amine color developing agent.

In the cyan couplers represented by formulae (C-I) and (C-II) described above, the alkyl group represented by $R_{11}$, $R_{12}$ and $R_{14}$ includes an alkyl group having from 1 to 32 carbon atoms, such as a methyl group, a butyl group, a tridecyl group, a cyclohexyl group and an allyl group. Examples of the aryl group represented by $R_{11}$, $R_{12}$ and $R_{14}$ include a phenyl group and a naphthyl group. Examples of the heterocyclic group represented by $R_{11}$ and $R_{14}$ include a 2-pyridyl group, a 2-imidazolyl group, a 2-furyl group and a 6-quinolyl group. These groups may have a substituent such as an alkyl group, an aryl group, a heterocyclic group, an alkoxy group (e.g., a methoxy group, a 2-methoxyethoxy group, etc.), an aryloxy group (e.g., a 2,4-di-tert-amylphenoxy group, a 2-chlorophenoxy group, a 4-cyanophenoxy group, etc.), an alkenyloxy group (e.g., a 2-propenyloxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butoxysulfonyl group, a toluenesulfonyloxy group, etc.), an amido group (e.g., an acetylamino group, a methanesulfonamido group, a dipropylsulfamoylamino group, etc.), a carbamoyl group (e.g., a dimethylcarbamoyl group, an ethylcarbamoyl group, etc.), a sulfamoyl group (e.g., a butylsulfamoyl group, etc.), an imido group (e.g., a succinimido group, a hydantoinyl group, etc.), a ureido group (e.g., a phenylureido group, a dimethylureido group, etc.), an aliphatic or aromatic sulfonyl group (e.g., a methanesulfonyl group, a phenylsulfonyl group, etc.), an aliphatic or aromatic thio group (e.g., an ethylthio group, a phenylthio group, etc.), a hydroxy group, a cyano group, a carboxy group, a nitro group, a sulfo group, a halogen atom.

The cycloalkyl group represented by $R_{11}$ includes a cycloalkyl group having to 32 carbon atoms, such as a cyclohexyl group and a benzocyclohexyl group.

The amino group represented by $R_{11}$ is a substituted or unsubstituted amino group, and the substituent for the amino group includes those illustrated above. Examples of the substituted amino group represented by $R_{11}$ include an anilino group a benzothiazolylamino group, etc.

When $R_{13}$ in formula (C-I) is a substitutable group, the group may be substituted by any substituent illustrated above for $R_{11}$, $R_{12}$ and $R_{14}$.

Examples of the alkyl group, which may be substituted, having 2 or more carbon atoms represented by $R_{15}$ in formula (C-II) are an ethyl group, a propyl group, a butyl group, a pentadecyl group, a tertbutyl group, a cyclohexyl group, a cyclohexylmethyl group, a phenylthiomethyl group, a dodecyloxyphenylthiomethyl group, a butaneamidomethyl group, a methoxymethyl group, etc.

$Z_{11}$ and $Z_{12}$ in formulae (C-I) and (C-II) each represents a hydrogen atom or a coupling releasable group (including a coupling releasing atom) and examples of the releasable group include a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecan oyloxy group, or a benzoyloxy group, etc.), a sulfonyloxy group (e.g., a methanesulfonyloxy group, a toluenesulfonyloxy group, etc.), an amido group (e.g., a dichloroacetylamino group, a heptafluorobutylamino group, a methanesulfonylamino group, a toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic or aromatic thio group (e.g., an ethylthio group, a phenylthio group, a tetrazolylthio group, etc.), an imido group (e.g., a succinimido group or a hydantoinyl group) and an aromatic azo group (e.g., phenylazo group, etc.). These releasing group may containing a photographically useful group.

Preferred cyan couplers represented by formula (C-I) or (C-II) described above are as follows.

In formula (C-I), $R_{11}$ is preferably an aryl group or a heterocyclic group and is more preferably an aryl group substituted by a halogen atom; an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

When in formula (C-I), $R_{12}$ and $R_{13}$ do not form a ring, $R_{12}$ preferably represents a substituted or unsubstituted alkyl group or aryl group, and particularly preferably an alkyl group substituted by a substituted aryloxy group, and $R_{13}$ is preferably a hydrogen atom.

In formula (C-II), $R_{14}$ is preferably a substituted or unsubstituted alkyl or aryl group, and particularly preferably an alkyl group substituted by a substituted aryloxy group.

In formula (C-II), $R_{15}$ is preferably an alkyl group having 2 to 15 carbon atoms or a methyl group having a substituent containing at least 1 carbon atom, and examples of the preferred substituent are an arylthio group, an alkylthio group, an acylamino group, an aryloxy group, or an alkyloxy group.

In formula (C-II), $R_{15}$ is more preferably an alkyl group having 2 to 15 carbon atoms, and particularly preferably a chlorine atom or a fluorine atom.

In formulae (C-I) and (C-II), $Z_{11}$ and $Z_{12}$ each is preferably a hydrogen atom, a halogen atom, an alkoxy group, an aryloxy group, an acyloxy group, or a sulfonamido group.

In formula (C-II), $Z_{12}$ is more preferably a halogen atom, and particularly preferably a chlorine atom or a fluorine atom.

In formula (C-I), $Z_{11}$ is more preferably a halogen atom, and particularly preferably a chlorine atom or a fluorine atom.

Specific examples of the cyan couplers represented by formulae (C-I) and (C-II) described above are illustrated below, but the invention is not to be construed as being limited to these compounds.

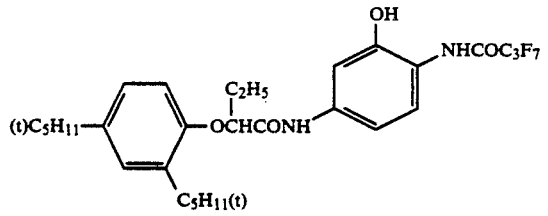

(C-1)

-continued
(C-2)
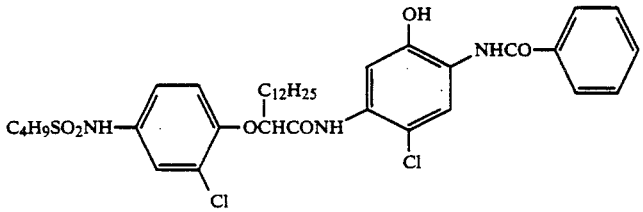
(C-3)
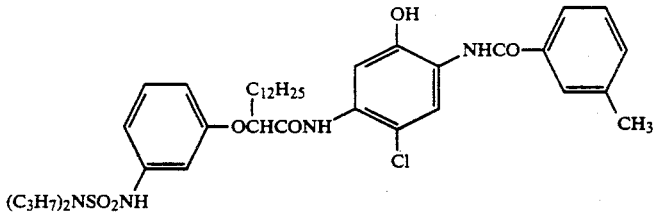
(C-4)
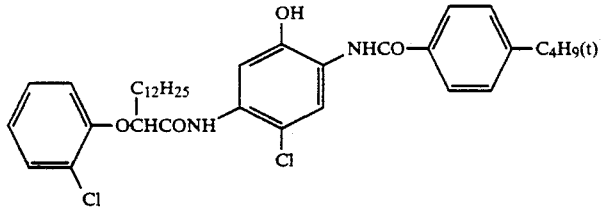
(C-5)
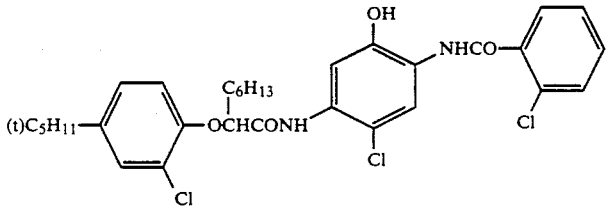
(C-6)
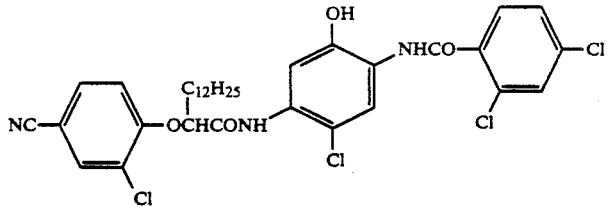
(C-7)
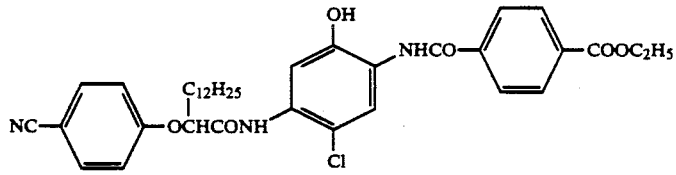
(C-8)
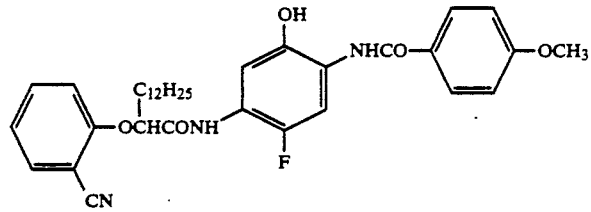

-continued
(C-9)
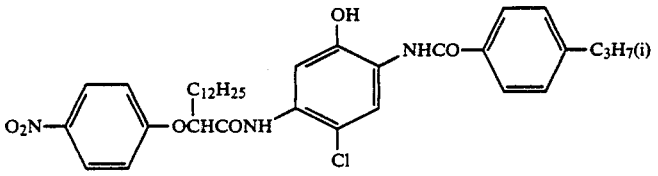
(C-10)
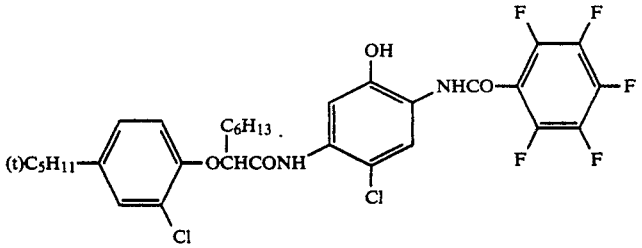
(C-11)
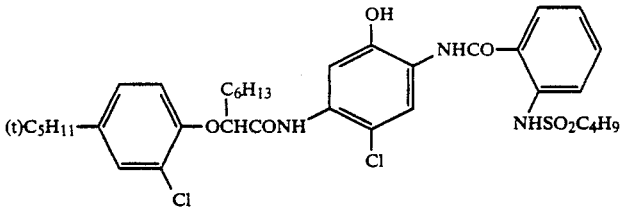
(C-12)
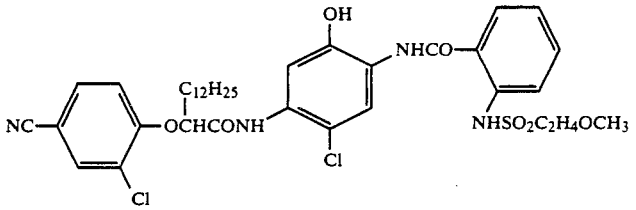
(C-13)
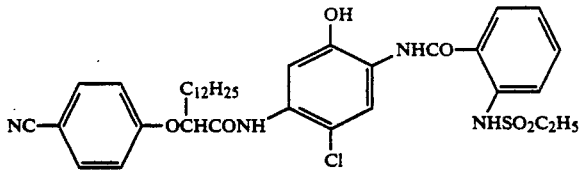
(C-14)
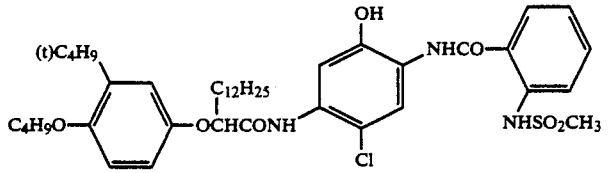
(C-15)
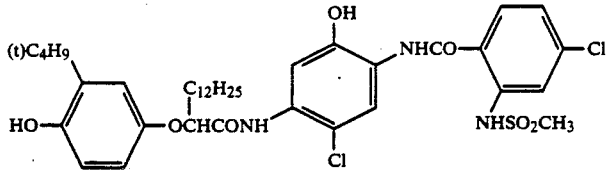

-continued
(C-16)
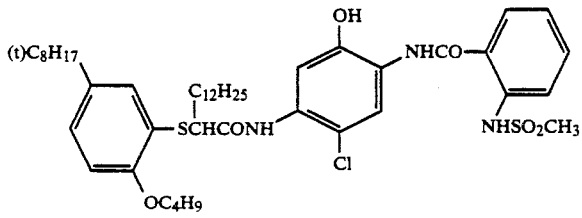
(C-17)
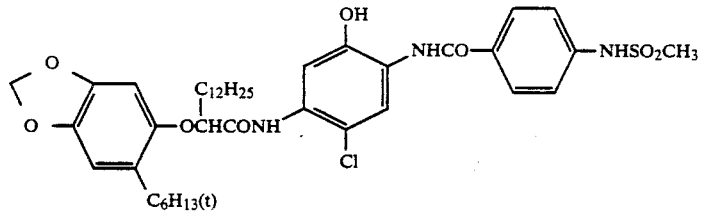
(C-18)
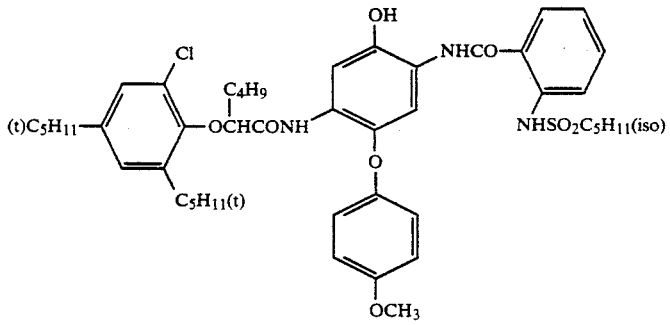
(C-19)
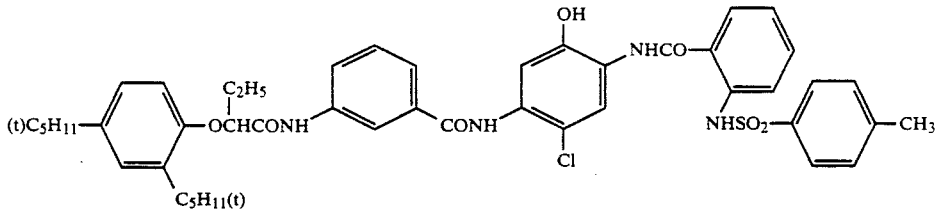
(C-20)
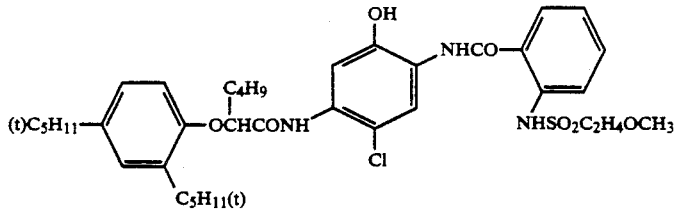
(C-21)
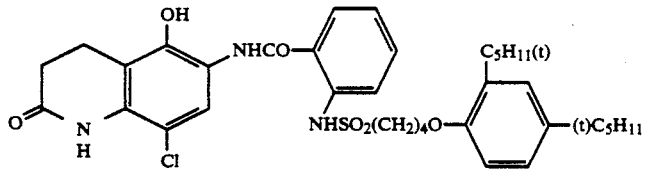
(C-22)
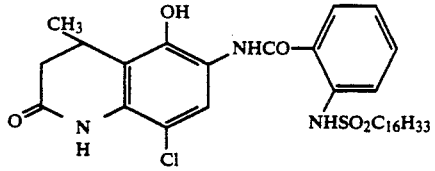

-continued
(C-23)
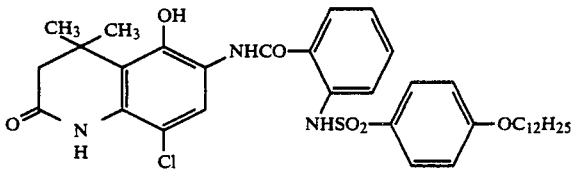
(C-24)
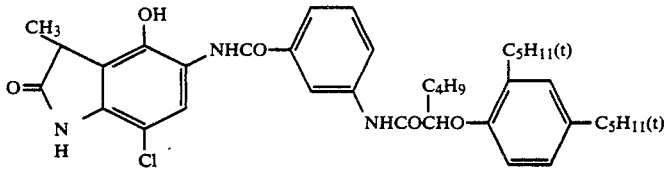
(C-25)
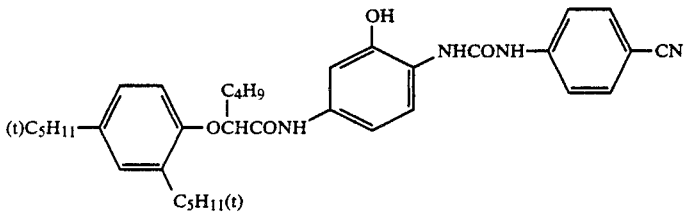
(C-26)
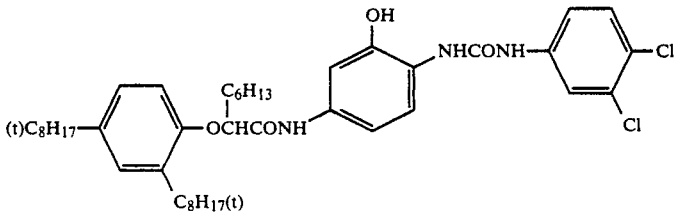
(C-27)
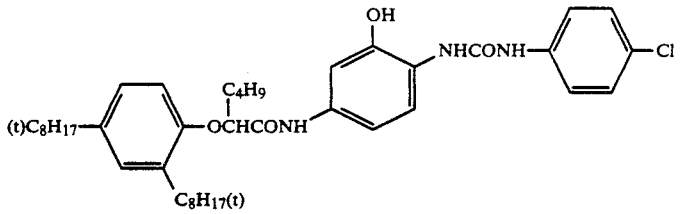
(C-28)
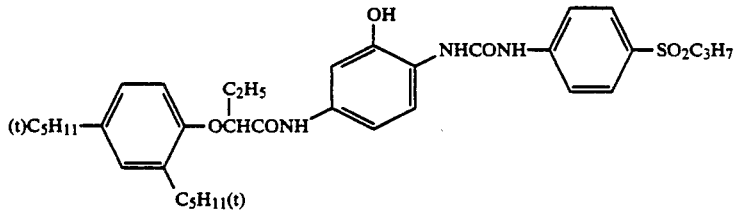
(C-29)
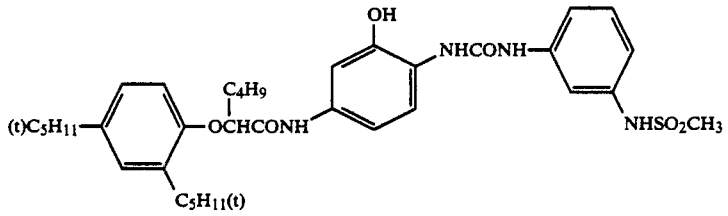

-continued
(C-30)
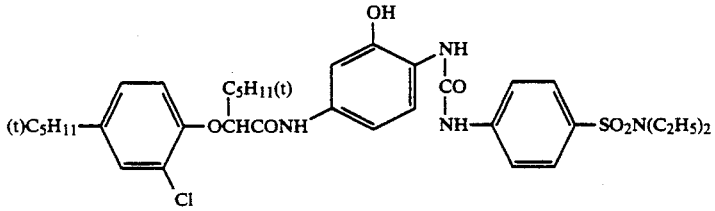
(C-31)
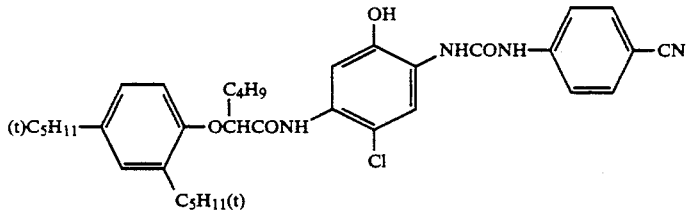
(C-32)
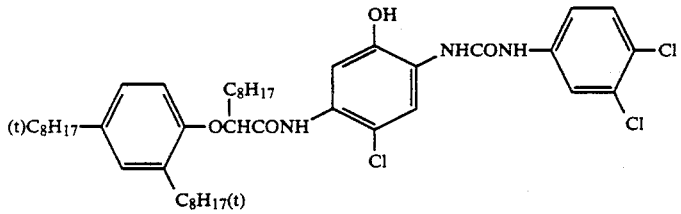
(C-33)
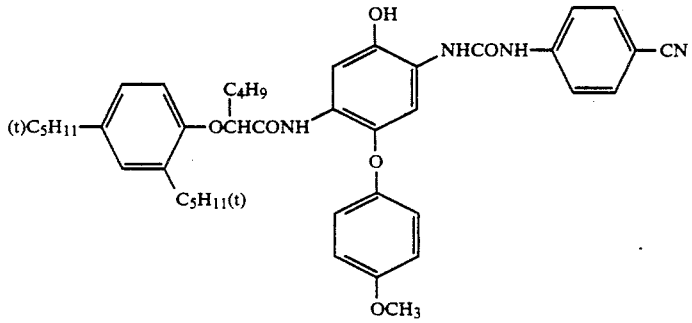
(C-34)
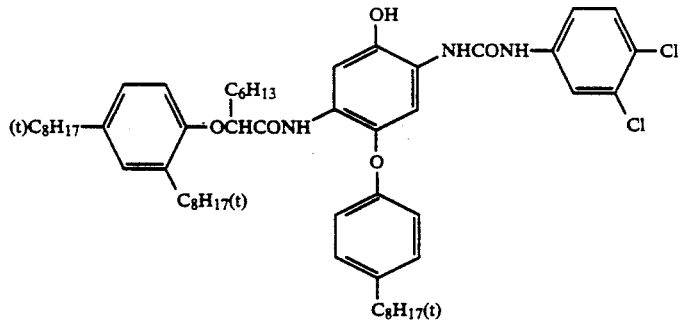
(C-35)
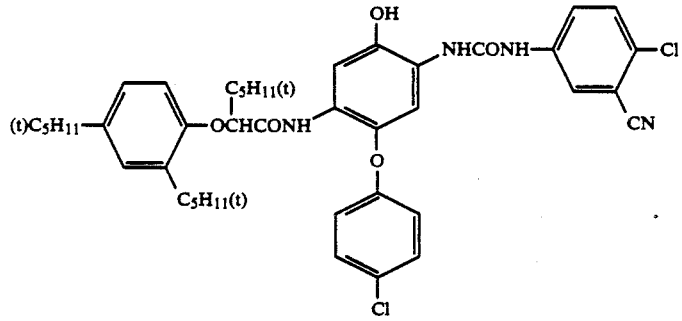

-continued
(C-36)
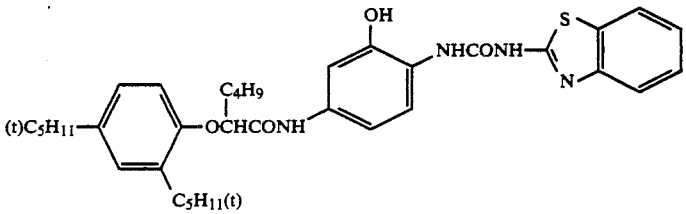
(C-37)
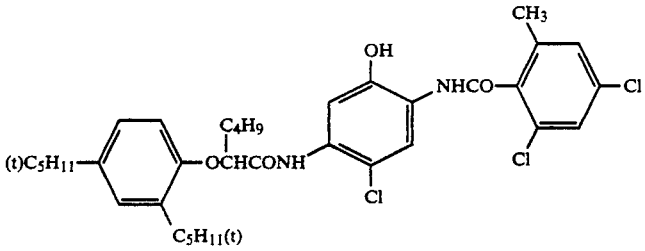
(C-38)
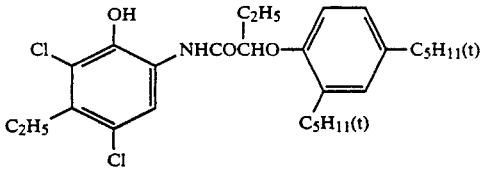
(C-39)
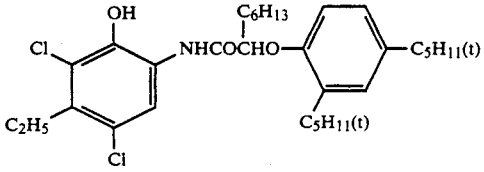
(C-40)
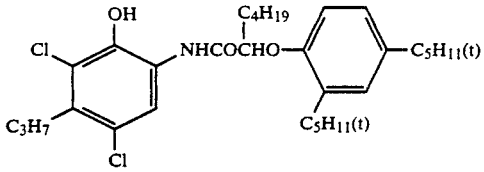
(C-41)
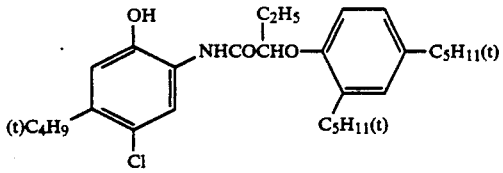
(C-42)
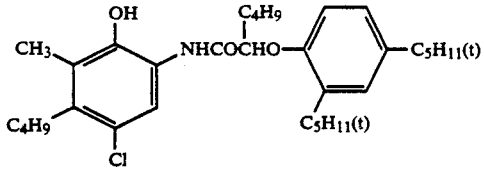
(C-43)
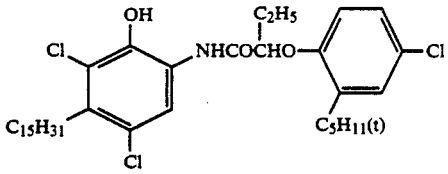

-continued (C-44)

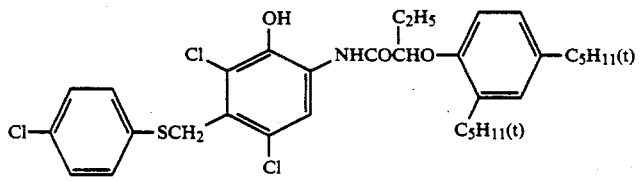

(C-45)

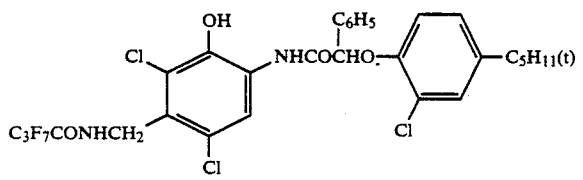

(C-46)

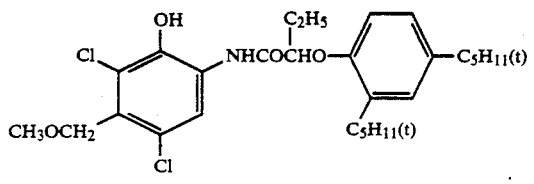

(C-47)

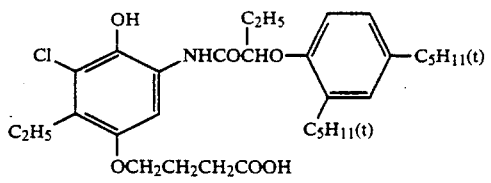

(C-48)

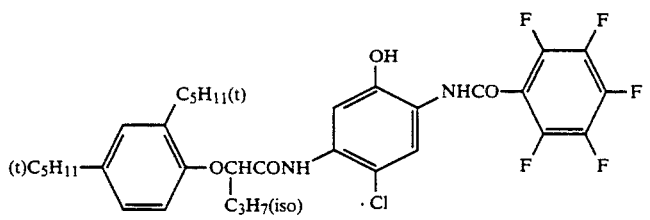

(C-49)

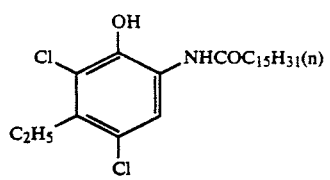

(C-50)

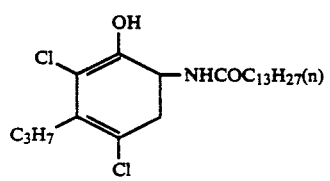

The cyan couplers shown by formulae (C-I) and (C-II) described above can be synthesized based on the methods described in Japanese Patent Application (OPI) No. 166956/84 and Japanese Patent Publication No. 11572/74.

In this invention, the graininess of the color images formed can be improved by using a coupler providing a colored dye having a proper diffusibility together with the above coupler(s). With respect to such couplers providing diffusible dyes, specific examples of magenta couplers are described in U.S. Pat. No. 4,366,237 and British Patent No. 2,125,570 and specific examples of yellow, magenta and cyan couplers are described in European Patent No. 96,570 and West German Patent Application (OLS) No. 3,234,533.

The dye-forming couplers and the specific couplers described above may form a dimer or higher polymer. Typical examples of polymerized dye-forming couplers are described in U.S. Pat. Nos. 3,451,820 and 4,080,211. Also, specific examples of polymerized magenta couplers are described in British Patent No. 2,102,173 and U.S. Pat. No. 4,367,282.

The various couplers for use in this invention can be used in one light-sensitive emulsion layer as a mixture of two or more, to provide the properties required for the color photographic material, or the same kind of coupler may be incorporated in two or more photographic layers.

The couplers for use in materials processed according to the invention can be introduced into silver halide emulsions by an oil drop-in-water dispersion method. That is, the coupler is dissolved in a high boiling organic solvent having a boiling point of at least about 175° C., a low boiling auxiliary solvent, or a mixture of both types of solvents, and then is finely dispersed in water or an aqueous medium such as an aqueous gelatin solution in the presence of a surface active agent. Examples of the high boiling organic solvent are described in U.S. Pat. No. 2,322,027, etc. In this case, the coupler may be dispersed with phase inversion and also, if necessary, the auxiliary solvent may be removed by distillation, noodle washing, or ultra-filtration before coating the dispersion.

Specific examples of the high boiling organic solvent include phthalic acid esters (e.g., dibutyl phthalate, dicyclohexyl phthalate, di-2-ethylhexyl phthalate, decyl phthalate, etc.), phosphoric acid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, etc.), benzoic acid esters (e.g., 2-ethylhexyl benzoate, dodecylbenzoate, 2-ethylhexyl-p-hydroxy benzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylic acid esters (e.g., dioctyl acetate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.).

As the auxiliary solvent, organic-solvents having boiling point of at least about 30° C., and preferably from about 50° C. to about 160° C. can be used, and specific examples thereof are ethyl acetate, butyl acetate, ethyl propionate, methyl ethyl ketone, cyclohexanone, 2-ethoxyethyl acetate, dimethylformamide.

A latex dispersing method can also be applied for incorporating the coupler into silver halide emulsions. The latex dispersing method and specific examples of the latex for impregnation are described in U.S. Pat. No. 4,199,363, West German Application (OLS) Nos. 2,541,274, 2,541,230.

A standard amount of the color coupler is in the range of from about 0.001 mol to 1 mol per mol of the light-sensitive silver halide in the silver halide emulsion layer, with from about 0.01 mol to 0.5 mol of a yellow coupler, from about 0.003 mol to 0.3 mol of a magenta coupler, and from about 0.002 mol to 0.3 mol of a cyan coupler per mol of the light-sensitive silver halide being preferred.

The color photographic materials which are processed by the process of this invention may further contain hydroquinone derivatives, aminophenol derivatives, amines, gallic acid derivatives, catechol derivatives, ascorbic acid derivatives, colorless couplers, sulfonamidophenol derivatives, etc., as color fog preventing agents or color mixing preventing agents.

Also, the color photographic materials used in this invention may further contain known fading preventing agents. Typical examples of organic fading preventing agents are hydroquinones, 6-hydroxychromans, 5-hydroxycoumarans, spirochromans, p-alkoxyphenols, bisphenols, hindered phenols, gallic acid derivatives, methylenedioxybenzenes, aminophenols, hindered amines, and the ether or ester derivatives of the aforesaid compounds formed by silylating or alkylating the phenolic hydroxy groups of these compounds. Also, metal complexes such as (bis-salicylaldoxymate) nickel complexes and (bis-N, N-dialkyldithiocarbamate) nickel complexes can also be used as the fading preventing agent.

For preventing the deterioration of yellow dye images by heat, moisture, and light, a compound having both hindered amine and hindered phenol moieties in one molecule, as described in U.S. Pat. No. 4,268,593, gives good results. Also, for preventing the deterioration of magenta dye images, particularly by light, spiroindans described in Japanese Patent Application (OPI) No. 159644/81 and chromans substituted by a hydroquinone diether or hydroquinone monoether described in Japanese Patent Application (OPI) No. 89835/80 give preferred results.

For improving storage stability, and in particular, the light fastness of cyan dye images, it is preferred to use a benzotriazole series ultraviolet absorbent with the cyan coupler(s). In this case, the ultraviolet absorbent may be co-emulsified with the cyan coupler(s). In this case, the ultraviolet absorbent may be coemulsified with the cyan coupler(s).

The amount of the ultraviolet absorbent may be one sufficient for imparting light stability to cyan dye images, but since if the amount is too much, the unexposed portions (background portions) of the color photographic material may be yellowed, the amount thereof is usually selected in the range of from about $1\times10^{-4}$ mol/m$^2$ to $2\times10^{-3}$ mol/m$^2$, particularly from about $5\times10^{-4}$ mol/m$^2$ to $1.5\times10^{-3}$ mol/m$^2$.

In the layer structure of an ordinary color photographic paper, the ultraviolet absorbent(s) are incorporated in one or both layers adjacent to a red-sensitive silver halide emulsion layer containing cyan coupler(s). When the ultraviolet absorbent(s) are incorporated in the interlayer between a green-sensitive emulsion layer and a red-sensitive emulsion layer, the ultraviolet absorbent(s) may be co-emulsified with a color mixing preventing agent. When the ultraviolet absorbent(s) are incorporated in a protective layer, another protective layer may be formed on the protective layer as the outermost layer. The outermost protective layer may contain a matting agent having a proper particle size.

The color photographic materials may further contain water-soluble dyes in the hydrophilic colloid layers as filter dyes or for the purpose of irradiation prevention or halation prevention. As such water-soluble dyes, oxonol series dyes, anthraquinone dyes, and azo series dyes are preferred. Oxonol dyes showing absorptions for green light and red light are particularly preferred.

The color photographic materials used in this invention may further contain whitening agents such as stilbene series, triazine series, oxazole series, or coumarin series whitening agents in the photographic emulsion layers or other hydrophilic colloid layers. In these materials, a water-soluble whitening agent is typically used but a waterinsoluble whitening agent may be also used in the form of the dispersion.

The process of this invention can be applied to a multilayer multicolor photographic material having at least two photographic emulsion layers each having a different spectral sensitivity on a support. A multilayer natural color photographic material usually has at least one red-sensitive emulsion layer, at least one green-sensitive emulsion layer, and at least one blue-sensitive emulsion layer layer on a support. The disposition order of the emulsion layers can be optionally selected according to purpose. Also, each of the aforesaid emulsion layers may be composed of two or more emulsion layers each having different light sensitivities or a light-insensitive layer may exist between two or more emulsion layers each having the same sensitivity.

The color photographic material for use in this invention preferably has auxiliary layers such as protective layer(s), interlayers, a filter layer, an antihalation layer, a backing layer, etc., in addition to the silver halide emulsion layers.

As a binder or protective colloid which can be used for the emulsion layers and auxiliary layers of the color photographic materials for use in this invention, gelatin is advantageously used but other hydrophilic colloids can be also used.

Examples of the protective colloid include proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; saccharose derivatives such as sodium alginate, starch derivatives, etc.; and synthetic hydrophilic polymers such as polyvinyl alcohol, polyvinyl alcohol partial acetal, poly-N-vinyl-pyrrolidone, polyacrylic acid, polymethacrylic acid, polyacrylamide, polyvinylimidazole, polyvinyl-pyr-zole, etc.

The use of acrylic acid-modified polyvinyl alcohols is useful for the protective layer and further is particularly useful for rapid processing of color photographic materials containing a silver chloride emulsion.

As gelatin, lime-processed gelatin as well as acid-processed gelatin and enzyme-processed gelatin as described in *Bull. Soc. Sci. Photo. Japan*, No. 16, p. 30 (1966) can be used. Also, the hydrolyzed product or enzyme-decomposed product of gelatin can be used.

The color photographic materials for use in this invention may further contain various stabilizers, stain preventing agents, developing agents or the precursors therefor, development accelerators described above or the precursors thereof, lubricants, mordants, matting agents, antistatic agents, plasticizers, or other photographically useful additives in addition to the above-described additives. Typical examples of such additives are described in *Research Disclosure*, No. 17643 (December, 1978) and inid., No. 18716 (November, 1979).

These additives are very important in rapid printing and rapid processing, and further are important in relation to the compound represented by formula (I) described above for improvement of stability of photographic characteristics and fog preventing effect in this invention. Also, in particular, when the silver halide emulsions for use in this invention contain a high content of silver chloride, it is useful for improving coloring properties and preventing the occurence of fog to include a mercaptoazole series compound, a mercaptothiadiazole series compound, or a mercaptobenzazole series compound in the emulsions.

The reflective support for the color photographic materials which are processed in this invention is a support having high reflectivity for clearly viewing the color images formed in silver halide emulsion layer(s), and includes a support coated with a hydrophobic resin having dispersed therein a light reflective material such as titanium oxide, zinc oxide, calcium carbonate, calcium sulfate, etc., and a support composed of a hydrophobic resin containing the light reflective material as described above as a dispersion thereof. Examples of such a support include baryta-coated papers, polyethylene-coated papers, polypropylene series synthetic papers, and transparent supports coated with a reflective layer or containing therein a reflective material as described above. Examples of such a transparent support are glass plates, polyester films (e.g., polyethylene terephthalate films, etc.), polyamide films, polycarbonate films, polystyrene films, etc. These supports can be properly selected according to the purposes.

The process for synthesizing the hydrazides to be used in the present invention will be illustrated by way of the following Synthesis Examples.

SYNTHESIS EXAMPLE 1

Synthesis of Compound I-29

To a solution of 39 g of sodium sulfanilate and 17 ml of pyridine in 100 ml of acetonitrile was slowly added dropwise 26.5 ml of phenyl chloroformate under ice-cooling, followed by stirring at room temperature for 5 hours. The precipitated crystals were collected by filtration, washed twice with 50 ml of acetonitrile, and dried to obtain 63 g of a sodium salt of phenyl 4-sulfocarbanilide. Subsequently, the resulting crystals were added slowly to a solution of 62 g of hydrazine hydrate (80%) in 50 ml of water under ice-cooling, followed by stirring at room temperature for 3 hours. The reaction solution was adjusted to a pH of about 1 by addition of 100 ml of concentrated hydrochloric acid under ice-cooling to precipitate white crystals. The crystals were collected by filtration, washed once with 20 ml of water and then twice with 50 ml of methanol, and dried to obtain 34 g of 4-(4-sulfophenyl) semicarbazide (decomposition point: 285° C.).

Elementary Analysis for $C_7H_9N_3O_4S$:
Calcd. (%): C 36.36; H 3.92; N 18.18;
Found (%): C 36.11; H 4.01; N 18.14.

SYNTHESIS EXAMPLE 2

Synthesis of Compound I-33

The procedure of Synthesis Example 1 was repeated, except for replacing 39 g of sodium sulfanilate as used in Synthesis Example 1 with 42 g of sodium o-toluidine-5-sulfonate to obtain 23 g of 4-(2-methyl-4-sulfophenyl)-semicarbazide (melting point: 252–255° C.).

Elementary Analysis for $C_8H_{11}N_3O_4S$:
Calcd. (%): C 39.17; H 4.52; N 17.14;
Found (%): C 39.34; H 4.45; N 16.93.

SYNTHESIS EXAMPLE 3

Synthesis of Compound I-34

The same procedure of Synthesis Example 1 was repeated, except for replacing 39 g of sodium sulfanilate as used in Synthesis Example 1 with 49 g of sodium 4-amino-1-naphthalenesulfonate to obtain g of 4-(4-sulfo-1-naphtyl)semicarbazide (melting point: 265–267° C.).

Elementary Analysis for $C_{11}H_{11}N_3O_4S$:
Calcd. (%): C 46.96; H 3.94; N 14.94;
Found (%): C 47.07; H 3.82; N 14.99.

SYNTHESIS EXAMPLE 4

Synthesis of Compound I-41

The same procedure of Synthesis Example 1 was repeated, except for replacing 39 g of sodium sulfanilate as used in Synthesis Example 1 with 39 g of sodium 2,2'-benzidinedisulfonate to obtain 37 g of Compound I-41 (decomposition point: 290° C.).

Elementary Analysis for $C_{14}H_{16}N_6O_8S_2$:
Calcd. (%): C 36.51; H 3.50; N 18.26;
Found (%): C 36.69; H 3.37; N 18.19.

SYNTHESIS EXAMPLE 5

Synthesis of Compound I-42

The same procedure of Synthesis Example 1 was repeated, except for replacing 39 g of sodium sulfanilate as used in Synthesis Example 1 with 41 g of sodium 4,4'-diaminostilbene-2,2'-disulfonate to obtain 39 g of Compound I-42 (melting point: 238–241° C.).

Elementary Analysis for $C_{16}H_{18}N_6O_8S_2$:
Calcd. (%): C 39.50; H 3.73; N 17.28;
Found (%): C 39.72; H 3.63; N 17.31.

SYNTHESIS EXAMPLE 6

Synthesis of Compound I-43

The same procedure of Synthesis Example 1 was repeated, except for replacing 39 g of sodium sulfanilate as used in Synthesis Example 1 with 21 g of sodium m-phenylenediamine-4-sulfonate to obtain g of Compound I-43 (melting point: 295–297° C.).

Elementary Analysis for $C_8H_{12}N_6O_5S$:
Calcd. (%): C 31.57; H 3.97; N 27.62;
Found (%): C 31.77; H 3.83; N 27.60.

SYNTHESIS EXAMPLE 7

Synthesis of Compound I-53

The same procedure of Synthesis Example 1 was repeated, except for replacing 39 g of sodium sulfanilate as used in Synthesis Example with 29 g of sodium aminoethanesulfonate to obtain 15 g of 4-(2-sulfoethyl)-semicarbazide (melting point: 212–215° C.).

Elementary Analysis for $C_3H_9N_3O_4S$:
Calcd. (%): C 19.67; H 4.95; N 22.94;
Found (%): C 19.60; H 4.51; N 22.91.

SYNTHESIS EXAMPLE 8

Synthesis of Compound I-28

To a solution of 27 g of p-aminobenzoic acid in 100 ml of acetonitrile was slowly added drop-wise 25 ml of phenyl chloroformate under ice-cooling, followed by stirring at room temperature for 2 hours. To the solution was further added 16 ml of pyridine at room temperature, followed by stirring for 1 hour. After completion of the reaction, the reaction solution was poured into 1 l of ice-water to precipitate while crystals. The crystals were collected by filtration, washed twice with 50 ml of water, and dried to obtain 47 g of phenyl 4-carboxycarbanilide. Subsequently, the crystals were slowly added to a solution of 62 g of hydrazine hydrate (80%) in 50 ml of water while ice-cooling, and the mixture was stirred at room temperature for 3 hours. The reaction solution was adjusted to a pH of about 1 by addition of 100 ml of concentrated hydrochloric acid under ice-cooling to precipitate white crystals. The thus formed crystals were collected by filtration, washed once with 20 ml of water and then twice with 50 ml of methanol, and dried to obtain 29 g of 4-(4-carboxyphenyl)semicarbazide (melting point: 254–257° C.).

Elementary Analysis for $C_8H_9N_3O_3$:
Calcd. (%): C 49.23; H 4.65; N 21.53;
Found (%): C 48.98; H 4.58; N 21.26.

SYNTHESIS EXAMPLE 9

Synthesis of Compound I-44

The same procedure of Synthesis Example 8 was repeated, except for replacing 27 g of p-aminobenzoic acid with 15 g of 3,5-diaminobenzoic acid to obtain 21 g of Compound I-44 (melting point: 272–274° C.).

Elementary Analysis for $C_9H_{12}N_6O_4$:
Calcd. (%): C 40.29; H 4.51; N 31.34;
Found (%): C 40.50; H 4.46; N 31.24.

SYNTHESIS EXAMPLE 10

Synthesis of Compound I-50

The same procedure of Synthesis Example 8 was repeated, except for replacing 27 g of p-aminobenzoic acid as used in Synthesis Example 8 with 26 g of iminodiacetic acid to obtain 19 g of Compound I-50 melting point: 192–194° C.).

Elementary Analysis for $C_5H_9N_3O_5$:
Calcd. (%): C 31.42; H 4.75; N 21.99;
Found (%): C 31.33; H 4.89; N 22.07.

SYNTHESIS EXAMPLE 11

Synthesis of Compound I-54

The same procedure of Synthesis Example 8 was repeated, except for replacing 27 g of p-aminobenzoic acid with 17 g of $\beta$-alanine to obtain 15 g of Compound I-54 (melting point: 152–155° C.).

Elementary Analysis for $C_4H_9N_3O_3$:
Calcd. (%): C 32.65; H 6.17; N 28.56;
Found (%): C 32.51; H 6.03; N 28.39.

SYNTHESIS EXAMPLE 12

Synthesis of Compound I-39

To a solution of 22 g of p-aminophenol in 100 ml of acetonitrile was slowly added dropwise 26 ml of phenyl chloroformate under ice-cooling, and the mixture was stirred at room temperature for 2 hours. To the mixture was added 17 ml of pyridine at room temperature, followed by stirring for 1 hour. After completion of the reaction, the reaction solution was poured into 1 l of ice-water to precipitate white crystals. The crystals were collected by filtration, washed twice with 50 ml of water, and dried to obtain 6 g of phenyl 4-hydroxycarbanilide. Subsequently, the crystals were slowly added to a solution of 62 g of hydrazine hydrate (80%) in 50 ml of methanol under ice-cooling, followed by stirring at room temperature for 3 hours. The reaction solution was poured into 1 l of ice-water to precipitate white crystals. The thus formed crystals were collected by filtration, washed once with 20 ml of water and then twice with 50 ml of isopropyl alcohol, and dried to obtain 15 g of 4-(4-hydroxyphenyl)semicarbazide (melting point: 184–186° C.).

Elementary Analysis for $C_7H_9N_3O_2$:
Calcd. (%): C 50.29; H 5.43; N 25.14;
Found (%): C 50.32, H 5.30; N 25.36.

SYNTHESIS EXAMPLE 13

Synthesis of Compound I-17

The same procedure of Synthesis Example 12 was repeated, except for replacing 22 g of p-aminophenol with 8 g of piperazine to obtain 10 g of Compound I-17 (melting point: 137–139° C.).

Elementary Analysis for $C_6H_{14}N_6O_2$:
Calcd. (%): C 35.63; H 6.98: N 41.57;
Found (%): C 35.59; H 6.78; N 41.39.

SYNTHESIS EXAMPLE 14

Synthesis of Compound I-35

The same procedure of Synthesis Example 12 was repeated, except for replacing p-aminophenol as used in Synthesis Example 12 with 12 g of 2,4-diaminotoluene to obtain 20 g of Compound I-35 (melting point: 180–182° C.).

Elementary Analysis for $C_9H_{14}N_6O_2$:
Calcd. (%): C 45.37; H 5.92; N 35.28;
Found (%): C 45.32; H 5.81; N 35.45.

SYNTHESIS EXAMPLE 15

Synthesis of Compound I-30

The same procedure of Synthesis Example 12 was repeated, except for replacing 22 g of p-aminophenol as used in Synthesis Example 12 with 22 g of m-aminophenol to obtain 20 g of Compound I-30 (melting point: 142–145° C.).

Elementary Analysis for $C_6H_{14}N_6O$.
Calcd. (%): C 50.29; H 5.43; N 25.14;
Found (%): C 50.33; H 5.23; N 25.24.

SYNTHESIS EXAMPLE 16

Synthesis of Compound I-12

To a solution of 88 g of hydrazine hydrate (80%) in 50 ml of water was added dropwise 41 ml of methyl isocyanate under ice-cooling, followed by stirring for 30 minutes. After stirring at room temperature for 1 hour, the reaction solution was filtered. Sodium chloride was added to the filtrate, and the mixture was extracted three times with ethyl acetate/acetonitrile. The organic layer was dried over anhydrous sodium sulfate, and the solvent was removed by distillation under reduced pressure. The residue was recrystallized from ethyl acetate/acetonitrile (9:1 by volume) to obtain 30.1 g of 4-methylsemicarbazide (melting point: 118–120° C.).

Elementary Analysis:
Calcd. (%): C 26.96; H 7.92; N 47.16;
Found (%): C 27.14; H 7.84; N 47.27.

SYNTHESIS EXAMPLE 17

Synthesis of Compound I-63

To a solution of 30 g of hydrazine hydrate (80%) in 100 ml of ethanol was added dropwise 34 ml of t-butyl isocyanate under ice-cooling, followed by stirring for 1 hour. After stirring at room temperature for an additional 3 hours, a saturated aqueous solution of sodium chloride was added to the reaction solution. The mixture was extracted three ,times with ethyl acetate, and the organic layer was distilled under reduced pressure. To the residue was added 65 ml of a 10% hydrochloric acid aqueous solution. After washing with chloroform, 16 ml of a 50% aqueous solution of sodium hydroxide was added thereto, and sodium chloride was further added thereto The mixture was extracted with ethyl acetate, and the organic layer was dried over anhydrous sodium sulfate. The solvent was removed by distillation under reduced pressure. Recrystallization of the residue from n-hexane/ethyl acetate (9:1 by volume) to obtain 36 g of 4-t-butylsemicarbazide (melting point:109 –110 ° C.).

Elementary Analysis: $C_3H_9N_O$
Calcd. (%): C 34.94; H 8.80; N 40.75;
Found (%): C 34.99; H 8.71; N 40.57.

SYNTHESIS EXAMPLE 18

Synthesis of Compound I-49

The same procedure of Synthesis Example 16 was repeated, except for replacing 41 ml of methyl isocyanate as used in Synthesis Example 16 with 64 ml of dimethylcarbamyl chloride to obtain 36 g of 4,4-dimethylsemicarbazide (melting point: 109–110° C.).

Elementary Analysis for $C_3H_9N_3O$:
Calcd. (%): C 34.94; H 8.80; N 40.75;
Found (%): C 34.99; H 8.71; N 40.57.

SYNTHESIS EXAMPLE 19

Synthesis of Compound II-4

Into 200 ml of ethanol was poured 32 g (1.0 mol) of anhydrous hydrazine, and 38 g (0.2 mol) of p-toluenesulfonyl chloride was slowly added dropwise thereto while stirring. After the addition, the mixture was refluxed for 30 minutes and then poured into ice-water. The precipitated crystals were collected by filtration and recrystallized from acetonitrile to obtain 23 g of colorless crystals of p-toluenesulfonyl hydrazide (melting point: 107–108° C.).

SYNTHESIS EXAMPLE 20

Synthesis of Compound II-8

Into 200 ml of ethanol were poured 21.6 g (0.2 mol) of phenylhydrazine and 30 ml of triethylamine, and 21.6 g (0.2 mol) of ethyl chloroformate was slowly added dropwise thereto. After the addition, the mixture was refluxed for 30 minutes and then poured into ice-water. The mixture was extracted with ethyl acetate, and the extract was concentrated and purified by column chromatography to obtain 31 g of N-phenyl-N'-ethoxycarbonylhydrazine as an oily substance.

SYNTHESIS EXAMPLE 21

Synthesis of Compound II-23

In 1 l of methanol was dissolved 180 g of monomethyl terephthalate, and the solution was slowly added dropwise to 500 ml of hydrazine hydrate (50%) at room temperature while stirring. After the drop-wise addition, the mixture was heat-refluxed for 5 hours while stirring. A hydrochloric acid aqueous solution was slowly added to the reaction mixture to adjust to a pH of about 1 to thereby precipitate white crystals. Two liters of water was added to the system, followed by stirring for a while. The formed crystals were collected by filtration under reduced pressure, washed twice with 200 ml of water, and dried to obtain 160 g of p-carboxybenzhydrazide (melting point: 235–236° C.).

SYNTHESIS EXAMPLE 22

Synthesis of Compound II-25

To 156 g of hydrazine hydrate (80%) was added dropwise 62 ml of pivaloyl chloride, followed by stirring for one hour. To the reaction mixture was added 300 ml of a sodium chloride saturated aqueous solution, and the mixture was extracted three times with 500 ml of ethyl acetate. The organic layer was distilled under reduced pressure, and 150 ml of a 10% aqueous solution of hydrochloric acid was added to the residue. After washing with chloroform, 40 ml of a 50% aqueous solution of sodium hydroxide was added thereto, followed by extraction with ethyl acetate. The organic layer was dried over anhydrous sodium sulfate, and the solvent was removed by distillation under reduced pressure. The residue was recrystallized from hexane/ethyl acetate to obtain 7.2 g of Compound II-25 (melting point: 69–70° C.)

SYNTHESIS EXAMPLE 23

Synthesis of Compound II-49

To a solution of 94 g of hydrazine hydrate (80%) in 100 ml of ethanol was added dropwise 38 ml of phenyl chloroformate under ice-cooling, followed by stirring for 1 hour. To the reaction mixture was added 200 ml of a saturated sodium chloride aqueous solution, and the mixture was extracted three times with ethyl acetate. The organic layer was dried over anhydrous sodium sulfate, and the solvent was removed by distillation under reduced pressure. The residue was crystallized from hexane, and the resulting crystals were recrystallized from hexane/ethyl acetate to obtain 7.1 g of Compound II-49 (melting point: 106–107° C.).

The following examples are intended to illustrate the effects of this invention but not are not to be construed as limiting the invention in any way. Unless otherwise indicated, all parts, percents and ratios are by weight.

EXAMPLE 1

A multilayer color photographic paper having the layer structure as shown below on a paper support both surfaces of which were coated with polyethylene (the thickness of surface layer is 22 μm and the thickness of underlying layer is 29 μm) was prepared. In this case, a polyethylene layer coated on the emulsion layer side contained titanium dioxide as a white pigment and ultramarine blue as a bluish dye.

The coating compositions for the layers were prepared as follows.

Preparation of Coating Composition for Layer 1

To 19.1 g of yellow coupler (a) described below and 4.4 g of dye image stabilizer (b) shown below were added 27.2 ml of ethyl acetate and 7.9 ml of solvent (c) shown below and the components were dissolved in the solvents. The solution was dispersed by emulsification in 185 ml of an aqueous 10% gelatin solution containing 8 ml of an aqueous solution of 10% sodium dodecylbenzenesulfonate. Separately a blue spectral sensitizing dye shown below was added to a silver chlorobromide emulsion (containing 1 mol% silver bromide and 70 g/kg of silver) in an amount of $5.0\times10^{-4}$ mol per mol of silver chlorobromide. Thus, 90 g of the blue-sensitive silver halide emulsion was prepared. The emulsified dispersion of the yellow coupler prepared above was mixed with the aforesaid silver halide emulsion and the gelatin concentration was adjusted as shown below to provide a coating composition for Layer 1.

The coating compositions for Layers 2 to 7 were prepared in a similar manner with the substitution shown below.

In addition, 100 mg/m$^2$ of 1-oxy-3,5-dichloro-s-triazine sodium salt was used for each layer as a gelatin hardening agent.

The following spectral sensitizers were used for the emulsion layers:

Blue spectral sensitizing dye

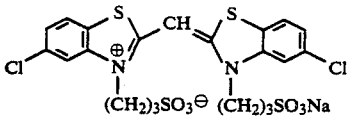

($5.0\times10^{-4}$ mol per mol of silver halide)

Green spectral sensitizing dye

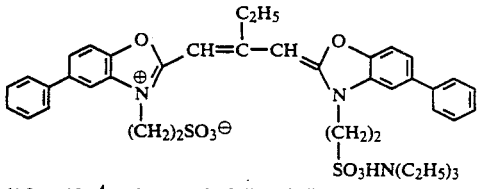

($4.0\times10^{-4}$ mol per mol of silver halide)

Green Spectral Sensitizing Dye

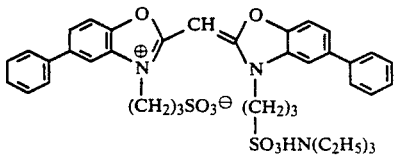

($7.0\times10^{-4}$ mol per mol of silver halide)

Red Spectral Sensitizing Dye

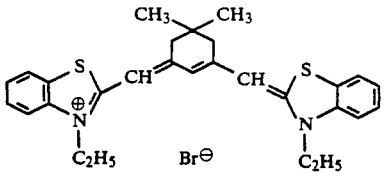

($1.0\times10^{-4}$ mol per mol of silver halide)

Also, the following dyes was used for the green-sensitive emulsion layer and the red-sensitive emulsion layer as irradiation preventing dyes.

In the Green-Sensitive Emulsion Layer

D-I (10 mg/m$^2$)

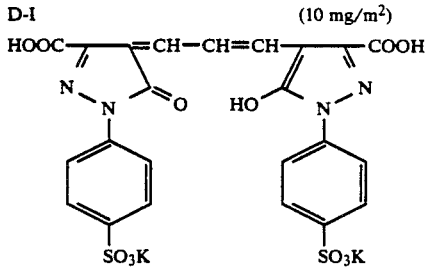

In the Red-Sensitive Emulsion Layer

D-II (5 mg/m$^2$)

-continued

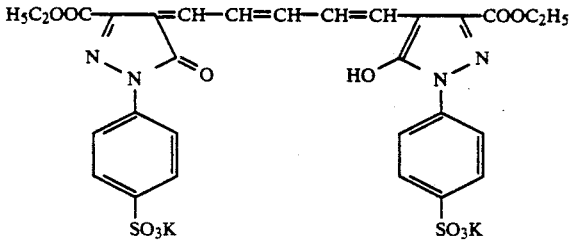

Layer Structure

| | |
|---|---|
| Layer 1: Blue-Sensitive Emulsion Layer: | |
| Silver Chlorobromide Emulsion (silver bromide 1 mol %) | 0.30 g/m$^2$ as silver |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.34 ml/m$^2$ |
| Layer 2: Color mixing Preventing Layer: | |
| Gelatin | 0.99 g/m$^2$ |
| Color mixing Preventing Agent (d) | 0.08 g/m$^2$ |
| Layer 3: Green-Sensitive Emulsion Layer: | |
| Silver Chlorobromide Emulsion (silver bromide 0.5 mol %) | 0.16 g/m$^2$ as silver |

-continued

| | |
|---|---|
| Gelatin | 1.80 g/m$^2$ |
| Magenta Coupler (e) | 0.48 g/m$^2$ |
| Color Image Stabilizer (f) | 0.20 g/m$^2$ |
| Solvent (g) | 0.68 ml/m$^2$ |
| Layer 4: Ultraviolet Absorbing Layer: | |
| Gelatin | 1.60 g/m$^2$ |
| Ultraviolet Absorbent (h) | 0.62 g/m$^2$ |
| Color Mixing Preventing agent (i) | 0.05 g/m$^2$ |
| Solvent (j) | 0.26 ml/m$^2$ |
| Layer 5: Red-Sensitive Emulsion Layer: | |
| Silver Chlorobromide Emulsion (silver bromide 0.5 mol %) | 0.26 g/m$^2$ as silver |
| Gelatin | 0.98 g/m$^2$ |
| Cyan Coupler (k) | 0.38 g/m$^2$ |
| Color Image Stabilizer (l) | 0.17 g/m$^2$ |
| Solvent (m) | 0.23 ml/m$^2$ |
| Layer 6: Ultraviolet Absorptive Layer: | |
| Gelatin | 0.54 g/m$^2$ |
| Ultraviolet Absorbent (h) | 0.21 g/m$^2$ |
| Solvent (j) | 0.09 ml/m$^2$ |
| Layer 7: Protective Layer: | |
| Gelatin | 1.33 g/m$^2$ |
| Acryl-Modified Copolymer of Polyvinyl Alcohol (degree of modification 17%) | 0.17 g/m$^2$ |

The compounds used for the aforesaid layers were as follows.

(a) Yellow Coupler

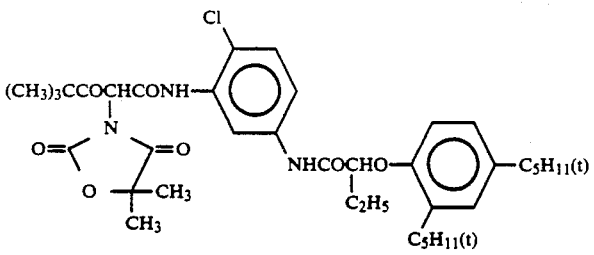

(b) Color Image Stabilizer

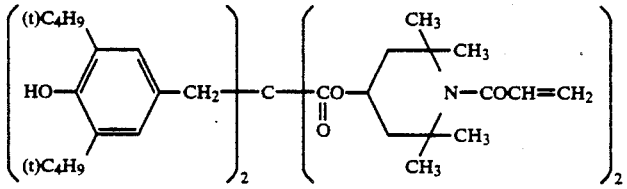

(c) Solvent

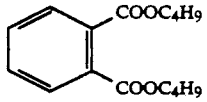

(d) Color Mixing Preventing Agent

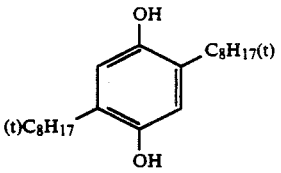

(e) Magenta Coupler

-continued
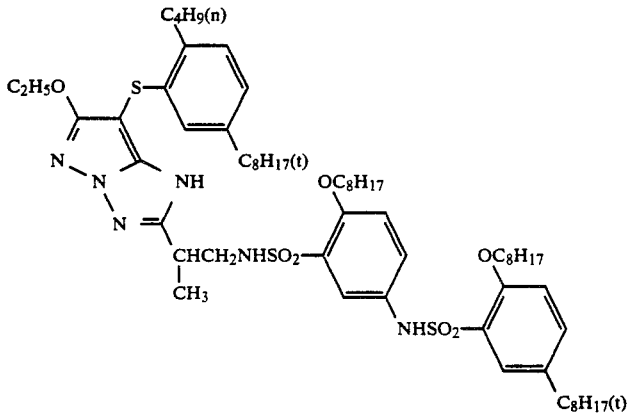
(f) Color Image Stabilizer
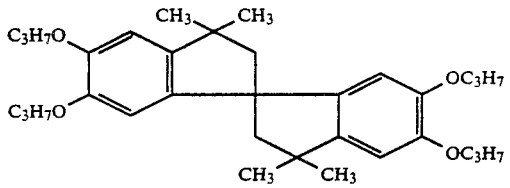
(g) Solvent
$(C_8H_{17}O)_3-P=O$ and ( 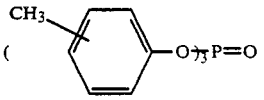
2:1 Mixture (by weight)
(h) Ultraviolet Absorbent
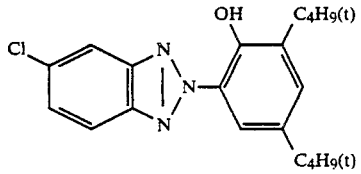
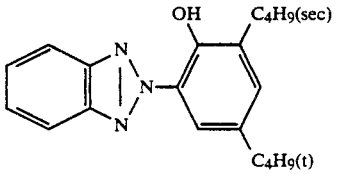
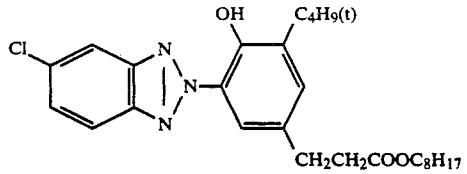
1:5:3 Mixture (by mole)
(i) Color Mixing Preventing Agent
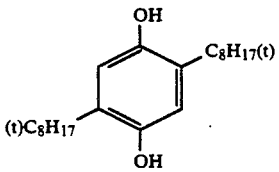
(j) Solvent
(iso $C_9H_{19}O)_3P=O$
(k) Cyan Coupler
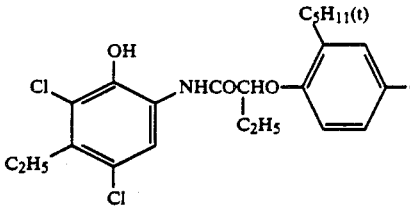
and -continued

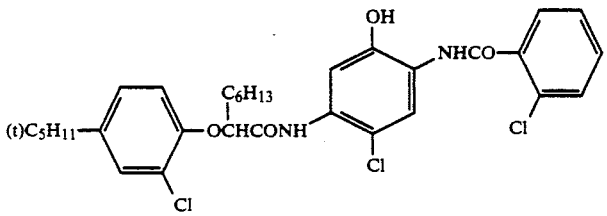

1:1 Mixture (by mole)

(l) Color Image Stabilizer

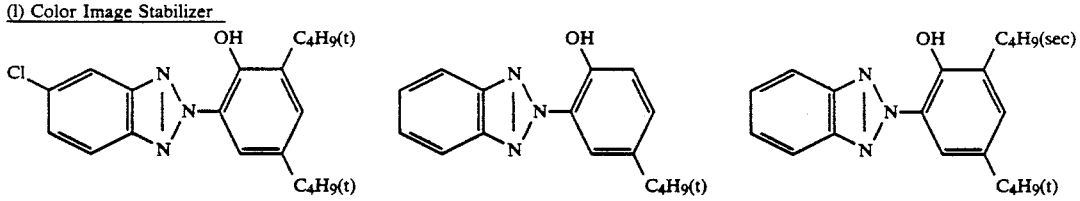

1:3:3 Mixture (by mole)

(m) Solvent

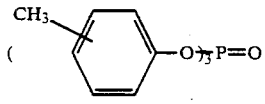

The color photographic paper thus prepared was processed by the following processing steps wherein the composition of the color developer was varied as shown in Table 1 below.

| Processing Step | Temperature | Time |
|---|---|---|
| Color Development | 35° C. | 45 sec. |
| Blix | 35° C. | 45 sec. |
| Rinse 1 | 35° C. | 20 sec. |
| Rinse 2 | 35° C. | 20 sec. |
| Rinse 3 | 35° C. | 20 sec. |
| Drying | 80° C. | 60 sec. |

The rinse step employed was 3-tank counter-current wash step from Rinse 1 to Rinse 3. The processing compositions used were as follows.

| | |
|---|---|
| Color Developer | |
| Additive | Shown in Table 1 |
| Benzyl Alcohol | Shown in Table 1 |
| Diethylene Glycol | Shown in Table 1 |
| Sodium Sulfite | 0.2 g |
| Potassium Carbonate | 30 g |
| EDTA.2Na | 1 g |
| Sodium Chloride | 1.5 g |
| Color Developing Agent (shown in Table 1) | 0.012 mol |
| Whitening Agent (4,4'-diaminostilbene series) | 3.0 g |
| Water to make | 1,000 ml |
| pH | 10.05 |
| Blix Liquid | |
| EDTAFe(III).$NH_4$.$2H_2O$ | 60 g |

-continued

| | |
|---|---|
| EDTA.2Na.$2H_2O$ | 4 g |
| Ammonium Thiosulfate (70%) | 120 ml |
| Sodium Sulfite | 16 g |
| Glacial Acetic Acid | 7 g |
| Water to make | 1000 ml |
| pH | 5.5 |
| EDTA: Ethylenediaminetetraacetic acid. | |
| Rinse Liquid | |
| Formalin (37%) | 0.1 ml |
| 1-Hydroxyethylidene-1,1-diphosphonic Acid (60%) | 1.6 ml |
| Bismuth Chloride | 0.35 g |
| Aqueous Ammonia (26%) | 2.5 ml |
| Nitrilotriacetic Acid.3Na | 1.0 g |
| EDTA.4H | 0.5 g |
| Sodium Sulfite | 1.0 g |
| 5-Chloro-2-methyl-4-isothiazolin-3-one | 50 mg |
| Water to make | 1000 ml |

As the color developer, a developer immediately after preparation (fresh solution) and the same developer after standing for 2 days at 35° C. (aged solution) were used in the processing.

The photographic properties obtained by processing using the fresh liquid and aged liquid are shown in Table 1 below.

The photographic properties are represented values of Dmin, Dmax and the gradation of magenta density.

Dmin is the minimum magenta density Dmax is the maximum magenta density and the gradation is the density change from the exposure producing a density of 0.5 to the density produced by an exposure (Log E) 0.3 higher.

TABLE 1

| No. | Color* Developing Agent | Benzyl Alcohol (ml) | Diethylene Glycol (ml) | Additive (0.04 mol/l) | Fresh Solution Dmin | Fresh Solution Gradation | Fresh Solution Dmax | Aged Solution Dmin | Aged Solution Gradation | Aged Solution Dmax | Remarks |
|---|---|---|---|---|---|---|---|---|---|---|---|
| 1 | D-6 | — | — | Hydroxylamine sulfate | 0.13 | 0.52 | 1.95 | 0.20 | 0.67 | 2.21 | Comparison |
| 2 | D-6 | 15 | 10 | Hydroxylamine sulfate | 0.14 | 0.73 | 2.03 | 0.21 | 0.90 | 2.31 | Comparison |
| 3 | D-6 | — | — | $NH_2NHCONHNH_2$ | 0.13 | 0.73 | 1.99 | 0.16 | 0.77 | 2.25 | This invention |
| 4 | D-6 | — | — | NHNHCONHNH | 0.12 | 0.72 | 2.05 | 0.15 | 0.76 | 2.30 | This invention |
| 5 | D-1 | — | — | Hydrazide** I-1 | 0.13 | 0.72 | 2.27 | 0.17 | 0.77 | 2.32 | This invention |

TABLE 1-continued

| No. | Color* Developing Agent | Benzyl Alcohol (ml) | Diethylene Glycol (ml) | Additive (0.04 mol/l) | Fresh Solution Dmin | Fresh Solution Gradation | Fresh Solution Dmax | Aged Solution Dmin | Aged Solution Gradation | Aged Solution Dmax | Remarks |
|---|---|---|---|---|---|---|---|---|---|---|---|
| 6 | D-2 | — | — | Hydrazide** I-1 | 0.13 | 0.72 | 2.30 | 0.17 | 0.78 | 2.33 | This invention |
| 7 | D-5 | — | — | Hydrazide** I-1 | 0.13 | 0.77 | 2.29 | 0.15 | 0.80 | 2.32 | This invention |
| 8 | D-6 | — | — | Hydrazide** I-1 | 0.13 | 0.73 | 2.29 | 0.15 | 0.76 | 2.30 | This invention |
| 9 | D-6 | 15 | 10 | Hydrazide** I-1 | 0.13 | 0.75 | 2.31 | 0.17 | 0.79 | 2.33 | This invention |
| 10 | D-1 | — | — | Hydrazide** I-29 | 0.13 | 0.73 | 2.25 | 0.16 | 0.77 | 2.30 | This invention |
| 11 | D-2 | — | — | Hydrazide** I-29 | 0.13 | 0.73 | 2.31 | 0.16 | 0.77 | 2.33 | This invention |
| 12 | D-5 | — | — | Hydrazide** I-29 | 0.13 | 0.77 | 2.31 | 0.15 | 0.79 | 2.34 | This invention |
| 13 | D-6 | — | — | Hydrazide** I-29 | 0.13 | 0.74 | 2.29 | 0.14 | 0.76 | 2.30 | This invention |
| 14 | D-6 | 15 | 10 | Hydrazide** I-29 | 0.13 | 0.76 | 2.30 | 0.16 | 0.80 | 2.32 | This invention |
| 15 | D-5 | — | — | Hydrazide** I-31 | 0.13 | 0.76 | 2.30 | 0.15 | 0.77 | 2.32 | This invention |
| 16 | D-6 | — | — | Hydrazide** I-31 | 0.13 | 0.73 | 2.27 | 0.15 | 0.74 | 2.30 | This invention |
| 17 | D-5 | — | — | Hydrazide** I-41 | 0.13 | 0.77 | 2.31 | 0.14 | 0.79 | 2.33 | This invention |
| 18 | D-6 | — | — | Hydrazide** I-41 | 0.13 | 0.74 | 2.28 | 0.15 | 0.76 | 2.30 | This invention |

*As set forth below.
**As set forth above in the Detailed Description.

*D-1

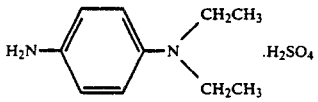

D-2

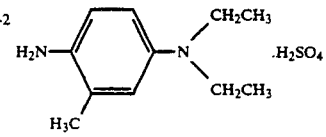

D-5

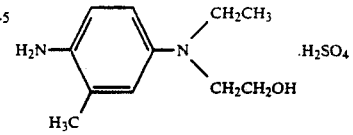

D-6

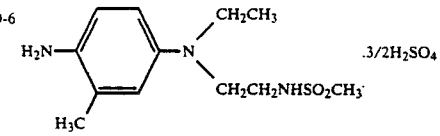

From the results shown in Table 1 above, it can be seen that when adding hydroxylamine to the color developer, the formation of fog (increase in Dmin) increased and the change of gradation was large in the processing using the aged solution. In the case of carbohydrazide, the change of Dmax was large to cause disadvantageous results.

On the other hand, it can be seen that when processing by the process of this invention, the formation of fog was reduced and the change of gradation was lower than when processing using the aged solution. The effect is especially remarkable when processing is conducted using the developer containing no benzyl alcohol.

EXAMPLE 2

By following the same procedure as in Example 1 except for changing the content of silver bromide in the green-sensitive emulsion layer to 80 mol%, the change of photographic properties when using the aged solution was evaluated. When using the process of this invention, good results with reduced fogging were also obtained.

EXAMPLE 3

By following the same procedures as in Example 1 except for standing for 14 days at 40° C. (aged solution) instead of standing for 21 days at 35° C. and using additives shown in Table 2, the results shown in Table 2 were obtained.

TABLE 2

| No. | Color Developing Agent | Benzyl Alcohol (ml) | Diethylene Glycol (ml) | Additive (0.04 mol/l) | Fresh Solution Dmin | Fresh Solution Gradation | Aged Solution Dmin | Aged Solution Gradation | Remarks |
|---|---|---|---|---|---|---|---|---|---|
| 1 | D-6 | — | — | Hydroxylamine | 0.13 | 0.52 | 0.21 | 0.65 | Comparison |
| 2 | D-6 | 15 | 10 | Hydroxylamine | 0.14 | 0.73 | 0.22 | 0.89 | Comparison |
| 3 | D-5 | 15 | 10 | II - 1 | 0.14 | 0.75 | 0.16 | 0.80 | This invention |
| 4 | D-6 | 15 | 10 | II - 1 | 0.14 | 0.75 | 0.16 | 0.80 | This invention |
| 5 | D-1 | — | — | II - 1 | 0.13 | 0.74 | 0.13 | 0.77 | This invention |
| 6 | D-2 | — | — | II - 1 | 0.13 | 0.73 | 0.14 | 0.76 | This invention |
| 7 | D-5 | — | — | II - 1 | 0.13 | 0.77 | 0.13 | 0.78 | This invention |
| 8 | D-6 | — | — | II - 1 | 0.13 | 0.73 | 0.14 | 0.76 | This invention |
| 9 | D-6 | — | — | II - 2 | 0.12 | 0.72 | 0.13 | 0.75 | This invention |
| 10 | D-6 | — | — | II - 5 | 0.13 | 0.72 | 0.13 | 0.74 | This invention |
| 11 | D-6 | — | — | II - 7 | 0.12 | 0.72 | 0.13 | 0.75 | This invention |
| 12 | D-6 | — | — | II - 10 | 0.12 | 0.72 | 0.12 | 0.74 | This invention |
| 13 | D-6 | — | — | II - 15 | 0.12 | 0.72 | 0.13 | 0.74 | This invention |

From the results shown in Table 2 above, it can be seen that when adding hydroxylamine to the color developer, the formation of fog (increase in Dmin) increased and the change of gradation was large in the processing using the aged solution.

On the other hand, it can be seen that the processing by the process of this invention, the formation of fog was reduced and the change of gradation was lower than when processing using the aged solution. The effect is remarkable when processing is conducted using the developer containing no benzyl alcohol.

EXAMPLE 4

By following the same procedure as in Example 1 except for changing the content of silver bromide in the green-sensitive emulsion layer to 80 mol%, the change of photographic properties when using the aged solution was evaluated. When using the process of this invention, good results with reduced fogging were also obtained.

EXAMPLE 5

A multilayer color photographic paper was prepared having Layer 1 (lowermost layer) to Layer 7 (uppermost layer) on a paper support, both surfaces of which were subjected to corona discharge treatment and coated with polyethylene.

The coating composition for Layer 1 was prepared as follows.

A mixture of 200 g of a yellow coupler shown below, 93.3 g of a fading preventing agent shown below, 10 g of high-boiling solvent (p), 5 g of high-boiling solvent (g) shown below, and 600 ml of ethyl acetate as an auxiliary solvent was heated to 60° C. to dissolve the components, mixed with 3,300 ml of an aqueous 5% gelatin solution containing 330 ml of an aqueous solution of 5% Alkanol B (alkylnaphthalene sulfonate, trade name, made by Du Pont), and the resultant mixture was emulsified using a colloid mill to provide a coupler dispersion. Ethyl acetate was distilled off under reduced pressure from the dispersion, the residue thus formed was added to 1400 g of a silver halide emulsion (containing 96.7 g of silver halide as Ag and 170 g of gelatin), 1-methyl-2-mercapto-5-acetylamino-1,3,4-triazole and sensitizing dye for a blue-sensitive emulsion layer, shown below were acided, and than 2600 g of an aqueous 10% gelatin solution was added thereto to provide the coating composition for Layer 1.

Coating compositions for Layer 2 to Layer 7 were also prepared in the same manner with the substitutions shown below.

The following sensitizing dyes were used for the emulsion layers.

For the Blue-Sensitive Emulsion Layer:

Anhydro-5-methoxy-5'methyl-3,3'-disulfopropylselenacyanine hydroxide.

For the Green-Sensitive Emulsion Layer:

Anhydro-9-ethyl-5,5'-diphenyl-3,3'-disulfoethyloxacarbocyanine hydroxide.

For the Red-Sensitive Emulsion Layer:

3,3'-Diethyl-5-methoxy-9,9'-(2,2-dimethyl-1,3-propano)thiadicarbocyanine iodide.

Also, 1-methyl-2-mercapto-5-acetylamino-1,3,4-triazole was used as a stabilizer for each emulsion layer.

Furthermore, the following dyes were used in the emulsion layers as irradiation preventing dyes.

For the Green-Sensitive Emulsion Layer:

4-(3-Carboxy-5-hydroxy-4-(3-(3-carboxy-5-oxo-1-(4-sulfonaphthphenyl)-2-pyrazoline-4-iridene)-1-propenyl)-1-pyrazolyl)benzenesulfonate di-potassium salt.

For the Red-Sensitive Emulsion Layer:

N,N'-(4,8-Dihydroxy-9,10-dioxo-3,7-disulfonathoanthracene-1,5-diyl)bis(aminomethanesulfonate) tetrasodium salt.

Also, 10 mg/m$^2$ of 1,2-bis(vinylsulfonyl)ethane was used in each layer as a gelatin hardening agent. The layer structure was as follows.

| | |
|---|---|
| Layer 1: Blue-Sensitive Emulsion Layer: | |
| Silver Chlorobromide emulsion (silver bromide 1 mol %) | 290 mg/m$^2$ |
| Yellow Coupler | 600 mg/m$^2$ |
| Fading Preventing Agent (r) | 280 mg/m$^2$ |
| Solvent (p) | 30 mg/m$^2$ |
| Solvent (q) | 15 mg/m$^2$ |
| Gelatin | 1800 mg/m$^2$ |
| Layer 2: Color Mixing Preventing Layer: | |
| Silver Bromide Emulsion (primitive, grain size 0.05 μm) | 10 mg/m$^2$ as silver |
| Color Mixing Preventing Agent (s) | 55 mg/m$^2$ |
| Solvent (p) | 30 mg/m$^2$ |
| Solvent (q) | 15 mg/m$^2$ |
| Gelatin | 800 mg/m$^2$ |
| Layer 3: Green-Sensitive Emulsion Layer: | |
| Silver Chlorobromide Emulsion (silver bromide 0.5 mol %) | 305 mg/m$^2$ |
| Magenta Coupler | 670 mg/m$^2$ |
| Fading Preventing Agent (t) | 150 mg/m$^2$ |
| Fading Preventing Agent (u) | 10 mg/m$^2$ |
| Solvent (p) | 200 mg/m$^2$ |
| Solvent (q) | 10 mg/m$^2$ |
| Gelatin | 1400 mg/m$^2$ |
| Layer 4: Color Mixing Preventing Layer: | |
| Color Mixing Preventing Agent (s) | 65 mg/m$^2$ |
| Ultraviolet Absorbent (n) | 450 mg/m$^2$ |
| Ultraviolet Absorbent (o) | 230 mg/m$^2$ |
| Solvent (p) | 50 mg/m$^2$ |
| Solvent (q) | 50 mg/m$^2$ |
| Gelatin | 1700 mg/m$^2$ |
| Layer 5: Red-Sensitive Emulsion Layer: | |
| Silver Chlorobromide Emulsion (silver bromide 1 mol %) | 210 mg/m$^2$ |
| Cyan Coupler (shown in Table 3) | 0.5 mol/m$^2$ |
| Fading Preventing Agent (r) | 250 mg/m$^2$ |
| Solvent (p) | 160 mg/m$^2$ |
| Solvent (q) | 100 mg/m$^2$ |
| Gelatin | 1800 mg/m$^2$ |
| Layer 6: Ultraviolet Absorbing Layer: | |
| Ultraviolet Absorbent (n) | 260 mg/m$^2$ |
| Ultraviolet Absorbent (o) | 70 mg/m$^2$ |
| Solvent (p) | 300 mg/m$^2$ |
| Solvent (q) | 100 mg/m$^2$ |
| Gelatin | 700 mg/m$^2$ |
| Layer 7: Protective Layer: | |
| Gelatin | 600 mg/m$^2$ |

The couplers and compounds used for layers were as follows:

Yellow Coupler

-continued

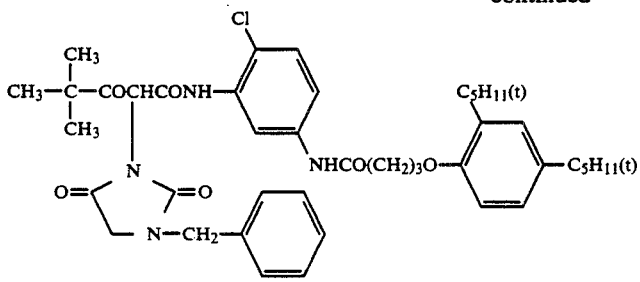

Magenta Coupler

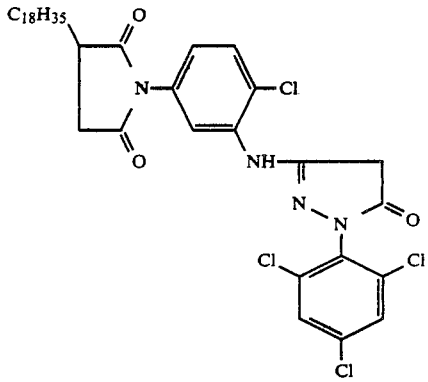

Ultraviolet Absorbent (n):
2-(2-Hydroxy-3,5-di-tert-amylphenyl)benzotriazole.
Ultraviolet Absorbent (o):
2-(2-Hydroxy-3,5-di-tert-butylphenyl)benzotriazole.
Solvent (p):
Di(2-ethylhexyl) phthalate.
Solvent (q):
Ditbutyl phthalate.
Fading Preventing Agent (r):
2,5-Di-tert-amylphenyl-3.5-di-tert-butylhydroxy benzoate.
Color Mixing Preventing Agent (s):
2,5-Di-tert-octylhydroquinone.
Fading Preventing Agent:(t)
1,4-Di-tert-amyl-2,5-dioctyloxybenzene.
Fading Preventing Agent (u):
2,2'-Methylenebis-(4-methyl-6-tert-butyl)phenol.

The multilayer color photographic paper thus obtained was, after wedge exposure, processed by the following processing steps:

| Processing Step | Temperature | Time |
|---|---|---|
| Color Development | 33° C. | 3 min. 30 sec. |
| Blix | 33° C. | 1 min. 30 sec. |
| Rinse (3-tank cascade) | 30° C. | 2 min. |
| Drying | 80° C. | 1 min. |

The processing compositions used in the processing steps were as follows.

| Color Developer | |
|---|---|
| Water | 800 ml |
| Triethanolamine | 10 ml |
| Sodium 5,6-dihydroxy-1,2,4-benzene-trisulfonate | 300 mg |
| N,N'-Bis(2-hydroxybenzyl)ethylene-diamine-N,N'-diacetic acid | 0.1 g |
| Nitrilo-N,N,N-trimethylenephosphonic Acid (40%) | 1.0 g |
| Potassium Bromide | 0.6 g |
| Additive | Shown in Table 3 |
| Sodium Sulfite | Shown in Table 3 |
| Potassium Carbonate | 30 g |
| N-Ethyl-N-(β-methanesulfonamidoethyl)-3-methyl-4-aminoaniline Sulfate | 5.5 g |
| Optical Whitening Agent (4,4'-diaminostilbene series) | 1.0 g |
| Water to make | 1000 ml |
| pH adjusted with potassium hydroxide to | 10.10 |
| **Blix Liquid** | |
| Ammonium Thiosulfate (70%) | 150 ml |
| Sodium Sulfite | 15 g |
| Ethylenediamine Iron(III) Ammonium Salt | 60 g |
| Ethylenediaminetetraacetic Acid | 10 g |
| Optical Whitening Agent (4,4'-diaminostilbene series) | 1.0 g |
| 2-Mercapto-5-amino-3,4-thiadiazole | 1.0 g |
| Water to make | 1000 ml |
| pH adjusted with aqueous ammonia to | 7.0 |
| **Rinse Liquid** | |
| 5-Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| Bismuth Chloride (40%) | 0.5 g |
| Nitrilo-N,N,N-trimethylenephosphonic Acid (40%) | 1.0 g |
| 1-Hydroxyethylidene-1,1-diphosphonic Acid (60%) | 2.5 g |
| Fluorescent Brightening Agent (4,4'-diaminostilbene series) | 1.0 g |
| Aqueous Ammonia (26%) | 2.0 ml |
| Water to make | 1000 ml |
| pH adjusted with potassium hydroxide to | 7.5 |

As the color developer, a developer immediately after preparation (fresh solution) and the developer after standing for one month at 38° C. (aged solution) were used.

Dmin and Dmax of cyan dye and the gradations of the cyan dye image formed by processing using the fresh solution and the aged solution were measured.

The results obtained using the aged solution and the results obtained using the fresh solution are compared in Table 3 below.

TABLE 3

| No. | Cyan Coupler* | Sodium Sulfate (g/l) | Additive (0.03 mol/l) | Change of Photographic Properties Dmin | Gradation | Dmax | Remarks |
|---|---|---|---|---|---|---|---|
| 19 | C-9 | 1.8 | Hydroxylamine Sulfate | +0.05 | +0.10 | +0.29 | Comparison |
| 20 | C-1 | 1.8 | Hydroxylamine Sulfate | +0.06 | +0.10 | +0.27 | Comparison |
| 21 | C-38 | — | Hydroxylamine Sulfate | +0.07 | +0.07 | +0.19 | Comparison |
| 22 | C-38 | — | $N_2NNHCONHNH_2$ | 0 | +0.01 | +0.21 | Present Invention |
| 23 | A*** | 1.8 | Hydrazide** I-29 | +0.03 | +0.06 | +0.13 | Present Invention |
| 24 | B*** | 1.8 | Hydrazide** I-29 | +0.03 | +0.06 | +0.14 | Present Invention |
| 25 | C-5 | 1.8 | Hydrazide** I-29 | +0.02 | +0.04 | +0.14 | Present Invention |
| 26 | C-38 | 1.8 | Hydrazide** I-29 | +0.02 | +0.04 | +0.15 | Present Invention |
| 27 | A*** | 0.2 | Hydrazide** I-29 | +0.02 | +0.04 | +0.07 | Present Invention |
| 28 | B*** | 0.2 | Hydrazide** I-29 | +0.02 | +0.04 | +0.08 | Present Invention |
| 29 | C-5 | 0.2 | Hydrazide** I-29 | +0.01 | +0.02 | +0.03 | Present Invention |
| 30 | C-38 | 0.2 | Hydrazide** I-29 | +0.01 | +0.02 | +0.03 | Present Invention |
| 31 | A*** | — | Hydrazide** I-29 | +0.01 | +0.03 | +0.06 | Present Invention |
| 32 | B*** | — | Hydrazide** I-29 | +0.01 | +0.03 | +0.07 | Present Invention |
| 33 | C-5 | — | Hydrazide** I-29 | 0 | +0.01 | +0.02 | Present Invention |
| 34 | C-38 | — | Hydrazide** I-29 | 0 | +0.01 | +0.03 | Present Invention |
| 35 | C-38 | — | Hydrazide** I-6 | 0 | +0.01 | +0.04 | Present Invention |
| 36 | C-38 | — | Hydrazide** I-31 | 0 | +0.01 | +0.03 | |
| 37 | C-38 | — | Hydrazide** I-44 | 0 | +0.01 | +0.03 | |

*As set forth above in the Detailed Description
**As set forth above in the Detailed Description
***As set forth below Cyan Coupler A

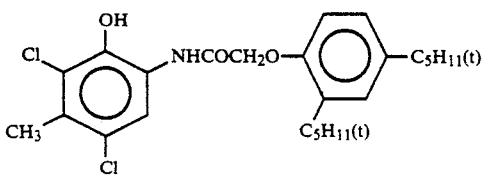

Cyan Coupler B

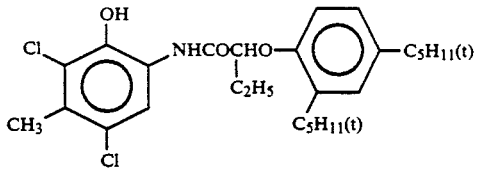

From the results shown in Table 3, it can be seen that using the process of this invention, the increase of fog, Dmax and the change of gradation were both reduced even when using the aged solution. Also, this effect was more remarkable when the concentration of sulfite ion in the processing solution (color developer) was low.

On the other hand, when processing with the color developer containing hydroxylamine, the increase of fog and the change in gradation were both large due to the deterioration of the color developer with the passage of time.

Also, when color photographic materials containing cyan couplers represented by formulae (C-I) or (C-II) described above were processed by the process of this invention, the increase of fog and the change in gradation when processing with the aged color developer solution were lower than when processing color photographic materials containing other cyan couplers than those represented by formulae (C-I) or (C-II) according to the process of this invention. Furthermore, this effect was more remarkable when the concentration of sulfite ion in the color developer was low.

EXAMPLE 6

A color photographic paper prepared in the same manner as in Example 1 was subjected to a running test by the following processing steps until the amount of the replenisher for the color developer reached 3 times the volume of the developer tank (60 liters). In this Example, however, the composition of the color developer was changed as shown in Table 3 below.

| Processing Step | Temp. | Time | Replenisher Amount |
|---|---|---|---|
| Color Development | 35° C. | 45 sec. | 160 ml/m$^2$ |
| Blix | 35° C. | 45 sec. | 100 ml/m$^2$ |
| Rinse (1) | 30° C. | 20 sec. | — |
| Rinse (2) | 30° C. | 20 sec. | — |
| Rinse (3) | 30° C. | 20 sec. | 200 ml/m$^2$ |
| Drying | 60–70° C. | 30 sec. | |

In the rinse step, a 3-tank counter-current system from Rinse (1) to Rinse (3) was employed.

The compositions of the processing liquids used were as follows:

| Color Developer | Tank Liquid | Replenisher |
|---|---|---|
| Triethanolamine | 8.0 g | 10.0 g |
| Additive | Shown in Table 3 | |
| Optical Whitening Agent (4,4'-diaminostilbene series) | 3.0 g | 4.0 g |
| Ethylenediaminetetraacetic Acid | 1.0 g | 1.5 g |
| Potassium Carbonate | 30.0 g | 30.0 g |
| Sodium Chloride | 1.4 g | 0.1 g |
| 4-Amino-3-methyl-N-ethyl-N-(β-(methanesulfonamido)ethyl)-aniline Sulfate | 5.0 g | 5.0 g |
| Benzyl Alcohol | Shown in Table 3 | |
| Diethylene Glycol | Shown in Table 3 | |
| 5-Methyl-7-hydroxy-3,4-tri-azaindorizine | 30 mg | — |
| Water to make | 1000 ml | 1000 ml |
| pH | 10.10 | 10.10 |
| Blix Liquid (Replenisher was same as the tank liquid) | | |
| EDTAFe(III).$NH_4$.2$H_2O$ | 60 g | |
| EDTA.2Na.2$H_2O$ | 4 g | |
| Sodium Thiosulfate (70%) | 120 ml | |
| Sodium Sulfite | 16 g | |
| Glacial Acetic Acid | 7 g | |

-continued

| | |
|---|---|
| Water to make | 1000 ml |
| pH | 5.5 |
| Rinse (Replenisher was same as the tank liquid) | |
| EDTA.2Na.2$H_2O$ | 0.4 g |
| Water to make | 1000 ml |
| pH | 7.0 |

In the aforesaid processing, the densities of blue (B), green (G), and red (R) of the unexposed portions of photographic materials were measured at the start of the running test and at the end of the running test using the using densitometer made by Fuji Photo Film Co., Ltd. Furthermore, the samples from the end of the running test period were allowed to stand for 2 months at 60° C. and 70% RH, and thereafter, the densities of B, G, and R in the unexposed portions were measured again.

The results obtained are shown in Table 4 below.

TABLE 4

| | Tank Liquid | | Replenisher | | | Dmin Increased Amount* (End of Running) | | | Dmin Increased Amount* (60° C., 70% RH, After 2 months) | | | |
|---|---|---|---|---|---|---|---|---|---|---|---|---|
| No. | Benzyl Alcohol (ml) | Diethylene Glycol (ml) | Benzyl Alcohol (ml) | Diethylene Glycol (ml) | Additive (0.04 mol/l) | B | G | R | B | G | R | Remarks |
| 38 | — | — | — | — | Hydroxylamine | +0.12 | +0.08 | +0.04 | +0.31 | +0.20 | +0.11 | Comparison |
| 39 | 15 | 10 | 20 | 10 | Hydroxylamine | +0.12 | +0.08 | +0.04 | +0.32 | +0.21 | +0.11 | Comparison |
| 40 | 15 | 10 | 20 | 10 | Hydrazide I-1 | +0.05 | +0.03 | +0.02 | +0.19 | +0.12 | +0.07 | This invention |
| 41 | 15 | 10 | 20 | 10 | Hydrazide I-2 | +0.05 | +0.03 | +0.02 | +0.16 | +0.12 | +0.07 | This invention |
| 42 | — | — | — | — | Hydrazide I-1 | +0.01 | +0.01 | +0.00 | +0.09 | +0.06 | +0.03 | This invention |
| 43 | — | — | — | — | Hydrazide I-2 | +0.00 | +0.01 | +0.00 | +0.08 | +0.06 | +0.03 | This invention |
| 44 | — | — | — | — | Hydrazide I-7 | +0.00 | +0.00 | +0.00 | +0.08 | +0.06 | +0.02 | This invention |
| 45 | — | — | — | — | Hydrazide I-29 | +0.00 | +0.00 | +0.00 | +0.07 | +0.05 | +0.02 | This invention |
| 46 | — | — | — | — | Hydrazide I-31 | +0.01 | +0.00 | +0.00 | +0.07 | +0.05 | +0.03 | This invention |

*Increase over Dmin at running start.

From the results shown in Table 4 above, it can be seen that when adding hydroxylamine to the color developer, the increase of fog after running was large, while in the case of using the process of this invention, the increase of fog after running was lower and also the increase of staining of the color images This effect of this invention was particularly remarkable when using the color developer containing no benzyl alcohol.

EXAMPLE 7

By following the same procedures as in Example 5 except for using additives shown in Table 5, the results shown in Table 5 were obtained.

TABLE 5

| No. | Cyan Coupler | Sodium Sulfite (g/l) | Additive (0.03 mol/l) | Change of Photographic Properties Dmin | Gradation | Remarks |
|---|---|---|---|---|---|---|
| 14 | C-5 | 1.8 | Hydroxylamine | +0.05 | +0.18 | Comparison |
| 15 | C-38 | 1.8 | Hydroxylamine | +0.06 | +0.15 | Comparison |
| 16 | C-38 | — | Hydroxylamine | +0.07 | +0.11 | Comparison |
| 17 | A* | 1.8 | II - 1 | +0.02 | +0.05 | Present Invention |
| 18 | B* | 1.8 | II - 1 | +0.02 | +0.04 | Present Invention |
| 19 | C-5 | 1.8 | II - 1 | +0.00 | +0.03 | Present Invention |
| 20 | C-38 | 1.8 | II - 1 | +0.00 | +0.03 | Present Invention |
| 21 | A* | 0.2 | II - 1 | +0.01 | +0.01 | Present Invention |
| 22 | B* | 0.2 | II - 1 | +0.02 | +0.02 | Present Invention |
| 23 | C-5 | 0.2 | II - 1 | +0.00 | +0.00 | Present Invention |
| 24 | C-38 | 0.2 | II - 1 | +0.00 | +0.00 | Present Invention |
| 25 | A* | — | II - 1 | +0.02 | +0.00 | Present Invention |
| 26 | B* | — | II - 1 | +0.02 | +0.00 | Present Invention |
| 27 | C-5 | — | II - 1 | +0.00 | +0.00 | Present Invention |
| 28 | C-38 | — | II - 1 | +0.00 | +0.00 | Present Invention |
| 29 | C-38 | — | II - 2 | +0.00 | +0.00 | Present Invention |
| 30 | C-38 | — | II - 7 | +0.00 | +0.00 | Present Invention |
| 31 | C-38 | — | II - 12 | +0.00 | +0.00 | Present Invention |

EXAMPLE 8

By following the same procedures as in Example 6 except for using additives shown in Table 6, the results shown in Table 6 were obtained.

From the results shown in Table 6 above, it can be seen that when adding hydroxylamine to the color developer, the formation of fog increased using the aged solution.

On the other hand, it can be seen that the processing by the process of this invention, the formation of fog was reduced and the stain caused with elapse of time after processing was reduced. The effect is especially remarkable in a case of using a processing solution containing no benzylalcohol.

TABLE 6

| No. | Tank Liquid Benzyl Alcohol (ml) | Tank Liquid Diethylene Glycol (ml) | Replenisher Benzyl Alcohol (ml) | Replenisher Diethylene Glycol (ml) | Additive (0.04 mol/l) | Dmin Increased Amount* (End of Running) B | G | R | Dmin Increased Amount* (60° C., 70% RH, After 2 months) B | G | R | Remarks |
|---|---|---|---|---|---|---|---|---|---|---|---|---|
| 32 | — | — | — | — | Hydroxylamine | +0.12 | +0.08 | +0.04 | +0.31 | +0.20 | +0.11 | Comparison |
| 33 | 15 | 10 | 20 | 10 | Hydroxylamine | +0.12 | +0.08 | +0.04 | +0.32 | +0.21 | +0.11 | Comparison |
| 34 | 15 | 10 | 20 | 10 | II - 1 | +0.05 | +0.03 | +0.01 | +0.16 | +0.09 | +0.05 | Present Invention |
| 35 | 15 | 10 | 20 | 10 | II - 2 | +0.04 | +0.03 | +0.01 | +0.17 | +0.09 | +0.05 | Present Invention |
| 36 | — | — | — | — | II - 1 | +0.01 | +0.00 | +0.00 | +0.11 | +0.04 | +0.03 | Present Invention |
| 37 | — | — | — | — | II - 2 | +0.00 | +0.01 | +0.00 | +0.10 | +0.03 | +0.02 | Present Invention |
| 38 | — | — | — | — | II - 5 | +0.00 | +0.00 | +0.00 | +0.09 | +0.04 | +0.03 | Present Invention |
| 39 | — | — | — | — | II - 13 | +0.01 | +0.00 | +0.00 | +0.10 | +0.04 | +0.03 | Present Invention |
| 40 | — | — | — | — | II - 14 | +0.00 | +0.01 | +0.00 | +0.10 | +0.03 | +0.02 | Present Invention |
| 41 | — | — | — | — | II - 23 | +0.01 | 0 | 0 | +0.11 | +0.05 | +0.03 | Present Invention |
| 42 | — | — | — | — | II - 24 | +0.01 | 0 | 0 | +0.11 | +0.04 | +0.03 | Present Invention |
| 43 | — | — | — | — | II - 25 | +0.01 | 0 | 0 | +0.12 | +0.04 | +0.03 | Present Invention |
| 44 | — | — | — | — | II - 26 | +0.01 | 0 | 0 | +0.10 | +0.05 | +0.02 | Present Invention |

*Increase over Dmin at running start.

EXAMPLE 9

A multilayer photographic paper having a layer structure shown below on a paper support both surfaces of which were coated with polyethylene was prepared. The polyethylene layer of the support on the side to be coated contained titanium dioxide as a white pigment and a bluing dye.

The coating compositions for the layers were prepared as follows.

Preparation of Coating Composition for Layer 1

To 10.2 g of yellow coupler (ExY-1), 9.1 g of yellow coupler (ExY-2), and 4.4 g of dye image stabilizer (Cpd-1) were added 27.2 ml of ethyl acetate and 7.7 ml (8.0 g) of high-boiling solvent (Solv-1) to form a solution. The solution was dispersed by emulsification in 185 ml of a 10% gelatin aqueous solution containing 8 ml of a 10% aqueous solution of sodium dodecylbenzenesulfonate. The resulting dispersion was mixed with emulsions (EM1) and (EM2), and the gelatin concentration of the resulting solution was adjusted so as to have a composition shown below to obtain a coating composition for Layer 1.

The coating compositions for Layers 2 to 7 were prepared in the same manner as described above.

Each of the layers further contained sodium 1-oxy-3,5-dichloro-s-triazine as a gelatin hardening agent. In addition, (Cpd-2) was used as a thickening agent. Amount of silver halide emulsion is represented as an amount of silver.

| Layer Structure | |
|---|---|
| Layer 1 (Blue-Sensitive Layer): | |
| Mono-dispersed silver chlorobromide emulsion (EM1) spectrally sensitized with sensitizing dye (ExS-1) | 0.13 g of Ag/m$^2$ |

-continued

| Layer Structure | |
|---|---|
| Mono-dispersed silver chlorobromide emulsion (EM2) spectrally sensitized with sensitizing dye (ExS-1) | 0.13 g of Ag/m$^2$ |
| Gelatin | 1.86 g/m$^2$ |
| Yellow coupler (ExY-1) | 0.44 g/m$^2$ |
| Yellow coupler (ExY-2) | 0.39 g/m$^2$ |
| Dye image stabilizer (Cpd-1) | 0.19 g/m$^2$ |
| Solvent (Solv-1) | 0.35 g/m$^2$ |
| Layer 2 (Color Mixing Preventing Layer): | |
| Gelatin | 0.99 g/m$^2$ |
| Color mixing preventing agent (Cpd-3) | 0.08 g/m$^2$ |
| Layer 3 (Green-Sensitive Layer): | |
| Mono-dispersed silver chlorobromide emulsion (EM3) spectrally sensitized with sensitizing dyes (ExS-2 & 3) | 0.05 g of Ag/m$^2$ |
| Mono-dispersed silver chlorobromide emulsion (EM3) spectrally sensitized with sensitizing dyes (ExS-2 & 3) | 0.11 g of Ag/m$^2$ |
| Gelatin | 1.80 g/m$^2$ |
| Magenta coupler (ExM-2) | 0.39 g/m$^2$ |
| Dye image stabilizer (Cpd-4) | 0.20 g/m$^2$ |
| Dye image stabilizer (Cpd-5) | 0.02 g/m$^2$ |
| Dye image stabilizer (Cpd-6) | 0.03 g/m$^2$ |
| Solvent (Solv-2) | 0.12 g/m$^2$ |
| Solvent (Sov-3) | 0.25 g/m$^2$ |
| Layer 4 (Ultraviolet Absorbing Layer): | |
| Gelatin | 1.60 g/m$^2$ |
| Ultraviolet absorbent (Cpd-7/Cpd-8/Cpd-9 = 3/2/6 by weight) | 0.70 g/m$^2$ |
| Color mixing preventing agent (Cpd-10) | 0.05 g/m$^2$ |
| Solvent (Solv-4) | 0.27 g/m$^2$ |
| Layer 5 (Red-Sensitive Layer): | |
| Mono-dispersed silver chlorobromide emulsion (EM5) spectrally sensitized with sensitizing dyes (ExS-4 & 5) | 0.07 g of Ag/m$^2$ |
| Mono-dispersed silver chlorobromide emulsion (EM6) spectrally sensitized with sensitizing dyes (ExS-4 & 5) | 0.16 g of Ag/m$^2$ |

-continued

| Layer Structure | |
|---|---|
| Gelatin | 0.92 g/m$^2$ |
| Cyan coupler (ExC-1) | 0.32 g/m$^2$ |
| Dye image stabilizer (Cpd-8/ Cpd-9/Cpd-12 = 3/4/2 by weight) | 0.17 g/m$^2$ |
| Polymer for dispersion (Cpd-11) | 0.28 g/m$^2$ |
| Solvent (Solv-2) | 0.20 g/m$^2$ |
| Layer 6 (Ultraviolet Absorbing Layer): | |
| Gelatin | 0.54 g/m$^2$ |
| Ultraviolet absorbent (Cpd-7/ Cpd-9/Cpd-12 = 1/5/3 by weight) | 0.21 g/m$^2$ |
| Solvent (Solv-2) | 0.08 g/m$^2$ |
| Layer 7 (Protective Layer): | |
| Gelatin | 1.33 g/m$^2$ |
| Acryl-modified copolymer of polyvinyl alcohol (degree of modification: 17%) | 0.17 g/m$^2$ |
| Liquid paraffin | 0.03 g/m$^2$ |

In the sample preparation, (Cpd-13) and (Cpd-14) were used as anti-irradiation dyes. Further, in each of layers, Alkanol XC (produced by E. I. Du Pont), sodium alkylbenzenesulfonate, succinic ester, and Megafacx F-120 (produced by Dai-Nippon Ink K.K.) were used as an emulsifier or a coating aid; and (Cpd-15) and (Cpd-16) were used as a stabilizer for silver halide. The emulsions (EM1) to (EM6) used in the sample preparation are tabulated below.

| Emulsion No. | Grain Size μm | Br Content (mol %) | Coefficient of Variation |
|---|---|---|---|
| EM1 | 1.0 | 80 | 0.08 |
| EM2 | 0.75 | 80 | 0.07 |
| EM3 | 0.5 | 83 | 0.09 |
| EM4 | 0.4 | 83 | 0.10 |
| EM5 | 0.5 | 73 | 0.09 |
| EM6 | 0.4 | 73 | 0.10 |

Compounds used in the sample preparation are shown below.

ExY-1

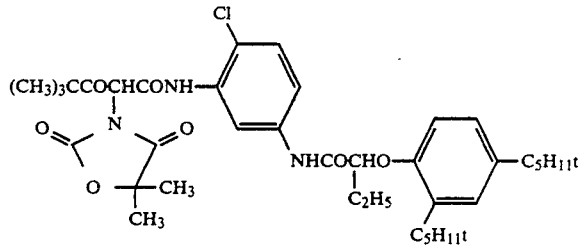

ExY-2

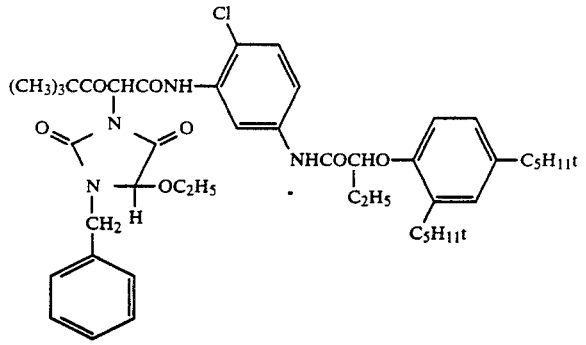

ExM-1

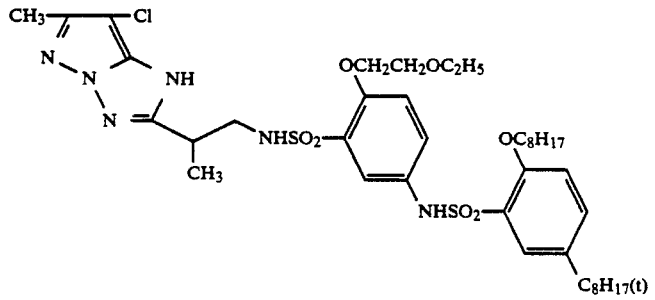

ExC-1

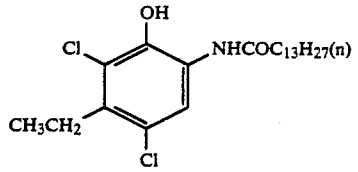

-continued
ExS-1
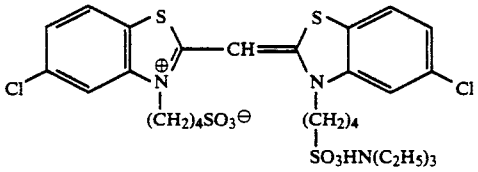
ExS-2
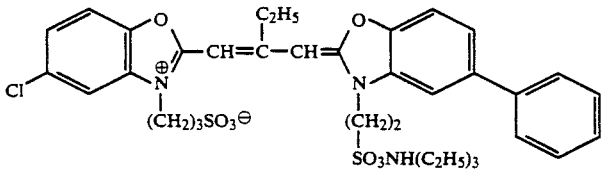
ExS-3
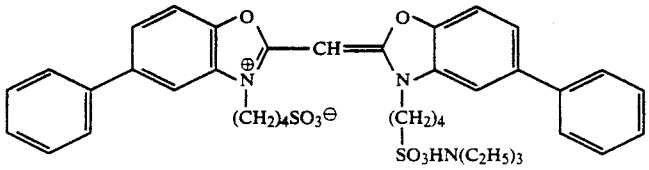
ExS-4
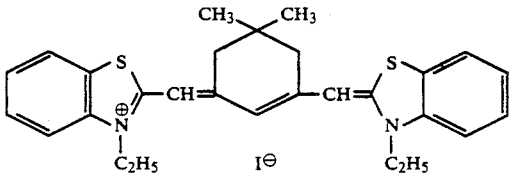
ExS-5
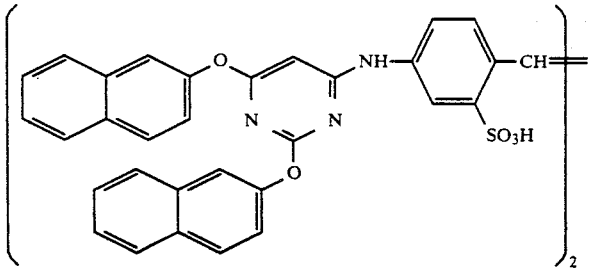
Cpd-1
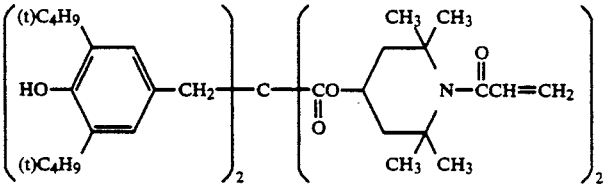
Cpd-2
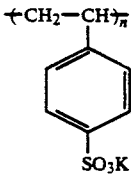
Cpd-3
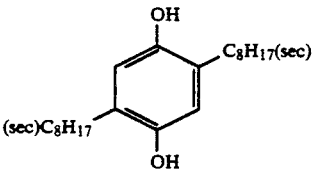

-continued
Cpd-4
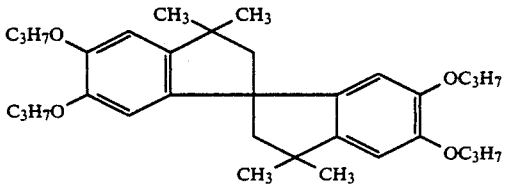
Cpd-5
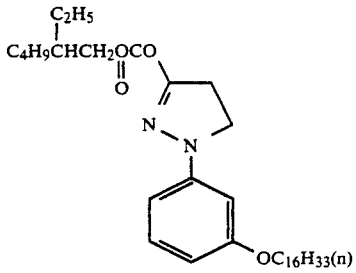
Cpd-6
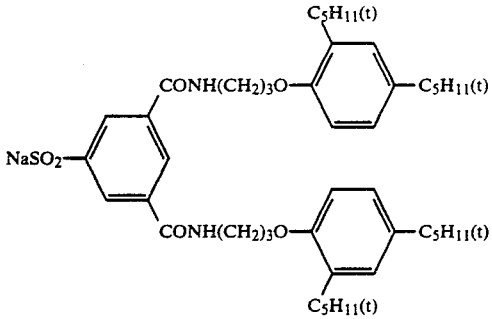
Cpd-7
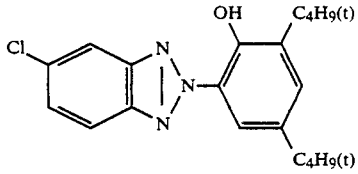
Cpd-8
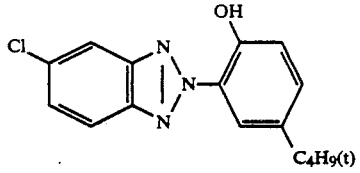
Cpd-9
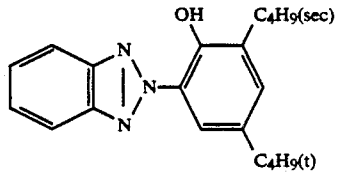
Cpd-10
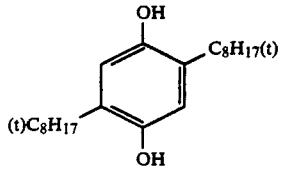
Cpd-11
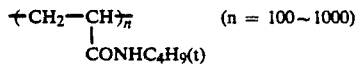

-continued

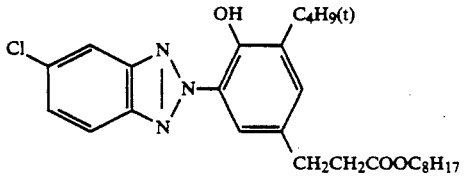

Cpd-12

Dibutylphthalate — Solv-1
Tricresylphosphate — Solv-2
Trioctylphosphate — Solv-3
Trinonylphosphate — Solv-4

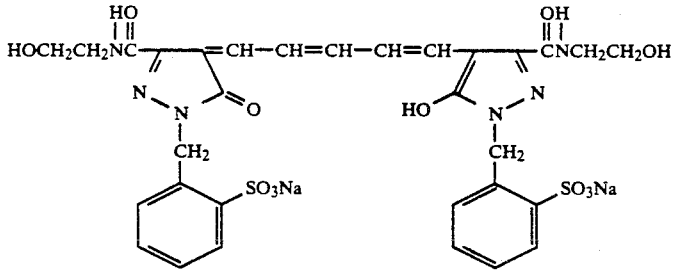

Cpd-13

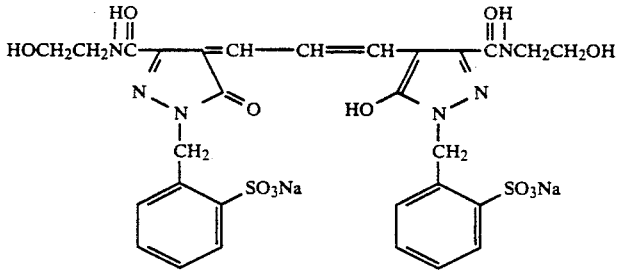

Cpd-14

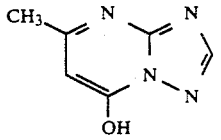

Cpd-15

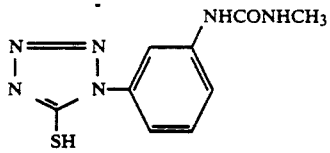

Cpd-16

The thus prepared sample was imagewise exposed to light and continuously development-processed according to the steps shown below, with the composition of the color developer being varied as shown in Table 5, until the amount of the replenisher for the color developer reached twice the volume of the developer tank.

| Processing Step | Temp. | Time | Amount* of Replenisher | Tank Volume |
|---|---|---|---|---|
| Color Development | 38° C. | 1'40" | 290 ml | 17 l |
| Blix | 33° C. | 60" | 150 ml | 9 l |
| Rinse (1) | 30–34° C. | 20" | — | 4 l |
| Rinse (2) | 30–34° C. | 20" | — | 4 l |
| Rinse (3) | 30–34° C. | 20" | 10 l | 4 l |
| Drying | 70–80° C. | 50" | | |

Note: *Per $m^2$ of light-sensitive material

The rinse step was carried out in a counter-current system using three tanks of from (3) to (1).

The processing solutions had the following compositions.

| | Tank Liquid | Replenisher |
|---|---|---|
| Color Developer Composition: | | |
| Water | 800 ml | 800 ml |
| Diethylenetriaminepenta-acetic acid | 1.0 g | 1.0 g |
| Nitrilotriacetic acid | 2.0 g | 2.0 g |
| 1-Hydroxyethylidene-1,1-diphosphonic acid | 2.0 g | 2.0 g |
| Potassium bromide | 0.5 g | — |
| Potassium carbonate | 30 g | 30 g |
| N-Ethyl-N-(β-methanesulfon-amidoethyl)-3-methyl-4-aminoaniline sulfate | 5.5 g | 7.5 g |
| Additive (see Table 7) | $5 \times 10^{-2}$ mol | $7 \times 10^{-2}$ mol |
| Fluorescent brightening agent ("WHITEX 4" produced by Sumitomo Chemical Co., Ltd.) | 1.5 g | 2.0 g |
| Triethylenediamine(1,4-di- | 5.0 g | 5.0 g |

-continued

| | Tank Liquid | Replenisher |
|---|---|---|
| azabicyclo[2,2,2]octane | | |
| Water to make | 1000 ml | 1000 ml |
| pH (25° C.) | 10.20 | 10.60 |
| Blix Bath Composition: | | |
| Water | 400 ml | 400 ml |
| Ammonium thiosulfate (70%) | 200 ml | 300 ml |
| Sodium sulfite | 20 g | 40 g |
| Ammonium (ethylenediamine-tetraacetato)iron (III) | 60 g | 120 g |
| Disodium ethylenediamine-tetraacetate | 5 g | 10 g |
| Water to make | 1000 ml | 1000 ml |
| pH (25° C.) | 6.70 | 6.30 |

Wash Water (Replenisher was same as the tank liquid)
Ion exchanged water (containing each 3 ppm or less of Ca ions and Mg ions)

at 60° C. and 70% RH for 2 months were measured. The change in the minimum density is shown in Table 7.

It can be seen that the photographic papers according to the present invention (Sample Nos. 49 to 55) not only have low minimum densities immediately after processing but undergo only a small increase in stain due to aging.

EXAMPLE 10

By following the same procedures as in Example 9 except for using additives shown in Table 8, and standing for two months at 60° C. and 70%RH after processing to measure Dmin, the results shown in Table 8 were obtained.

TABLE 8

| No. | Additive | | Dmin B | Dmin G | Dmin R | Dmin (with elapse of time) B | Dmin (with elapse of time) G | Dmin (with elapse of time) R |
|---|---|---|---|---|---|---|---|---|
| 45 | Hydroxyl Amine | Comparison | +0.04 | +0.02 | +0.01 | +0.25 | +0.15 | +0.10 |
| 46 | N,N-diethylhyroxyl-amine | " | +0.04 | +0.02 | +0.01 | +0.25 | +0.14 | +0.09 |
| 47 | II - 1 | Present Invention | +0.01 | 0 | 0 | +0.10 | +0.05 | +0.03 |
| 48 | II - 23 | Present Invention | +0.01 | 0 | 0 | +0.11 | +0.06 | +0.03 |
| 49 | II - 24 | Present Invention | +0.01 | 0 | 0 | +0.11 | +0.06 | +0.04 |
| 50 | II - 25 | Present Invention | +0.02 | 0 | 0 | +0.13 | +0.07 | +0.04 |
| 51 | II - 26 | Present Invention | +0.02 | +0.01 | 0 | +0.15 | +0.08 | +0.04 |
| 52 | II - 27 | Present Invention | +0.01 | 0 | 0 | +0.12 | +0.05 | +0.03 |
| 53 | II - 33 | Present Invention | +0.01 | 0 | 0 | +0.12 | +0.06 | +0.03 |

According to the present invention (Nos. 47 to 53), the increase of stain not only just after processing but also after standing for long time since processing is small.

TABLE 7

| No. | Additive | Dmin (Immediately after the processing) B | G | R | Dmin (With elapse of time) B | G | R | Remarks |
|---|---|---|---|---|---|---|---|---|
| 47 | Hydroxylamine.Sulfate | 0.14 | 0.26 | 0.15 | 0.24 | 0.33 | 0.21 | Comparison |
| 48 | N,N-diethylhydroxylamine | 0.13 | 0.26 | 0.15 | 0.22 | 0.32 | 0.21 | Comparison |
| 49 | Glycol | 0.15 | 0.27 | 0.16 | 0.24 | 0.34 | 0.22 | Comparison |
| 50 | Hydroxide I-1 | 0.11 | 0.24 | 0.13 | 0.17 | 0.27 | 0.21 | Present Invention |
| 51 | Hydroxide I-2 | 0.11 | 0.24 | 0.13 | 0.18 | 0.27 | 0.21 | Present Invention |
| 52 | Hydroxide I-16 | 0.11 | 0.24 | 0.14 | 0.19 | 0.27 | 0.21 | Present Invention |
| 53 | Hydroxide I-24 | 0.11 | 0.23 | 0.13 | 0.17 | 0.26 | 0.20 | Present Invention |
| 54 | Hydroxide I-28 | 0.10 | 0.22 | 0.12 | 0.16 | 0.25 | 0.19 | Present Invention |
| 55 | Hydroxide I-29 | 0.10 | 0.22 | 0.12 | 0.16 | 0.26 | 0.19 | Present Invention |
| 56 | Hydroxide I-31 | 0.10 | 0.21 | 0.11 | 0.16 | 0.24 | 0.19 | Present Invention |
| 57 | Hydroxide I-41 | 0.10 | 0.21 | 0.11 | 0.16 | 0.25 | 0.19 | Present Invention |
| 58 | Hydroxide I-53 | 0.10 | 0.21 | 0.12 | 0.16 | 0.25 | 0.19 | Present Invention |

The sample in an unexposed state was processed, and the minimum density (Dmin) immediately after the processing and that after allowing the processed sample

EXAMPLE 11

A color photographic paper was prepared in the same manner as in Example 3, except that the spectral sensitizers for the emulsion layers were changed as shown below:

(a) Spectral SEnsitizer for Blue-Sensitive Emulsion Layer

-continued

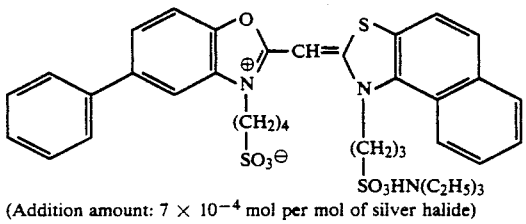

(Addition amount: $7 \times 10^{-4}$ mol per mol of silver halide)

(b) Spectral Sensitizer for Green-Sensitive Emulsion Layer

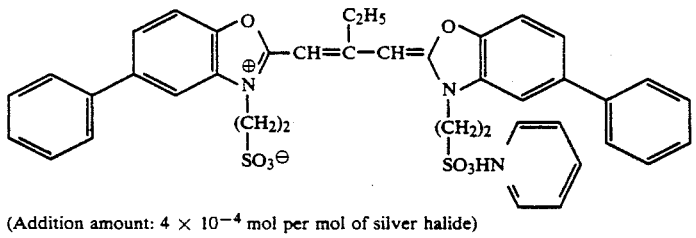

(Addition amount: $4 \times 10^{-4}$ mol per mol of silver halide)

(c) Spectral Sensitizer for Red-STnsitive Emulsion Layer

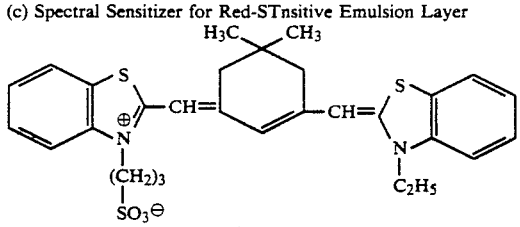

(Addition amount: $2 \times 10^{-4}$ mol per mol of silver halide)

The color photographic paper was imagewise exposed, processed as in Example 8, and subjected to a running test (continuous processing) until the amount of the replenisher for each color developer reached 3 times the volume of the tank (10 l). In this case, however, in the color developer, triethanolamine and 5-methyl-7-hydroxy-3,4-triazaindrizine were omitted and 1,2-dihydroxybenzene-3,4,6-trisulfonic acid was added to each of the tank liquid and the replenisher in an amount of 300 mg. Also, the following wash water was used as the rinse liquid:

Wash Water (Replenisher was same as the tank liquid)

City water was passed through a mixed bed type column packed with an H-type strong acid cation exchange resin, Diaion SK-1B (made by Mitsubishi Chemical Industries Ltd.) and an OH-type strong basic anion exchange resin, Diaion SA-10A to provide water having the following properties:

| | |
|---|---|
| Calcium ion content | 1.1 mg/liter |
| Magnesium ion content | 0.5 mg/liter |
| pH | 6.9 |

And then, 20 mg/liter of sodium isocyanurate dichloride was added thereto as a fungicide.

After continuous processing, the same evaluations as in Example 8 were performed and almost the same results were obtained.

EXAMPLE 12

A multilayer photographic paper having a layer structure shown below on a paper support both surfaces of which were coated with polyethylene was prepared.

| | |
|---|---|
| Layer E9 | Protective layer |
| Layer E8 | Ultraviolet absorbing layer |
| Layer E7 | Blue-sensitive emulsion layer |
| Layer E6 | Ultraviolet absorbing layer |
| Layer E5 | Yellow filter layer |
| Layer E4 | Ultraviolet absorbing layer |
| Layer E3 | Green-sensitive emulsion layer |
| Layer E2 | Ultraviolet absorbing layer |
| Layer E1 | Red-sensitive emulsion layer |

The coating compositions for the layers were prepared as follows.

Preparation of Coating Composition for Layer E1

To 13.4 g of cyan coupler (ExCC-1), 5.7 g color image stabilizer ($E_xSA$-1) and 10.7 g of polymer were added 40 ml of ethylacetate and 7.7 ml of solvent($E_xS$-1) to form a solution.

The resulting solution was dispersed by emulsification in 185 ml of 10% gelatin aqueous solution containing 8 ml of 10% aqueous solution of sodium dodecylbenzenesulfonate.

An emulsion in which a red-sensitive sensitizing dye shown below was added to an internal latent image type emulsion (Ag 63 g/kg) in an amount of $2.5 \times 10^{-4}$ mol per mol of silver.

The resulting dispersion was mixed and dissolved with the above emulsion so as to have the following composition to prepare the first coating composition.

Coating compositions for Layers E2 to E9 and Layers B1 and B2 were prepared in the same manner as described above.

Each of the layers further contained sodium 1-oxy-3,5-dichloro-s-triazine as a gelatin hardening agent.

The following compounds were used as a spectral sensitizing dye.

Red Spectral Sensitizing Dye

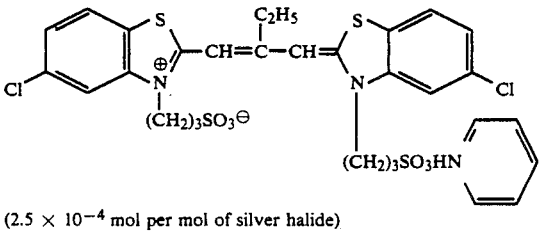

($2.5 \times 10^{-4}$ mol per mol of silver halide)

Green Spectral Sensitizing Dye

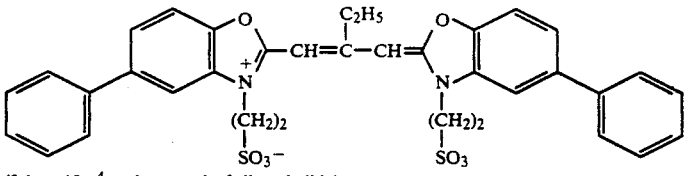

($3.1 \times 10^{-4}$ mol per mol of silver halide)

Blue Spectral Sensitizing Dye

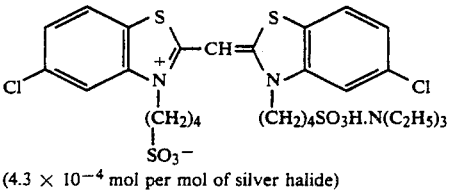

($4.3 \times 10^{-4}$ mol per mol of silver halide)

The following dyes were used as an irradiation preventing dye.

Irradiation Preventing Dye for Green-sensitive Emulsion layer

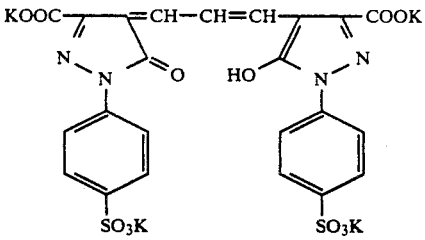

Irradiation Preventing Dye for Red-sensitive Emulsion Layer

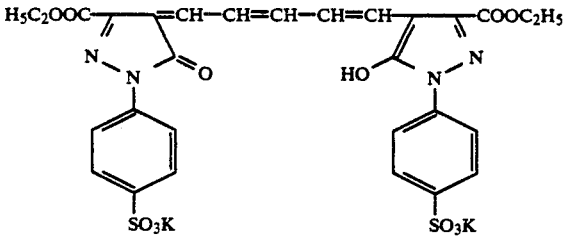

(Layer Structure)

Compositions for each layer are shown below. Numbers show a coating amount per m². Amounts of silver halide emulsion and collidal silver are represented by a coating amount of silver.

| Support<br>Polyethylene Laminated Paper<br>(Polyethylene layer at the side of the first layer contains a white pigment ($TiO_2$) and a bluing dye) | |
|---|---|
| Layer E1 | |
| Silver Halide Emulsion | 0.39 g |

-continued

| Support<br>Polyethylene Laminated Paper<br>(Polyethylene layer at the side of the first layer contains a white pigment ($TiO_2$) and a bluing dye) | |
|---|---|
| Gelatin | 1.35 g |
| Cyan Coupler ($E_xCC$-1) | 0.40 g |
| Color Image Stabilizer ($E_xSA$-1) | 0.17 g |
| Polymer ($E_xP$-1) | 0.32 g |
| Solvent ($E_xS$-1) | 0.23 g |
| Development Adjuster ($E_xGC$-1) | 32 mg |
| Stabilizer ($E_xA$-1) | 5.8 mg |
| Nucleating Accelerator ($E_xZS$-1) | 0.37 mg |
| Nucleating Agent ($E_xZK$-1) | 9.9 μm |
| Layer E2 | |
| Gelatin | 1.6 g |
| Ultraviolet Absorbent ($E_xUV$-1) | 0.62 g |
| Color Mixing Preventing Agent ($E_xKB$-1) | 0.06 g |
| Solvent ($E_xS$-2) | 0.24 g |
| layer E3 | |
| Silver halide Emulsion | 0.27 g |
| Gelatin | 1.79 g |
| Magenta Coupler ($E_xMC$-1) | 0.32 g |
| Color Image Stabilizer ($E_xSA$-2) | 0.20 g |
| Solvent ($E_xS$-3) | 0.65 g |
| Development Adjuster ($E_xGC$-1) | 22 mg |
| Stabilizer ($E_xA$-1) | 4 mg |
| Nucleating Accelerator ($E_xZS$-1) | 0.26 mg |
| Nucleating Agent ($E_xZK$-1) | 3.4 μm |
| Layer E4 | |
| Gelatin | 0.53 g |
| Ultraviolet Absorbent ($E_xUV$-1) | 0.21 g |
| Color Mixing Preventing Agent ($E_xKB$-2) | 0.02 g |
| Solvent ($E_xS$-2) | 0.08 g |
| Layer E5 | |
| Colloidal Silver | 0.10 g |
| Gelatin | 0.53 g |
| Ultraviolet Absorbent | 0.21 g |
| Color Mixing Preventing Agent | 0.02 g |
| Solvent ($E_xS$-2) | 0.08 g |
| Layer E6 | |
| Same as Layer E4 | |
| Layer E7 | |

-continued

| Support<br>Polyethylene Laminated Paper<br>(Polyethylene layer at the side of the first layer contains a white pigment ($TiO_2$) and a bluing dye) | |
|---|---|
| Silver halide Emulsion | 0.26 g |
| Gelatin | 1.83 g |
| Yellow Coupler ($E_xYC$-1) | 0.83 g |
| Color Image Stabilizer ($E_xSA$-3) | 0.19 g |
| Solvent ($E_xS$-4) | 0.35 g |
| Development Adjuster ($E_xGC$-1) | 32 mg |
| Stabilizer ($E_xA$-1) | 2.9 mg |
| Nucleating Accelerator ($E_xZS$-1) | 0.2 mg |
| Nucleating Agent ($E_xZK$-1) | 2.5 μm |
| Layer E8 | |
| Gelatin | 0.53 g |
| Ultraviolet Absorbent ($E_xUV$-1) | 0.21 g |
| Solvent ($E_xS$-2) | 0.08 g |
| Layer E9 | |

-continued

| Support<br>Polyethylene Laminated Paper<br>(Polyethylene layer at the side of the first layer contains a white pigment ($TiO_2$) and a bluing dye) | |
|---|---|
| Gelatin | 1.33 g |
| Modified Acrylic Copolymer of Polyvinylalcohol (modified ratio 17%) | 0.17 g |
| Liquid Raraffin | 0.03 g |
| Latex grains of polymethyl-mtahcrylate (average grainsize 2.8 μm) | 0.05 g |
| Layer B1 | |
| Gelatin | 8.7 g |
| Layer B2 | |
| Same as Layer E9 | |

Compounds used as as in shown below.

($E_xCC$-1) Cyan Coupler

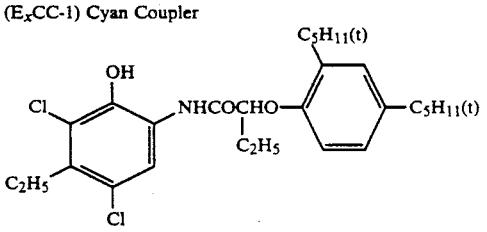

($E_xMC$-1) Magenta Coupler

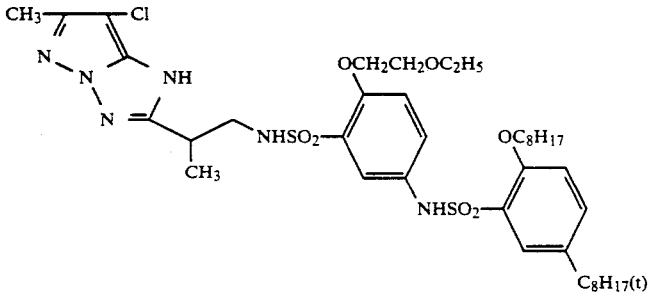

($E_xYC$-1) Yellow Coupler

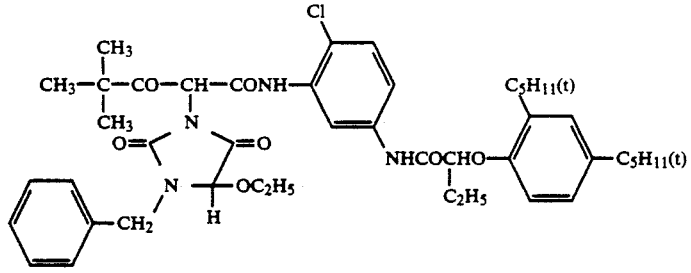

($E_xSA$-1) Color Image Stabilizer

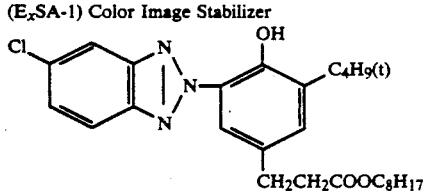

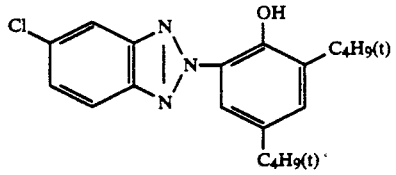

-continued
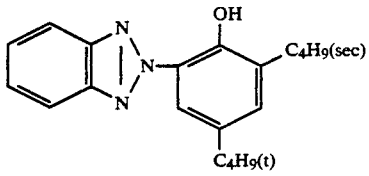
[mixture ratio 5:8:9 (by weight)]
($E_x$SA-2) Color Image Stabilizer
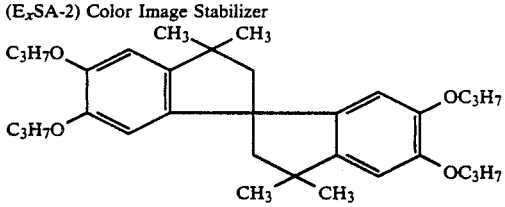
($E_x$SA-3) Color Image Stabilizer
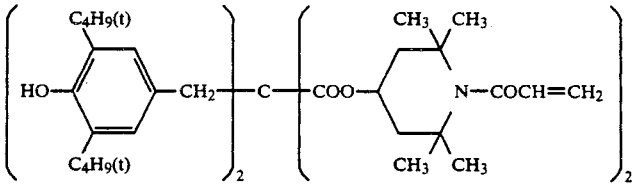
($E_x$UV-1) Ultraviolet Absorbent
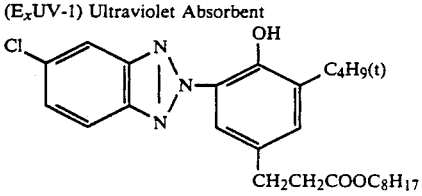
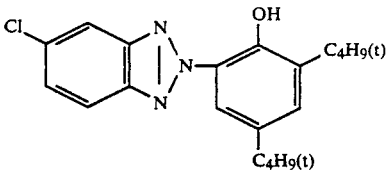
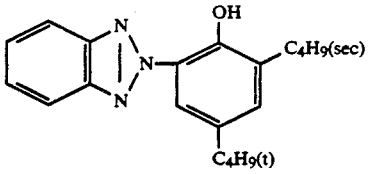
[mixture ratio 2:9:8 (by weight)]
($E_x$KB-1) Color Mixing Preventing Agent
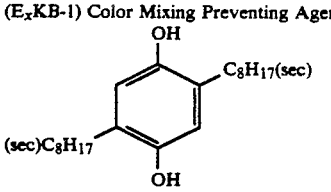
($E_x$KB-2) Color Mixing Preventing Agent
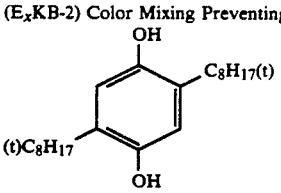

-continued ($E_xGC$-1) Development Adjustor

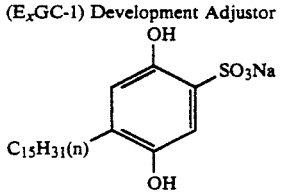

($E_xA$-1) Stabilizer
4-hydroxy-6-methyl-1,3,3a,7-tetrazaindene ($E_xXS$-1) Nucleating Acelerator
2-(3-dimetjhuylaminopropylthio)-5-merca[to-1,3,4-thiazole hydrochloride (ZK-1) Nuclating Agent
6-ethoxythiocarbonylamino-2-methyl-1-propargylquinolium trifluoromethane sulphonate The thus prepared sample was imagewise exposed to light and continuously development-processed according to the steps shown below, with the composition of the color developer being varied as shown in Table 9.

| Processing Step | Temp. | Time | Amount* of Replenisher | Tank Volume |
|---|---|---|---|---|
| Color Development | 38° C. | 1'40" | 300 ml | 10 l |
| Blix | 33° C. | 60" | 300 ml | 5 l |
| Rinse (1) | 30–34° C. | 20" | — | 2 l |
| Rinse (2) | 30–34° C. | 20" | — | 2 l |
| Drying | 70–80° C. | 50" | | |

Note: *Per $m^2$ of light-sensitive material

The rinse step was carried out in a counter-current system using three tank is of from (3) to (1).

The processing solutions had the following compositions.

-continued

| | Tank Liquid | Replenisher |
|---|---|---|
| Triethanolamine | 10.0 g | 10.0 g |
| Water to make | 1000 ml | 1000 ml |
| pH (25° C.) | 10.20 | 10. 60 |
| Blix Bath Composition: | | |
| Water | 400 ml | 400 ml |
| Ammonium thiosulfate (70%) | 200 ml | 300 ml |
| Sodium sulfite | 20 g | 40 g |
| Ammonium (ethyelnediamine-tetraacetato)iron (III) | 60 g | 120 g |
| Disodium ethylenediamine-tetraacetate | 5 g | 10 g |
| Water to make | 1000 ml | 1000 ml |
| pH (25° C.) | 6.70 | 6.30 |
| Wash Water (Replenisher is same as tank liquid) | | |
| Ion exchanged water (Ca ions and Mg ions contained are each 3 ppm or less) | | |

TABLE 9

| No. | Additive | Dmin (Immediately after the processing) B | G | R | Dmin (With elapse of time) B | G | R | Remarks |
|---|---|---|---|---|---|---|---|---|
| 59 | Hydroxylamine.Sulfate | 0.16 | 0.20 | 0.18 | 0.28 | 0.33 | 0.22 | Comparison |
| 60 | N,N-diethylhydroxyylamine | 0.15 | 0.20 | 0.18 | 0.26 | 0.32 | 0.22 | Comparison |
| 61 | Hydroxide I-1 | 0.12 | 0.17 | 0.17 | 0.19 | 0.26 | 0.20 | Present Invention |
| 62 | Hydroxide I-24 | 0.11 | 0.16 | 0.16 | 0.18 | 0.25 | 0.19 | Present Invention |
| 63 | Hydroxide I-28 | 0.11 | 0.16 | 0.16 | 0.18 | 0.25 | 0.19 | Present Invention |
| 64 | Hydroxide I-29 | 0.11 | 0.16 | 0.16 | 0.18 | 0.25 | 0.19 | Present Invention |
| 65 | Hydroxide I-47 | 0.11 | 0.17 | 0.17 | 0.19 | 0.26 | 0.20 | Present Invention |

| | Tank Liquid | Replenisher |
|---|---|---|
| Color Developer Composition: | | |
| Water | 800 ml | 800 ml |
| Diethylenetriaminepenta-acetic acid | 1.0 g | 1.0 g |
| Nitrilotriacetic acid | 2.0 g | 2.0 g |
| 1-Hydroxyethylidene-1,1-diphophonic acid | 2.0 g | 2.0 g |
| Ethylenediamine N,N,N',N-tetramethylene phophonic acid | 1.5 g | 1.5 g |
| Potassium bromide | 0.5 g | — |
| Potassium carbonate | 30 g | 30 g |
| N-Ethyl-N-(β-mehtanesulfon-amidoethyl)-3-methyl-4-aminoaniline sulfate | 5.5 g | 7.5 g |
| Additive (see Table 9) | $5 \times 10^{-2}$ mol | $7 \times 10^{-2}$ mol |
| Fluorescent brightening agent ("WHITEX 4" produced by Sumitomo Chemical Co., Ltd.) | 1.5 g | 2.0 g |

The sample in an unexposed state was processed, and the minimum density immediately after the processing and that after allowing the processed sample at 60° C. and 70% RH for 2 months were measured The change in the minimum density is shown in Table 9 in the same manner as in Example 4.

It can be seen that the photographic papers according to the present invention (Sample Nos.61 to 65) not only have low minimum densities immediately after processing but undergo only a small increase in stain due to aging.

EXAMPLE 13

A multilayer photographic paper having a layer structure shown below on a paper support both surfaces of which were coated with polyethylene was prepared. The polyethylene layer of the support on the side to be coated contained titanium dioxide as a white pigment and a bluing dye.

The coating compositions for the layers were prepared as follows.

Preparation of Coating Composition for Layer 1

To 19.1 g of yellow coupler (ExY-1) and 4.4 g of dye image stabilizer (Cpd-1) were added 27.2 ml of ethyl acetate and 7.7 ml (8.0 g) of high-boiling solvent (Solv-1) to form a solution. The resulting solution was dispersed by emulsification in 185 ml of a 10% gelatin aqueous solution containing 8 ml of a 10 aqueous solution of sodium dodecylbenzenesulfonate. The resulting dispersion was mixed with emulsions (EM7) and (EM8), and the gelatin concentration was adjusted so as to have a composition shown below to prepare a coating composition for Layer 1.

The coating compositions for Layers 2 to 7 were prepared in the same manner as described above.

Each of the layers further contained sodium 1-oxy-3,5-dichloro-s-triazine as a gelatin hardening agent. In addition, (Cpd-1) was used as a thickening agent.

| Layer Structure | |
|---|---|
| Layer 1 (Blue-Sensitive Layer): | |
| Mono-dispersed silver chlorobromide emulsion (EM7) spectrally sensitized with sensitizing dye (ExS-1) | 0.15 g of Ag/m$^2$ |
| Mono-dispersed silver chlorobromide emulsion (EM8) spectrally sensitized with sensitizing dye (ExS-1) | 0.15 g of Ag/m$^2$ |
| Gelatin | 1.86 g/m$^2$ |
| Yellow coupler (ExY-1) | 0.82 g/m$^2$ |
| Dye image stabilizer (Cpd-2) | 0.19 g/m$^2$ |
| Solvent (Solv-1) | 0.35 g/m$^2$ |
| Layer 2 (Color Mixing Preventing Layer): | |
| Gelatin | 0.99 g/m$^2$ |
| Color mixing preventing agent (Cpd-3) | 0.08 g/m$^2$ |
| Layer 3 (Green-Sensitive Layer): | |
| Mono-dispersed silver chlorobromide emulsion (EM9) spectrally sensitized with sensitizing dyes (ExS-2 & 3) | 0.12 g of Ag/m$^2$ |
| Mono-dispersed silver chlorobromide emulsion (EM10) spectrally sensitized with sensitizing dyes (ExS-2 & 3) | 0.24 g of Ag/m$^2$ |
| Gelatin | 1.24 g/m$^2$ |
| Magenta coupler (ExM-1) | 0.39 g/m$^2$ |
| Dye image stabilizer (Cpd-4) | 0.25 g/m$^2$ |
| Dye image stabilizer (Cpd-5) | 0.12 g/m$^2$ |
| Solvent (Solv-2) | 0.25 g/m$^2$ |
| Layer 4 (Ultraviolet Absorbing Layer): | |
| Gelatin | 1.60 g/m$^2$ |
| Ultraviolet absorbent (Cpd-6/Cpd-7/Cpd-8 = 3/2/6 by weight) | 0.70 g/m$^2$ |

-continued

| Layer Structure | |
|---|---|
| Color mixing preventing agent (Cpd-9) | 0.05 g/m$^2$ |
| Solvent (Solv-3) | 0.42 g/m$^2$ |
| Layer 5 (Red-Sensitive Layer): | |
| Mono-dispersed silver chlorobromide emulsion (EM11) spectrally sensitized with sensitizing dyes (ExS-4 & 5) | 0.07 g of Ag/m$^2$ |
| Mono-dispersed silver chlorobromide emulsion (EM12) spectrally sensitized with sensitizing dyes (ExS-4 & 5) | 0.16 g of Ag/m$^2$ |
| Gelatin | 0.92 g/m$^2$ |
| Cyan coupler (ExC-1) | 1.46 g/m$^2$ |
| Cyan coupler (ExC-2) | 1.84 g/m$^2$ |
| Dye image stabilizer (Cpd-7/Cpd-8/Cpd-10 = 3/4/2 by weight) | 0.17 g/m$^2$ |
| Polymer for dispersion (Cpd-11) | 0.14 g/m$^2$ |
| Solvent (Solv-1) | 0.20 g/m$^2$ |
| Layer 6 (Ultraviolet Absorbing Layer): | |
| Gelatin | 0.54 g/m$^2$ |
| Ultraviolet absorbent (Cpd-6/Cpd-8/Cpd-10 = 1/5/3 by weight) | 0.21 g/m$^2$ |
| Solvent (Solv-4) | 0.08 g/m$^2$ |
| Layer 7 (Protective Layer): | |
| Gelatin | 1.33 g/m$^2$ |
| Acryl-modified copolymer of polyvinyl alcohol (degree of modification: 17%) | 0.17 g/m$^2$ |
| Liquid paraffin | 0.03 g/m$^2$ |

In the sample preparation (Cpd-12) and (Cpd-13) were used as anti-irradiation dyes. Further, in each of layers, Alkanol XC (produced by E. I. Du Pont), a sodium alkylbenzenesulfonate, a succinic ester, and Magefacx F-120 (produced by Dai-Nippon Ink K.K.) were used as an emulsifier or a coating aid; and (Cpd-14) and (Cpd-15) were used as a stabilizer for silver halide.

The emulsions used in the sample preparation are tabulated below.

| Emulsion No. | Grain Form | Grain Size (μm) | Br Content (mol %) | Coefficient of Variation* |
|---|---|---|---|---|
| EM7 | cubic | 1.1 | 1.0 | 0.10 |
| EM8 | cubic | 0.8 | 1.0 | 0.10 |
| EM9 | cubic | 0.45 | 1.5 | 0.09 |
| EM10 | cubic | 0.34 | 1.5 | 0.09 |
| EM11 | cubic | 0.45 | 1.5 | 0.09 |
| EM12 | cubic | 0.34 | 1.6 | 0.10 |

Note: *Standard deviation/mean grain size

The compounds used in the Example 13 are shown below.

ExY-1

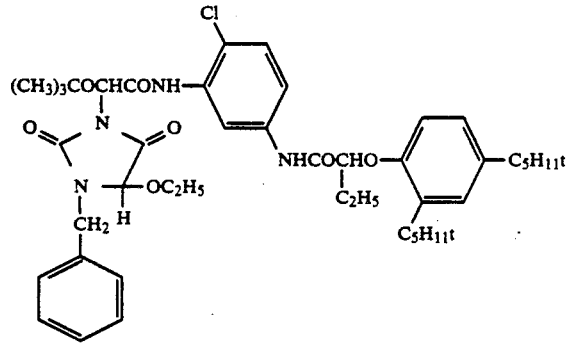

-continued
ExM-1
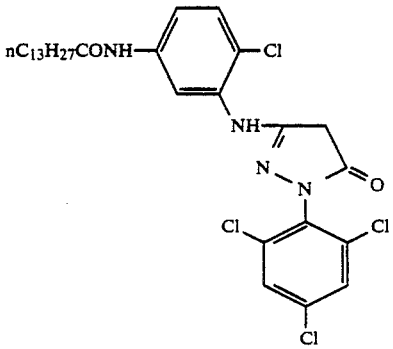
ExC-1
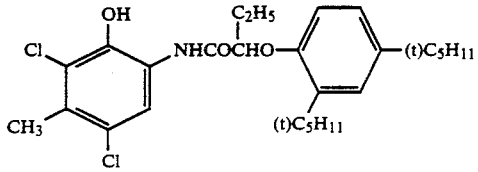
ExC-2
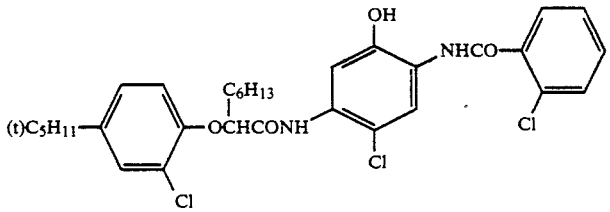
ExS-1
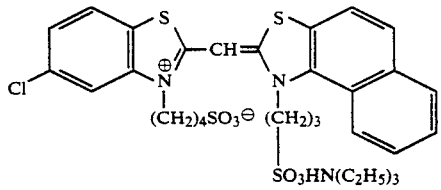
ExS-2
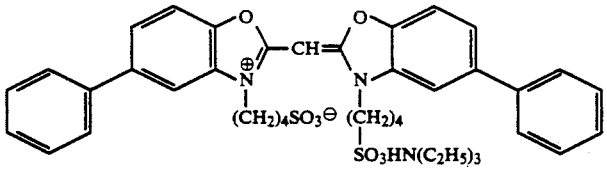
ExS-3
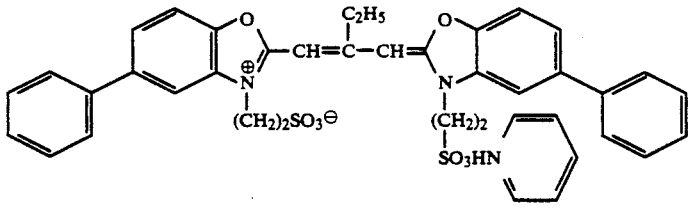
ExS-4
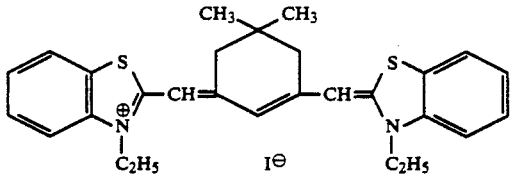

-continued
ExS-5
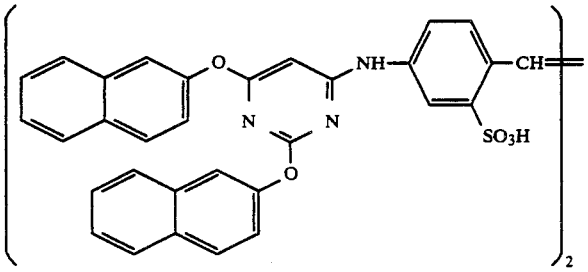
Cpd-1
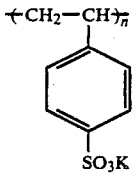
Cpd-2
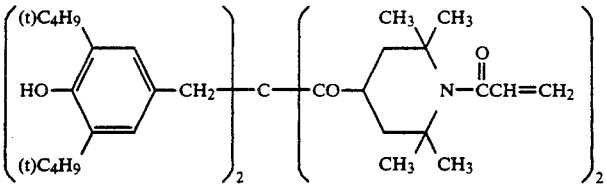
Cpd-3
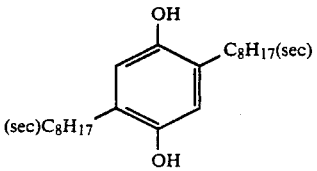
Cpd-4
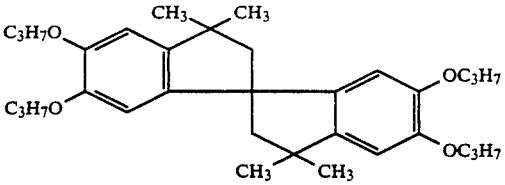
Cpd-5
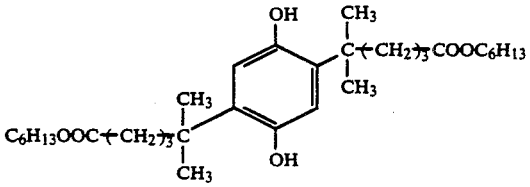
Cpd-6
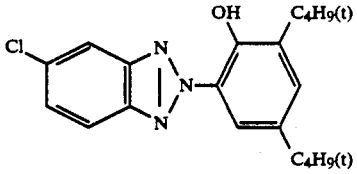
Cpd-7
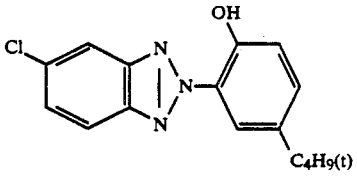

-continued

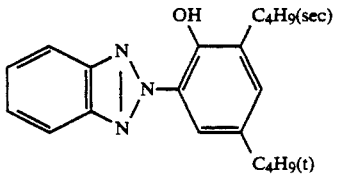

Cpd-8

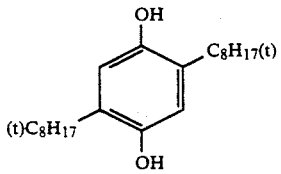

Cpd-9

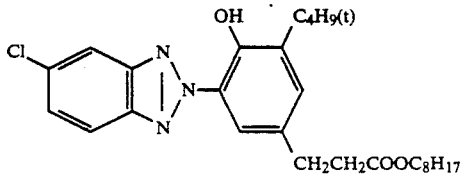

Cpd-10

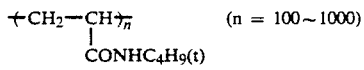

Cpd-11

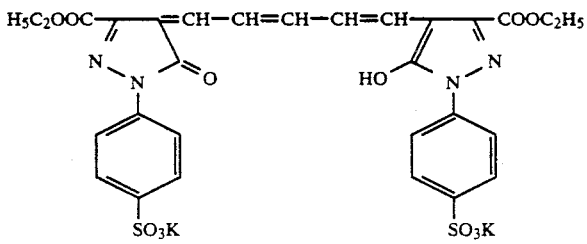

Cpd-12

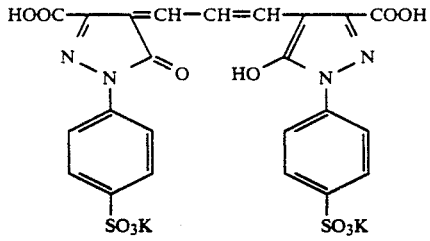

Cpd-13

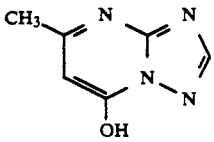

Cpd-14

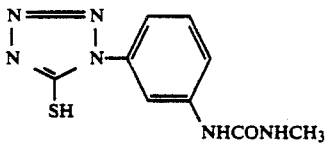

Cpd-15

| | |
|---|---|
| Dibutylphthalate | Solv-1 |
| Trioctylphosphate | Solv-2 |
| Trinonylphosphate | Solv-3 |
| Tricresylphosphate | Solv-4 |

The gelatin used was alkali-processed gelatin having isoelectric point of 5.0.

By following the same procedures as in Example 8, superior results were obtained in the present invention.

EXAMPLE 14

By following the same procedures as in Example 7 except for using the following compounds instead of additive II-1 used in Example 7, NOs. 23 and 27, the same superior results as in Example 7 were obtained.

II-II, II-19, KK-32, II-34,

II-41, II-44, and II-48.

As the results of the above examples show, by processing according to this invention, the stability and the coloring properties of a color developer are greatly improved, fog formation and the change of gradient are greatly reduced, and color images having excellent photographic properties are obtained, even in the processing using a color developer which was aged for a long period of time.

The effect of this invention is particularly remarkable in a color developer containing substantially no benzyl alcohol, which is a harmful pollutant.

Also, the excellent effects of this invention are more remarkable in color developers containing low concentrations of sulfite ion. Furthermore, the process is remarkably advantageous when processing color photographic materials containing the specific cyan couplers. Even in continuous processing, fog formation is greatly reduced and stability of images with elapse of time is superior.

While the invention has been described in detail and with reference to specific embodiments thereof, it will be apparent to one skilled in the art that various changes and modification can be made therein without departing from the spirit and scope thereof.

What is claimed is:

1. A method for forming a negative image in a silver halide color photographic material containing an emulsion capable of forming a negative image including the step of developing an imagewise exposed silver halide color photographic material with a color developing solution containing at least one aromatic primary amine developing agent selected from the group consisting of 2-methyl-4-aniline and N-ethyl-N-(β-methanesulfonamidoethyl)-3-methyl-4-aminoaniline and said solution containing substantially no p-aminophenol type developing agent, substantially no color coupler, at most about 2 ml of benzyl alcohol per liter of said developing solution and at least one hydrazide represented by the following formula (I) or (II)

$$R^1—X^1—NHNH—R^2 \quad (I)$$

in which $X^1$ represents —CO—, —$SO_2$— or $$—\overset{\overset{NH}{\|}}{C}—;$$

$R^1$ represents a hydroxyl group, a hydroxyamino group, a carbamoyl group, a hydrazinocarbonyl group, an amino group, or a hydrazino group; and $R^2$ represents a hydrogen atom, an alkyl group, or an aryl group; provided that the $R^1$ or $R^2$ groups of at least two of the hydrazide groups may be linked to form a dimer or higher polymer of the hydrazide;

$$R^3—X^2—NHNH—R^4 \quad (II)$$

in which $X^2$ represents —CO— or —$SO_2$—; $R^3$ represents a hydrogen atom, an alkyl group, an aryl group, a heterocyclic group, an alkoxy group, or an aryloxy group; and $R^4$ represents a hydrogen atom, an alkyl group or an aryl group; provided that the $R^3$ or $R^4$ groups of at least two of the hydrazide groups may be linked to form a dimer or higher polymer of the hydrazide.

2. The method for processing a silver halide color photographic material as claimed in claim 1, wherein said carbamoyl group, hydrazinocarbonyl group, amino group hydrazino group, alkyl group, aryl group, heterocyclic group, alkoxy group, heterocyclic group, alkoxy group, aryloxy group, carbamoyl group, hydrazinocarbamoyl group each have at least one substituent.

3. The method for processing a silver halide color photographic material as claimed in claim 1, wherein said amino group represented by $R^1$ has at most 10 carbon atoms and said hydrazino group represented by $R^1$ has at most 10 carbon atoms, and said alkyl group represented by $R^2$ has 1 to 15 carbon atoms and said aryl group represented by $R^2$ has 6 to 10 carbon atoms.

4. The method for processing a silver halide color photographic material as claimed in claim 1, wherein said alkyl group represented by $R^3$ has 1 to 15 carbon atoms, said aryl group represented by $R^3$ has 6 to 10 carbon atoms, said heterocyclic group represented by $R^3$ has 1 to 10 carbon atoms, said alkoxy group represented by $R^3$ has 1 to 10 carbon atoms and said aryloxy group represented by $R^3$ has 6 to 10 carbon atoms, and said alkyl group represented by $R^4$ has 1 to 15 carbon atoms and said aryl group represented by $R^4$ has 6 to 10 carbon atoms.

5. The method for processing a silver halide color photographic material as claimed in claim 1, wherein $R^1$ represents an amino group, $R^2$ represents a hydrogen atom or an alkyl group $X^1$ represents —CO—.

6. The method for processing a silver halide color photographic material as claimed in claim 1, wherein $R^3$ represents a hydrogen atom, an alkyl group, an aryl group or an alkoxy group, $R^4$ represents a hydrogen atom or an alkyl group and $X^2$represents —CO—.

7. The method for processing a silver halide color photographic material as claimed in claim 1, wherein said compound represented by formula (I) or (II) is present in an amount of from about $1.5\times10^{-3}$ to $3.0\times10^{-1}$ mol per liter of said developing solution and said aromatic primary amine color developing agent is present in an amount of from about 0.1 g to 20 g per liter of said developing.

8. A method for forming a negative image in a silver halide color photographic material containing an emulsion capable of forming a negative image including the step of developing an imagewise exposed silver halide color photographic material with a color developing solution containing at least one aromatic primary amine developing agent selected from the group consisting of 2-methyl-4-aniline and N-ethyl-N-(β-methanesulfonamidoethyl)-3-methyl-4-aminoaniline and said solution containing substantially no p-aminophenol type developing agent, substantially no color coupler, at most about 2 ml of benzyl alcohol per liter of said developing solution and at least one hydrazide represented by the following formula (I) and (II)

$$R^1—X^1—NHNH—R^2 \quad (I)$$

in which $X^1$ represents —CO—, —$SO_2$— or $$-\overset{\overset{\displaystyle NH}{\|}}{C}-;$$

$R^1$ represents an arylamino group, a hydroxyl group, a hydroxyamino group, a carbamoyl group, a hydrazinocarbonyl group, or a substituted or unsubstituted alkylamino group; and $R^2$ represents a hydrogen atom, an alkyl group, or an aryl group; provided that the $R^1$ or $R^2$ groups of at least two of the hydrazide groups may be linked to form a dimer or higher polymer of the hydrazide;

$$R^3—X^2—NHNH—R^4 \qquad (II)$$

in which $X^2$ represents —CO— or —$SO_2$—; $R^3$ represents a hydrogen atom, an alkyl group, an aryl group, a heterocyclic group, an alkoxy group, or an aryloxy group; and $R^4$ represents a hydrogen atom, an alkyl group or an aryl group; provided that the $R^3$ or $R^4$ groups of at least two of the hydrazide groups may be linked to form a dimer or higher polymer of the hydrazide.

9. The method for processing a silver halide photographic material as claimed in claim 1, wherein said $R^4$ is a hydrogen atom or an alkyl group.

10. The method for processing a silver halide photographic material as claimed in claim 8, wherein said $R^4$ is a hydrogen atom or an alkyl group.

* * * * *